US008737638B2

(12) United States Patent
Sakurada et al.

(10) Patent No.: US 8,737,638 B2
(45) Date of Patent: May 27, 2014

(54) AUDIO SIGNAL PROCESSING DEVICE, AUDIO SIGNAL PROCESSING SYSTEM, AND AUDIO SIGNAL PROCESSING METHOD

(75) Inventors: Shinya Sakurada, Hamamatsu (JP); Kei Nakayama, Hamamatsu (JP); Takashi Suzuki, Hamamatsu (JP); Mitsuru Fukui, Hamamatsu (JP); Hiroyuki Iwase, Hamamatsu (JP); Takuro Sone, Hamamatsu (JP)

(73) Assignee: Yamaha Corporation (JP)

( * ) Notice: Subject to any disclaimer, the term of this patent is extended or adjusted under 35 U.S.C. 154(b) by 697 days.

(21) Appl. No.: 12/936,895

(22) PCT Filed: Jul. 29, 2009

(86) PCT No.: PCT/JP2009/063513

§ 371 (c)(1),
(2), (4) Date: Oct. 7, 2010

(87) PCT Pub. No.: WO2010/013754

PCT Pub. Date: Feb. 4, 2010

(65) Prior Publication Data

US 2011/0033061 A1 Feb. 10, 2011

(30) Foreign Application Priority Data

| | | |
|---|---|---|
| Jul. 30, 2008 | (JP) | 2008-196492 |
| Sep. 29, 2008 | (JP) | 2008-249723 |
| Sep. 30, 2008 | (JP) | 2008-252075 |
| Sep. 30, 2008 | (JP) | 2008-253532 |
| Dec. 5, 2008 | (JP) | 2008-310402 |
| Dec. 25, 2008 | (JP) | 2008-331081 |

(51) Int. Cl.
*H04R 27/00* (2006.01)

(52) U.S. Cl.
USPC ..... 381/82; 381/81; 381/333; 381/119; 713/176

(58) Field of Classification Search
CPC ..... G10H 2240/041; G10H 2240/115; G10H 3/186; G10H 1/46; G10H 1/0058; G10H 1/366; G10L 19/018; H04R 3/005; H04R 3/04; H04R 27/00; H04R 2227/003
USPC ..... 381/381, 119, 122, 111, 82, 80, 77, 381/333, 332, 87, 306, 388, 386; 713/177, 713/178, 179
See application file for complete search history.

(56) References Cited

U.S. PATENT DOCUMENTS

| | | | |
|---|---|---|---|
| 4,680,740 | A | 7/1987 | Treptow |
| 4,964,000 | A | 10/1990 | Kanota et al. |

(Continued)

FOREIGN PATENT DOCUMENTS

| | | | |
|---|---|---|---|
| JP | 63-128810 | A | 6/1988 |
| JP | 5-091063 | A | 4/1993 |

(Continued)

OTHER PUBLICATIONS

Ryuke Tachibana, "Audio Watermarking for Live Performace" International Society for Optical Engineering, U.S. vol. 5020, Jun. 1, 2003, pp. 32-42, XP002442545. Cited in related U.S. Appl. No. 12/935,463.

(Continued)

*Primary Examiner* — Vivian Chin
*Assistant Examiner* — Con P Tran
(74) *Attorney, Agent, or Firm* — Rossi, Kimms & McDowell LLP

(57) ABSTRACT

An audio signal processing device includes multiple input reception units to which analog audio signals, on which watermark information indicating identification information is superimposed, are input, an extraction unit that is adapted to extract the identification information from each of the analog audio signals input to the multiple input reception units, and a display unit for performing display depending on the identification information extracted by the extraction unit in correspondence with the input reception unit to which the analog audio signal, from which the identification information is extracted, is input, or signal processing unit for performing signal processing depending on the identification information extracted by the extraction unit for the analog audio signal, from which the relevant identification information is extracted, and outputting the processed analog audio signal.

30 Claims, 48 Drawing Sheets

(56) References Cited

U.S. PATENT DOCUMENTS

| | | | | |
|---|---|---|---|---|
| 5,025,702 | A | 6/1991 | Oya | |
| 5,212,551 | A | 5/1993 | Conanan | |
| 5,414,567 | A | 5/1995 | Amada et al. | |
| 5,423,073 | A | 6/1995 | Ogawa | |
| 5,612,943 | A | 3/1997 | Moses et al. | |
| 5,684,261 | A | 11/1997 | Luo | |
| 5,857,171 | A | 1/1999 | Kageyama et al. | |
| 5,886,275 | A | 3/1999 | Kato et al. | |
| 6,141,032 | A | 10/2000 | Priest | |
| 6,266,430 | B1 | 7/2001 | Rhoads | |
| 6,462,264 | B1 | 10/2002 | Elam | |
| 6,621,881 | B2 | 9/2003 | Srinivasan | |
| 7,009,942 | B2 | 3/2006 | Fujimori et al. | |
| 7,026,537 | B2 | 4/2006 | Ishii | |
| 7,161,079 | B2 | 1/2007 | Nishitani et al. | |
| 7,181,022 | B2 | 2/2007 | Rhoads | |
| 7,415,129 | B2 | 8/2008 | Rhoads | |
| 7,546,173 | B2 | 6/2009 | Waserblat et al. | |
| 7,572,968 | B2 | 8/2009 | Komano | |
| 7,620,468 | B2 | 11/2009 | Shimizu | |
| 8,023,692 | B2 | 9/2011 | Rhoads | |
| 8,103,542 | B1 | 1/2012 | Davis et al. | |
| 8,116,514 | B2 * | 2/2012 | Radzishevsky | 382/100 |
| 8,165,341 | B2 | 4/2012 | Rhoads | |
| 8,204,222 | B2 | 6/2012 | Rhoads | |
| 2001/0021188 | A1 | 9/2001 | Fujimori et al. | |
| 2001/0053190 | A1 | 12/2001 | Srinivasan | |
| 2002/0078146 | A1 | 6/2002 | Rhoads | |
| 2002/0166439 | A1 | 11/2002 | Nishitani et al. | |
| 2003/0161425 | A1 | 8/2003 | Kikuchi | |
| 2003/0190155 | A1 | 10/2003 | Tsutsui et al. | |
| 2003/0195851 | A1 | 10/2003 | Ong | |
| 2003/0196540 | A1 | 10/2003 | Ishii | |
| 2004/0137929 | A1 | 7/2004 | Jones et al. | |
| 2006/0078305 | A1 | 4/2006 | Arora et al. | |
| 2006/0133624 | A1 | 6/2006 | Waserblat et al. | |
| 2006/0219090 | A1 | 10/2006 | Komano | |
| 2006/0239503 | A1 * | 10/2006 | Petrovic et al. | 382/100 |
| 2006/0248173 | A1 | 11/2006 | Shimizu | |
| 2007/0169615 | A1 | 7/2007 | Chidlaw et al. | |
| 2007/0209498 | A1 | 9/2007 | Lindgren et al. | |
| 2007/0256545 | A1 | 11/2007 | Lee et al. | |
| 2008/0053293 | A1 * | 3/2008 | Georges et al. | 84/609 |
| 2008/0063226 | A1 | 3/2008 | Koyama et al. | |
| 2008/0101635 | A1 | 5/2008 | Dijkstra et al. | |
| 2008/0105110 | A1 | 5/2008 | Pietrusko et al. | |
| 2008/0119953 | A1 | 5/2008 | Reed et al. | |
| 2008/0243491 | A1 | 10/2008 | Matsuoka | |
| 2009/0070114 | A1 | 3/2009 | Staszak | |
| 2010/0023322 | A1 | 1/2010 | Schnell et al. | |
| 2010/0045681 | A1 | 2/2010 | Weissmueller, Jr. et al. | |
| 2010/0208905 | A1 | 8/2010 | Franck et al. | |
| 2010/0280907 | A1 | 11/2010 | Wolinsky et al. | |
| 2011/0023691 | A1 | 2/2011 | Iwase et al. | |
| 2011/0028160 | A1 | 2/2011 | Roeding et al. | |
| 2011/0029359 | A1 | 2/2011 | Roeding et al. | |
| 2011/0029362 | A1 | 2/2011 | Roeding et al. | |
| 2011/0029364 | A1 | 2/2011 | Roeding et al. | |
| 2011/0029370 | A1 | 2/2011 | Roeding et al. | |
| 2011/0066437 | A1 | 3/2011 | Luff | |
| 2011/0103591 | A1 | 5/2011 | Ojala | |
| 2011/0150240 | A1 | 6/2011 | Akiyama et al. | |
| 2011/0167390 | A1 | 7/2011 | Reed, Jr. et al. | |
| 2011/0209171 | A1 | 8/2011 | Weissmueller, Jr. et al. | |
| 2011/0290098 | A1 | 12/2011 | Thuillier | |
| 2011/0319160 | A1 | 12/2011 | Arn et al. | |
| 2012/0065750 | A1 | 3/2012 | Tissier et al. | |
| 2013/0077447 | A1 | 3/2013 | Hiratsuka | |
| 2013/0179175 | A1 | 7/2013 | Biswas et al. | |
| 2013/0243203 | A1 | 9/2013 | Franck et al. | |
| 2013/0282368 | A1 | 10/2013 | Choo et al. | |
| 2013/0305908 | A1 | 11/2013 | Iwase et al. | |

FOREIGN PATENT DOCUMENTS

| | | | |
|---|---|---|---|
| JP | 08-286687 | A | 11/1996 |
| JP | 10-093449 | A | 4/1998 |
| JP | 2000-020054 | A | 1/2000 |
| JP | 2001-008177 | A | 1/2001 |
| JP | 2001-203732 | A | 7/2001 |
| JP | 2002175089 | A | 6/2002 |
| JP | 2002341865 | A | 11/2002 |
| JP | 2003-295894 | A | 10/2003 |
| JP | 2003280664 | A | 10/2003 |
| JP | 2003316356 | A | 11/2003 |
| JP | 2004126214 | A | 4/2004 |
| JP | 2004341066 | A | 12/2004 |
| JP | 2005274851 | A | 10/2005 |
| JP | 2006-100945 | A | 4/2006 |
| JP | 2006163435 | A | 6/2006 |
| JP | 2006251676 | A | 9/2006 |
| JP | 2006-287301 | A | 10/2006 |
| JP | 2006287730 | A | 10/2006 |
| JP | 2006-323161 | A | 11/2006 |
| JP | 2006323161 | A | 11/2006 |
| JP | 2006337483 | A | 12/2006 |
| JP | 2007104598 | A | 4/2007 |
| JP | 4030036 | B2 | 1/2008 |
| JP | 2008-072399 | A | 3/2008 |
| JP | 2008-228133 | A | 9/2008 |
| WO | 2005-018097 | A2 | 2/2005 |
| WO | 2011/014292 | A1 | 2/2011 |

OTHER PUBLICATIONS

European Search Report issued in European patent application No. EP09802996.0, dated Mar. 27, 2013. Cited in related U.S. Appl. No. 12/935,463.

International Search Report issued in related PCT/JP2009/063513 mailed Nov. 2, 2009.

"Digital Mixing Console LS9, LS9-16/LS9-32 Owner's Manual", [online], 2006, Yamaha Corporation, [searched on Sep. 24, 2008], Internet URL:http://www2.yamaha.co.jp/manual/pdf/pa/japan/mixers/ls9_ja_om_d0.pdf. Full English Translation provided.

ISR issued Sep. 8, 2009 for JP2009063510 (cited in related US 2011/0023691).

Japanese office action issued in Japanese counterpart application No. JP2008-331081, dated Mar. 5, 2013. English translation provided.

Notification of Reasons for Refusal for corresponding JP 2008-196492, dated Sep. 24, 2013. English translation provided.

Notification of Reasons for Refusal for corresponding JP 2008-253532, dated Sep. 26, 2013. English translation provided.

Extended European Search Report for EP 09802994.5, dated Oct. 17, 2013. Cited in related U.S. Appl. No. 12/935,463.

Japanese Office Action cited in Japanese counterpart application No. JP2008-331081, dated Jun. 18, 2013.

Office Action issued in JP 2009-171319 dated Sep. 17, 2013. Cited in Related U.S. Appl. No. 12/935,463 in a IDS dated Oct. 7, 2013. English Translation provided.

Office Action issued in JP 2009-171321 dated Sep. 10, 2013. Cited in Related U.S. Appl. No. 12/935,463 in a IDS dated Oct. 7, 2013. English Translation provided.

* cited by examiner

FIG. 33

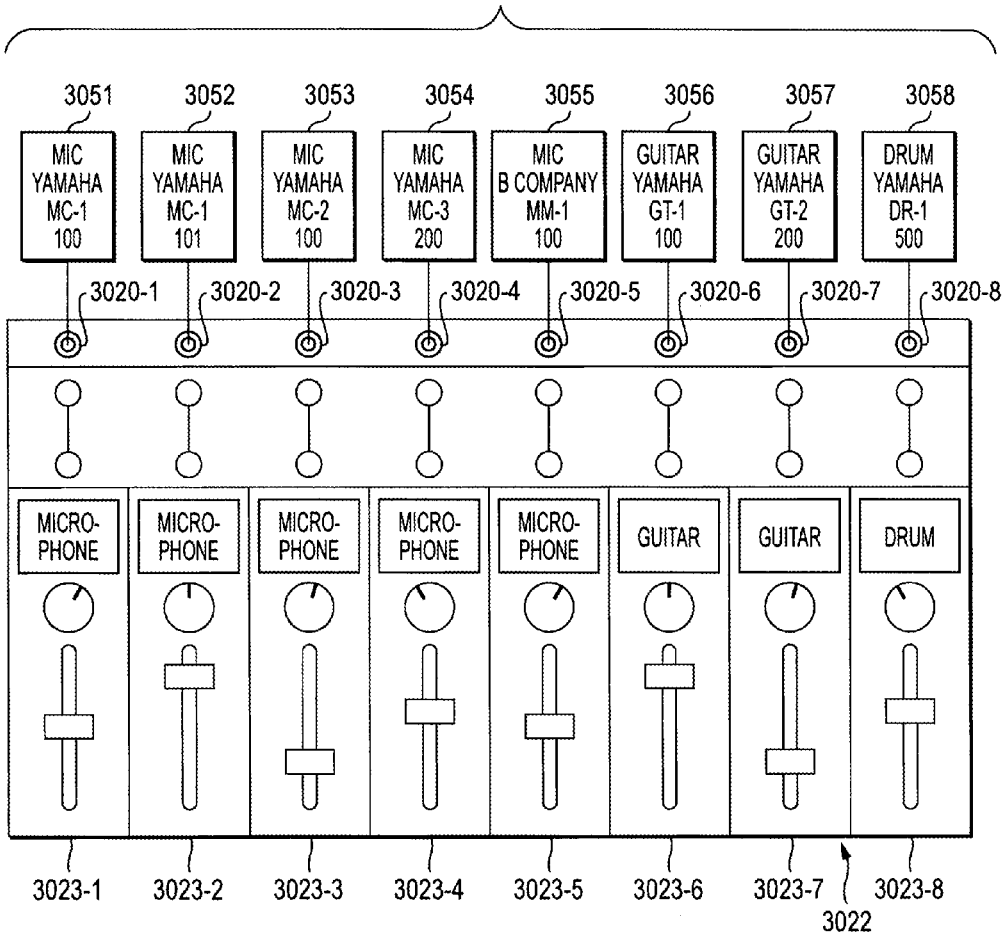

SCENE DATA

| CHANNEL OF INPUT TERMINAL | CH1 | CH2 | CH3 | CH4 | CH5 | CH6 | CH7 | CH8 |
|---|---|---|---|---|---|---|---|---|
| MUSICAL INSTRUMENT GROUP ID<br>MANUFACTURER ID<br>MODEL ID<br>SERIAL NO. | MIC<br>YAMAHA<br>MC-1<br>100 | MIC<br>YAMAHA<br>MC-1<br>101 | MIC<br>YAMAHA<br>MC-2<br>100 | MIC<br>YAMAHA<br>MC-3<br>200 | MIC<br>B COMPANY<br>MM-1<br>100 | GUITAR<br>YAMAHA<br>GT-1<br>100 | GUITAR<br>YAMAHA<br>MC-2<br>200 | DRUM<br>YAMAHA<br>DR-1<br>500 |
| CHANNEL OF MODULE | CH1 | CH2 | CH3 | CH4 | CH5 | CH6 | CH7 | CH8 |

FIG. 34

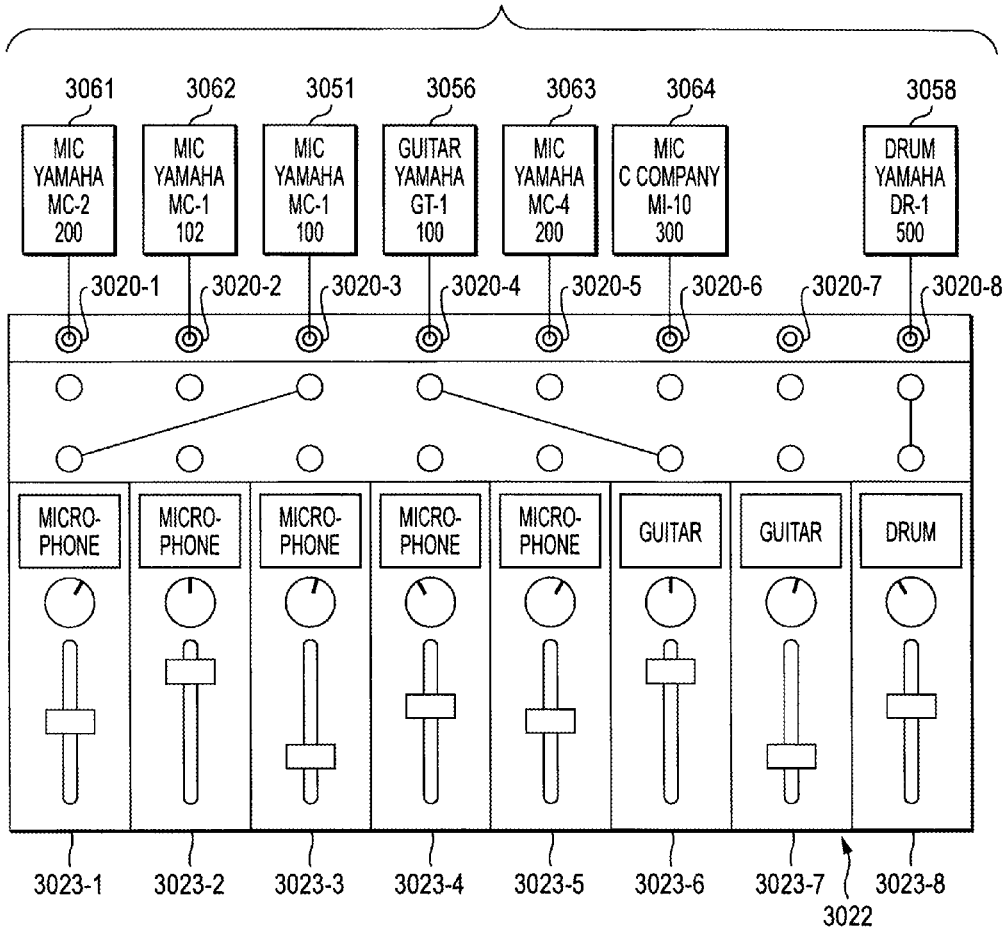

EXTRACTED IDENTIFICATION INFORMATION

| CHANNEL OF INPUT TERMINAL | CH1 | CH2 | CH3 | CH4 | CH5 | CH6 | CH7 | CH8 |
|---|---|---|---|---|---|---|---|---|
| MUSICAL INSTRUMENT GROUP ID<br>MANUFACTURER ID<br>MODEL ID<br>SERIAL NO. | MIC<br>YAMAHA<br>MC-2<br>200 | MIC<br>YAMAHA<br>MC-1<br>102 | MIC<br>YAMAHA<br>MC-1<br>100 | GUITAR<br>YAMAHA<br>GT-1<br>100 | MIC<br>YAMAHA<br>MC-4<br>200 | MIC<br>C COMPANY<br>MI-10<br>300 | | DRUM<br>YAMAHA<br>DR-1<br>500 |

SCENE DATA

| MUSICAL INSTRUMENT GROUP ID<br>MANUFACTURER ID<br>MODEL ID<br>SERIAL NO. | MIC<br>YAMAHA<br>MC-1<br>100 | MIC<br>YAMAHA<br>MC-1<br>101 | MIC<br>YAMAHA<br>MC-2<br>100 | MIC<br>YAMAHA<br>MC-3<br>200 | MIC<br>B COMPANY<br>MM-1<br>100 | GUITAR<br>YAMAHA<br>GT-1<br>100 | GUITAR<br>YAMAHA<br>MC-2<br>200 | DRUM<br>YAMAHA<br>DR-1<br>500 |
|---|---|---|---|---|---|---|---|---|
| CHANNEL OF MODULE | CH1 | CH2 | CH3 | CH4 | CH5 | CH6 | CH7 | CH8 |

FIG. 35

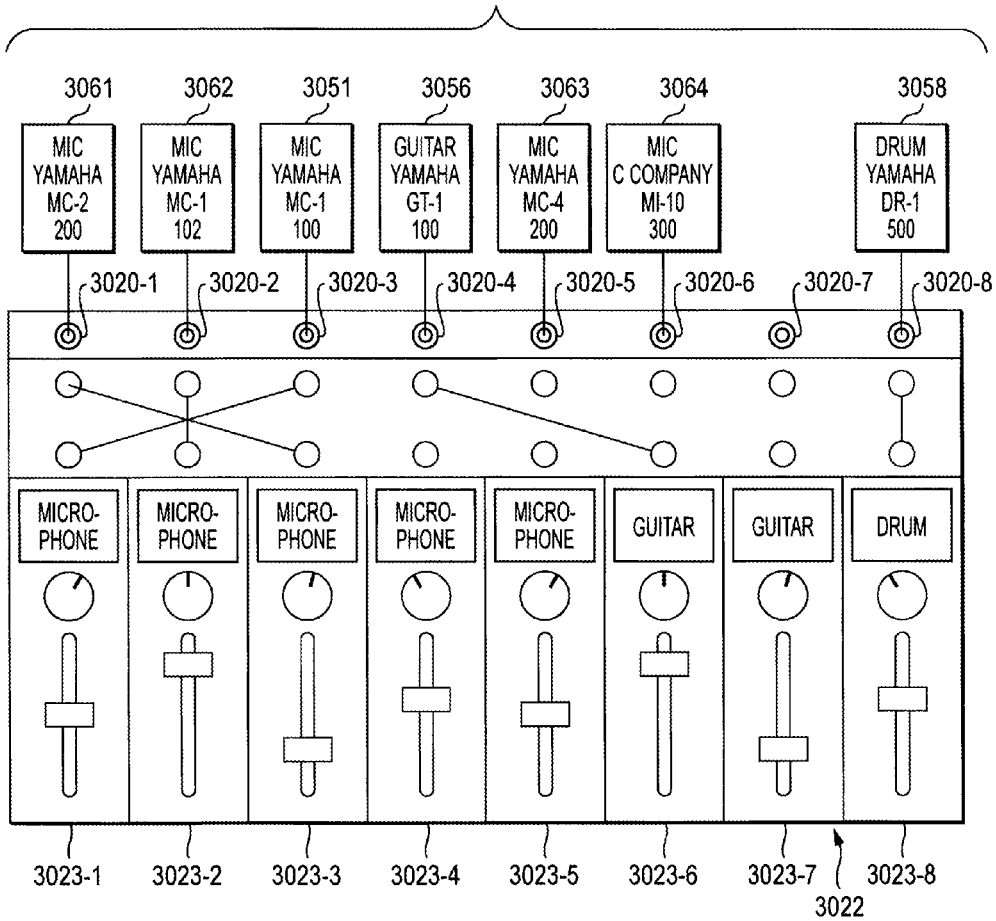

EXTRACTED IDENTIFICATION INFORMATION

| CHANNEL OF INPUT TERMINAL | CH1 | CH2 | CH3 | CH4 | CH5 | CH6 | CH7 | CH8 |
|---|---|---|---|---|---|---|---|---|
| MUSICAL INSTRUMENT GROUP ID<br>MANUFACTURER ID<br>MODEL ID<br>SERIAL NO. | MIC<br>YAMAHA<br>MC-2<br>200 | MIC<br>YAMAHA<br>MC-1<br>102 | MIC<br>YAMAHA<br>MC-1<br>100 | GUITAR<br>YAMAHA<br>GT-1<br>100 | MIC<br>YAMAHA<br>MC-4<br>200 | MIC<br>C COMPANY<br>MI-10<br>300 | | DRUM<br>YAMAHA<br>DR-1<br>500 |

SCENE DATA

| MUSICAL INSTRUMENT GROUP ID<br>MANUFACTURER ID<br>MODEL ID<br>SERIAL NO. | MIC<br>YAMAHA<br>MC-1<br>100 | MIC<br>YAMAHA<br>MC-1<br>101 | MIC<br>YAMAHA<br>MC-2<br>100 | MIC<br>YAMAHA<br>MC-3<br>200 | MIC<br>B COMPANY<br>MM-1<br>100 | GUITAR<br>YAMAHA<br>GT-1<br>100 | GUITAR<br>YAMAHA<br>MC-2<br>200 | DRUM<br>YAMAHA<br>DR-1<br>500 |
|---|---|---|---|---|---|---|---|---|
| CHANNEL OF MODULE | CH1 | CH2 | CH3 | CH4 | CH5 | CH6 | CH7 | CH8 |

FIG. 36

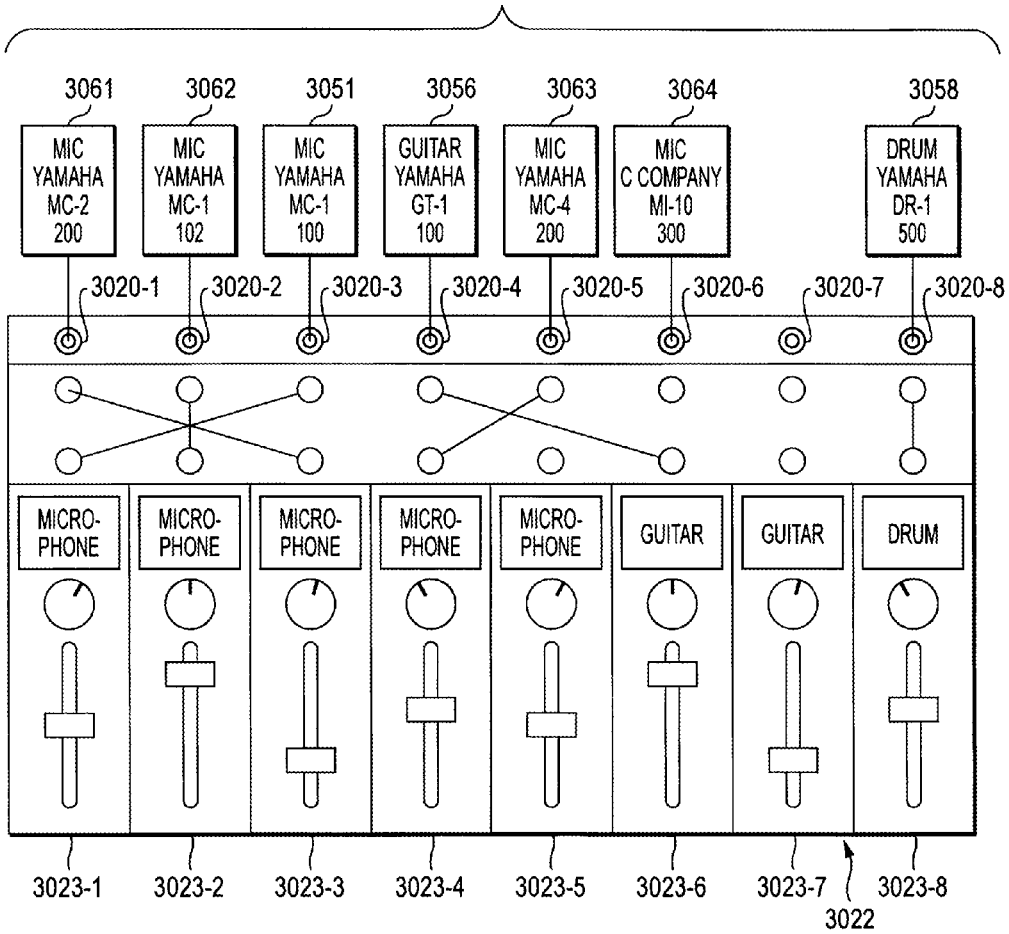

EXTRACTED IDENTIFICATION INFORMATION

| CHANNEL OF INPUT TERMINAL | CH1 | CH2 | CH3 | CH4 | CH5 | CH6 | CH7 | CH8 |
|---|---|---|---|---|---|---|---|---|
| MUSICAL INSTRUMENT GROUP ID<br>MANUFACTURER ID<br>MODEL ID<br>SERIAL NO. | MIC<br>YAMAHA<br>MC-2<br>200 | MIC<br>YAMAHA<br>MC-1<br>102 | MIC<br>YAMAHA<br>MC-1<br>100 | GUITAR<br>YAMAHA<br>GT-1<br>100 | MIC<br>YAMAHA<br>MC-4<br>200 | MIC<br>C COMPANY<br>MI-10<br>300 | | DRUM<br>YAMAHA<br>DR-1<br>500 |

SCENE DATA

| MUSICAL INSTRUMENT GROUP ID<br>MANUFACTURER ID<br>MODEL ID<br>SERIAL NO. | MIC<br>YAMAHA<br>MC-1<br>100 | MIC<br>YAMAHA<br>MC-1<br>101 | MIC<br>YAMAHA<br>MC-2<br>100 | MIC<br>YAMAHA<br>MC-3<br>200 | MIC<br>B COMPANY<br>MM-1<br>100 | GUITAR<br>YAMAHA<br>GT-1<br>100 | GUITAR<br>YAMAHA<br>MC-2<br>200 | DRUM<br>YAMAHA<br>DR-1<br>500 |
|---|---|---|---|---|---|---|---|---|
| CHANNEL OF MODULE | CH1 | CH2 | CH3 | CH4 | CH5 | CH6 | CH7 | CH8 |

FIG. 37

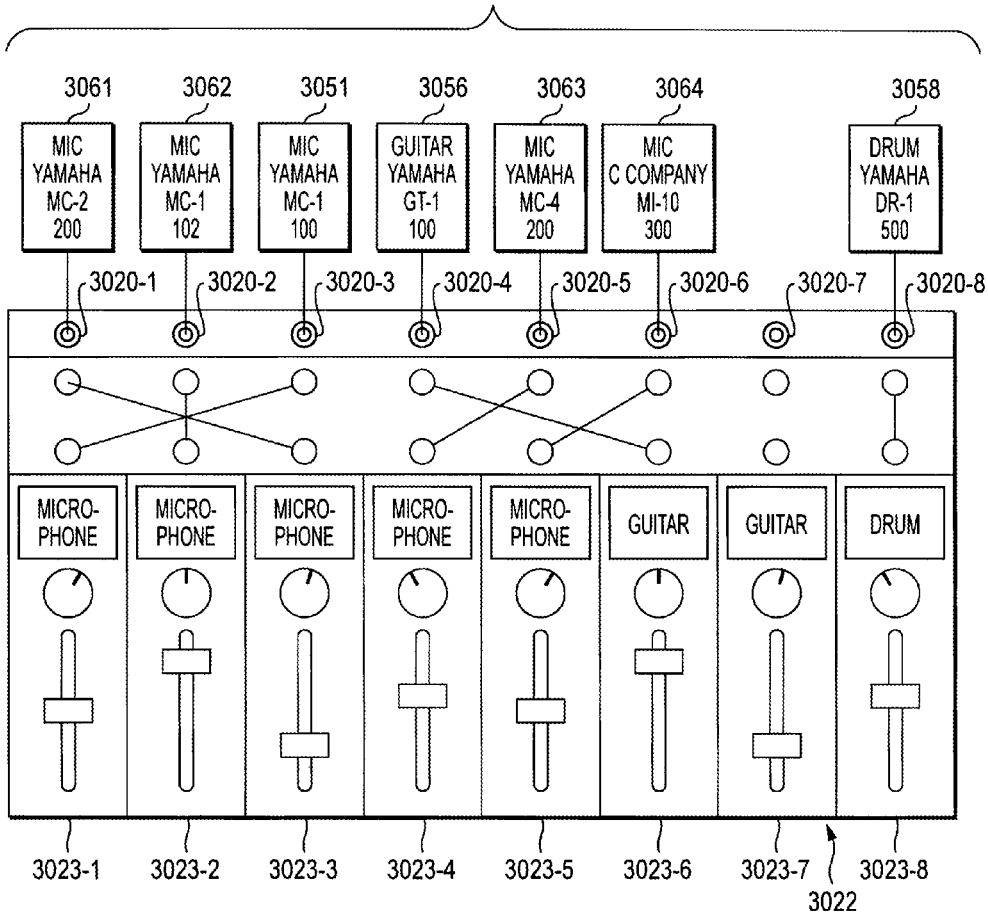

EXTRACTED IDENTIFICATION INFORMATION

| CHANNEL OF INPUT TERMINAL | CH1 | CH2 | CH3 | CH4 | CH5 | CH6 | CH7 | CH8 |
|---|---|---|---|---|---|---|---|---|
| MUSICAL INSTRUMENT GROUP ID<br>MANUFACTURER ID<br>MODEL ID<br>SERIAL NO. | MIC<br>YAMAHA<br>MC-2<br>200 | MIC<br>YAMAHA<br>MC-1<br>102 | MIC<br>YAMAHA<br>MC-1<br>100 | GUITAR<br>YAMAHA<br>GT-1<br>100 | MIC<br>YAMAHA<br>MC-4<br>200 | MIC<br>C COMPANY<br>MI-10<br>300 | | DRUM<br>YAMAHA<br>DR-1<br>500 |

SCENE DATA

| MUSICAL INSTRUMENT GROUP ID<br>MANUFACTURER ID<br>MODEL ID<br>SERIAL NO. | MIC<br>YAMAHA<br>MC-1<br>100 | MIC<br>YAMAHA<br>MC-1<br>101 | MIC<br>YAMAHA<br>MC-2<br>100 | MIC<br>YAMAHA<br>MC-3<br>200 | MIC<br>B COMPANY<br>MM-1<br>100 | GUITAR<br>YAMAHA<br>GT-1<br>100 | GUITAR<br>YAMAHA<br>MC-2<br>200 | DRUM<br>YAMAHA<br>DR-1<br>500 |
|---|---|---|---|---|---|---|---|---|
| CHANNEL OF MODULE | CH1 | CH2 | CH3 | CH4 | CH5 | CH6 | CH7 | CH8 |

FIG. 38

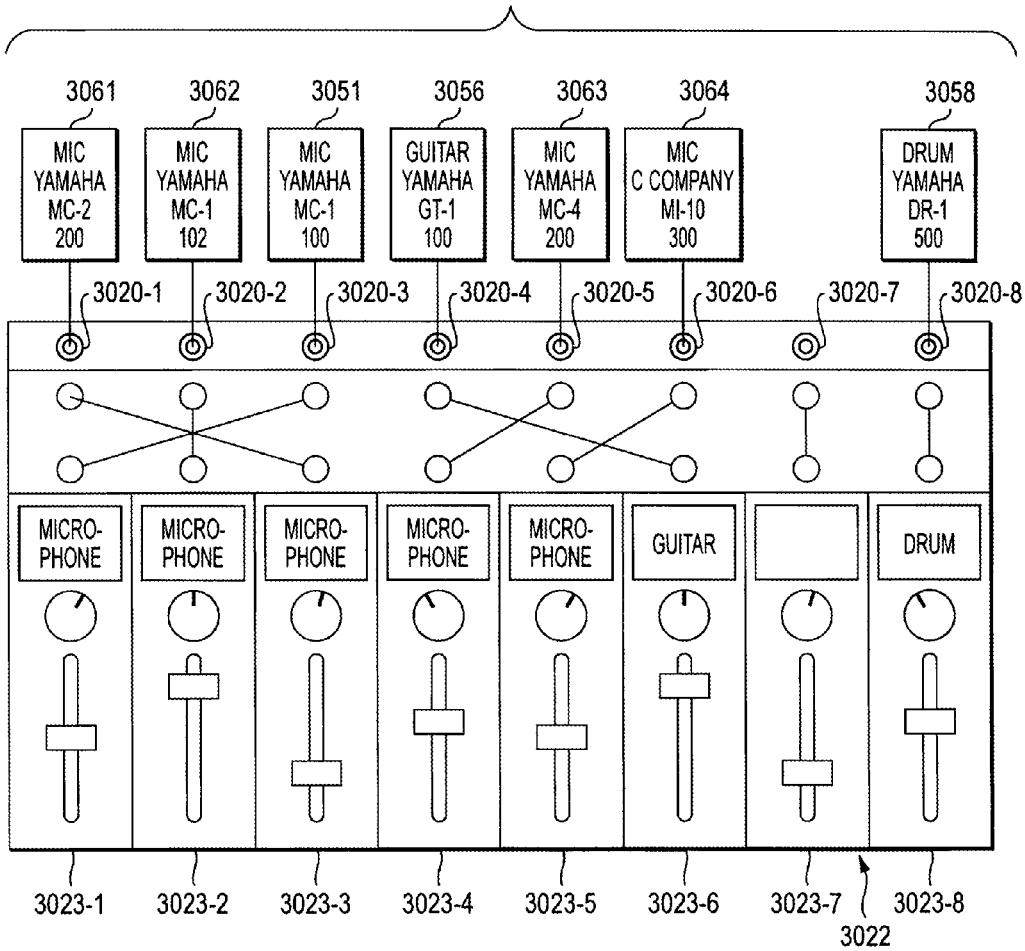

EXTRACTED IDENTIFICATION INFORMATION

| CHANNEL OF INPUT TERMINAL | CH1 | CH2 | CH3 | CH4 | CH5 | CH6 | CH7 | CH8 |
|---|---|---|---|---|---|---|---|---|
| MUSICAL INSTRUMENT GROUP ID<br>MANUFACTURER ID<br>MODEL ID<br>SERIAL NO. | MIC<br>YAMAHA<br>MC-2<br>200 | MIC<br>YAMAHA<br>MC-1<br>102 | MIC<br>YAMAHA<br>MC-1<br>100 | GUITAR<br>YAMAHA<br>GT-1<br>100 | MIC<br>YAMAHA<br>MC-4<br>200 | MIC<br>C COMPANY<br>MI-10<br>300 | | DRUM<br>YAMAHA<br>DR-1<br>500 |

SCENE DATA

| MUSICAL INSTRUMENT GROUP ID<br>MANUFACTURER ID<br>MODEL ID<br>SERIAL NO. | MIC<br>YAMAHA<br>MC-1<br>100 | MIC<br>YAMAHA<br>MC-1<br>101 | MIC<br>YAMAHA<br>MC-2<br>100 | MIC<br>YAMAHA<br>MC-3<br>200 | MIC<br>B COMPANY<br>MM-1<br>100 | GUITAR<br>YAMAHA<br>GT-1<br>100 | GUITAR<br>YAMAHA<br>MC-2<br>200 | DRUM<br>YAMAHA<br>DR-1<br>500 |
|---|---|---|---|---|---|---|---|---|
| CHANNEL OF MODULE | CH1 | CH2 | CH3 | CH4 | CH5 | CH6 | CH7 | CH8 |

FIG. 39

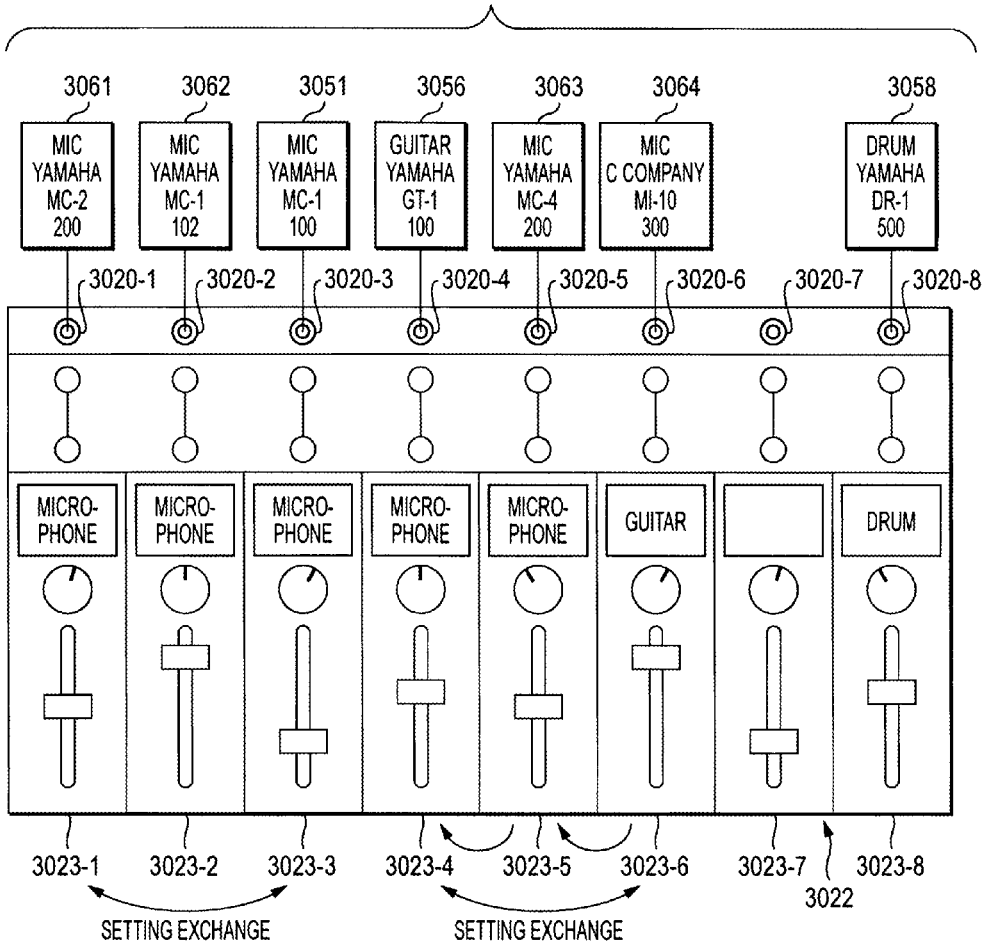

EXTRACTED IDENTIFICATION INFORMATION

| CHANNEL OF INPUT TERMINAL | CH1 | CH2 | CH3 | CH4 | CH5 | CH6 | CH7 | CH8 |
|---|---|---|---|---|---|---|---|---|
| MUSICAL INSTRUMENT GROUP ID<br>MANUFACTURER ID<br>MODEL ID<br>SERIAL NO. | MIC<br>YAMAHA<br>MC-2<br>200 | MIC<br>YAMAHA<br>MC-1<br>102 | MIC<br>YAMAHA<br>MC-1<br>100 | GUITAR<br>YAMAHA<br>GT-1<br>100 | MIC<br>YAMAHA<br>MC-4<br>200 | MIC<br>C COMPANY<br>MI-10<br>300 | | DRUM<br>YAMAHA<br>DR-1<br>500 |

SCENE DATA

| | | | | | | | | |
|---|---|---|---|---|---|---|---|---|
| MUSICAL INSTRUMENT GROUP ID<br>MANUFACTURER ID<br>MODEL ID<br>SERIAL NO. | MIC<br>YAMAHA<br>MC-1<br>100 | MIC<br>YAMAHA<br>MC-1<br>101 | MIC<br>YAMAHA<br>MC-2<br>100 | MIC<br>YAMAHA<br>MC-3<br>200 | MIC<br>B COMPANY<br>MM-1<br>100 | GUITAR<br>YAMAHA<br>GT-1<br>100 | GUITAR<br>YAMAHA<br>MC-2<br>200 | DRUM<br>YAMAHA<br>DR-1<br>500 |
| CHANNEL OF MODULE | CH1 | CH2 | CH3 | CH4 | CH5 | CH6 | CH7 | CH8 |

FIG. 43

| IDENTIFICATION INFORMATION | | | SETTING INFORMATION | | | | |
|---|---|---|---|---|---|---|---|
| MANUFAC-TURER | MODEL NUMBER | SERIAL NUMBER | GAIN | EFFECT | EQUALIZER | | |
| | | | | | HI | MID | LO |
| A COMPANY | M−1 | DEFAULT | 4 | ON | 2 | 4 | 2 |
| A COMPANY | M−1 | 0001 | 4 | ON | 3 | 4 | 2 |
| A COMPANY | M−1 | 0032 | 4 | ON | 3 | 4 | 1 |
| A COMPANY | M−1 | 0158 | 4 | ON | 2 | 4 | 2 |
| A COMPANY | M−31 | DEFAULT | 5 | ON | 3 | 5 | 4 |
| A COMPANY | M−31 | 10001 | 5 | ON | 3 | 5 | 4 |
| A COMPANY | M−31 | 10009 | 6 | ON | 3 | 5 | 5 |
| A COMPANY | M−31 | 10020 | 5 | ON | 3 | 5 | 4 |
| A COMPANY | M−32 | 20001 | 5 | ON | 4 | 3 | 2 |
| B COMPANY | M−32 | 20002 | 6 | ON | 3 | 4 | 3 |
| B COMPANY | MC−100 | DEFAULT | 6 | ON | 1 | 2 | 2 |
| B COMPANY | MC−100 | 11001 | 5 | ON | 1 | 2 | 2 |
| B COMPANY | MC−100 | 11002 | 6 | ON | 2 | 1 | 2 |
| B COMPANY | MC−100 | 11003 | 6 | ON | 2 | 2 | 1 |
| B COMPANY | MC−200 | DEFAULT | 5 | ON | 2 | 3 | 2 |
| B COMPANY | MC−200 | 12110 | 5 | ON | 2 | 3 | 1 |
| B COMPANY | MC−200 | 12119 | 5 | ON | 2 | 3 | 2 |
| C COMPANY | GT−10 | DEFAULT | 2 | OFF | 5 | 6 | 4 |
| C COMPANY | GT−10 | 0010 | 2 | OFF | 4 | 6 | 5 |
| C COMPANY | GT−10 | 0018 | 2 | OFF | 4 | 6 | 4 |
| C COMPANY | GT−10 | 0051 | 2 | OFF | 4 | 5 | 4 |
| C COMPANY | GT−10 | 0052 | 2 | OFF | 5 | 6 | 4 |
| D COMPANY | EGR−ZX | 051 | 3 | OFF | 5 | 5 | 5 |
| D COMPANY | EGR−ZX | 365 | 2 | OFF | 5 | 5 | 6 |
| D COMPANY | EGR−YC | DEFAULT | 3 | OFF | 6 | 5 | 5 |
| D COMPANY | EGR−YC | 111 | 3 | OFF | 6 | 5 | 5 |
| D COMPANY | EGR−YC | 172 | 3 | OFF | 6 | 5 | 4 |
| ⋮ | ⋮ | ⋮ | ⋮ | ⋮ | ⋮ | ⋮ | ⋮ |

FIG. 53

| IDENTIFICATION INFORMATION | FREQUENCY CHARACTERISTIC |
|---|---|
| MICROPHONE A | FREQUENCY CHARACTERISTIC A |
| MICROPHONE B | FREQUENCY CHARACTERISTIC B |
| MICROPHONE C | FREQUENCY CHARACTERISTIC C |
| ··· | FREQUENCY CHARACTERISTIC D |
| SPEAKER A | FREQUENCY CHARACTERISTIC E |
| SPEAKER B | FREQUENCY CHARACTERISTIC F |
| SPEAKER C | FREQUENCY CHARACTERISTIC G |
| ··· | FREQUENCY CHARACTERISTIC H |

AUDIO SIGNAL PROCESSING DEVICE, AUDIO SIGNAL PROCESSING SYSTEM, AND AUDIO SIGNAL PROCESSING METHOD

This application is a U.S. National Phase Application of PCT International Application PCT/JP2009/063513 filed on Jul. 29, 2009 which is based on and claims priority from Japanese Patent Application No. 2008-196492 filed on Jul. 30, 2008, Japanese Patent Application No. 2008-249723 filed on Sep. 29, 2008, Japanese Patent Application No. 2008-252075 filed on Sep. 30, 2008, Japanese Patent Application No. 2008-253532 filed on Sep. 30, 2008, Japanese Patent Application No. 2008-310402 filed on Dec. 5, 2008, and Japanese Patent Application No. 2008-331081 filed on Dec. 25, 2008, the contents of which is incorporated herein in its entirety by reference.

TECHNICAL FIELD

The present invention relates to a technique for facilitating the wiring of devices in an audio signal processing system, such as a PA (Public Address) system.

The present invention also relates to an audio signal processing system capable of automatically setting adjustment parameters on the basis of identification information of an audio signal output device superimposed on an audio signal.

BACKGROUND ART

A mixer which is used in the PA system assigns audio signals input from devices, such as a number of microphones and musical instruments, on the stage to respective channels, and controls various parameters, such as a volume value, for each channel. With regard to such a mixer, with the advancement of multichannel and multifunction, there is a demand for improvement in manipulation performance, and the improvement in a user interface is carried out (for example, Patent Literature 1).

In the mixer described in Patent Literature 1, the number of manipulator groups for setting the parameters of the channels is reduced, improving manipulation performance.

A mixer is also the main device of the PA audio device. An audio mixer is a device which inputs multiple audio signals input from multiple input terminals to respective input channel modules, performs level adjustment, equalization, and the like for the respective audio signals, and then mixes the audio signals. For this reason, for each input channel module, various signal processing parameters, such as gain and equalizer setting, are set in accordance with the type of audio signal input to the relevant channel.

There is a case where the signal processing parameters set for each input channel module are desired to be reused later. Thus, the audio mixer is provided with a scene memory function for storing the signal processing parameters and the like of each input channel module hitherto (see Non-Patent Literature 1).

CITATION LIST

Patent Literature

Patent Literature 1: JP-A-2006-100945

Non-Patent Literature

Non-Patent Literature 1: "(Digital Mixer) LS9 Manual", [online], 2006, Yamaha Corporation, [searched on Sep. 24, 2008], Internet <URL:http://www2.yamaha.co.jp/manual/pdf/pa/japan/mixers/ls9_ja_om_d0.pdf>

SUMMARY OF INVENTION

Technical Problem

In order to recognize from which device an audio signal is input for each input channel of the mixer, a user has to confirm the wirings connecting the devices and the mixer in advance, and has to memorize or set in the mixer the relationship between the devices and the input channels. For this reason, if the number of devices increases, it takes a lot of time to confirm the wirings. Further, when sound related to an audio signal is not output, it takes a lot of time to find the cause for which sound is not output, such as wiring disconnection, a connection error, or absence of output of an audio signal from a connected device, causing a lot of trouble.

In particular, if the mixer has a multistage configuration, it is impossible for the lower-stage mixer to easily determine what is connected to the upper stage. Further, it is difficult for the user to find connection errors between the devices and the channels, and to find connection errors in the uppermost-stage mixer.

The known scene memory function is provided only to store the signal processing parameters set for each input channel module, but is not intended to store which audio source is assigned to the input channel module. For this reason, even when scene data stored in the scene memory is read (recalled), if the same audio source as that at the time of storage is not connected to each input channel module, the setting at the time of storage cannot be correctly recovered.

Further, when an audio device breaks down, an alternative audio device may be connected to another channel, but the setting cannot of course be correctly recovered.

In addition, if the installment location of the audio signal processing device is changed, or the audio signal output device which is connected to the audio signal processing device is changed, usually, various adjustment parameters have to be set.

A mixer device is also known which stores the setting of adjustment parameters. In this case, if the same mixer device is constantly used, it is not problematic. However, when a mixer device of the same model installed at another location is to be used, various adjustment parameters have to be set just the same.

When a karaoke machine which is one audio signal processing device is used at a karaoke bar, a user individually sets various adjustment parameters such that his/her singing sounds good. Further, another user carries his/her own personal microphone with him/her and pays attention such that the characteristics of the microphone are not changed at any karaoke bar. However, each time a karaoke machine being used is changed, the user has to set various adjustment parameters, causing a lot of trouble in setting.

The invention has been finalized in consideration of the above-described situation, and an object of the invention is to provide a display device, an audio signal processing device, an audio signal processing system, a display method, and an audio signal processing method capable of enabling easy confirmation of the situation of the wirings connecting devices and a mixer.

Another object of the invention is to provide an audio signal processing device capable of enabling easy discrimination of which device is connected to each channel even when a mixer has a multistage configuration.

Another object of the invention is to provide an audio signal processing device capable of performing appropriate signal processing for audio signals of each audio source even when the connection form of the audio source is changed between storage and recall of scene data.

Another object of the invention is to provide an audio signal processing system capable of easily setting adjustment parameters according to a connected device.

Solution to Problem

In order to solve the problems, there is provided according to an aspect of the invention a display device comprising: multiple input reception units to which respective analog audio signals, on which watermark information indicating its own identification information is superimposed, are input from respective audio devices; an extraction unit that is adapted to extract the identification information from the respective analog audio signals input to the multiple input reception units; and a display unit that is adapted to perform display depending on the identification information extracted by the extraction unit in correspondence with the input reception unit to which the analog audio signal, from which the identification information is extracted, is input.

The present invention also provides an audio signal processing device comprising: the display device defined above; and a signal processing unit that is adapted to perform signal processing set in advance for the analog audio signal input to the input reception unit and output the processed analog audio signal.

The signal processing unit may perform signal processing depending on the identification information extracted by the extraction unit for the analog audio signal from which the identification information is extracted.

There is provided according to an aspect of the invention an audio signal processing device comprising: multiple input reception units to which respective analog audio signals, on which watermark information indicating its own identification information is superimposed, are input from respective audio devices; an extraction unit that is adapted to extract the identification information from the respective analog audio signals input to the multiple input reception units; and a signal processing unit that is adapted to perform signal processing depending on the identification information extracted by the extraction unit for the analog audio signal, from which the identification information is extracted, and output the processed analog audio signal.

The signal processing unit may mix the analog audio signals subjected to the signal processing each other and outputs the mixed analog audio signal.

It may be configured by further comprising a removal unit that is adapted to remove the watermark information superimposed on the respective analog audio signals.

It may be configured by further comprising a re-superimposition unit that is adapted to superimpose, on the analog audio signal from which the watermark information is removed by the removal unit, the watermark information.

It may be configured in that the signal processing unit performs signal processing for the analog audio signal from which the watermark information is removed by the removal unit, and the re-superimposition unit superimposes, on the analog audio signal which has been subjected to signal processing by the signal processing unit, the watermark information.

The present invention also provides an audio signal processing system comprising: the audio signal processing device described above; an identification information superimposition device including an identification information superimposition unit that is adapted to superimpose watermark information indicating identification information on analog audio signals to be supplied and output the resultant analog audio signals; and a transmission unit that is adapted to transmit the analog audio signals output from the identification information superimposition unit and input the analog audio signals to the input reception unit.

It may be configured in that the identification information superimposition device further includes multiple input terminals to which the respective analog audio signals to be supplied are input and which are provided in correspondence with the input reception unit, and when the analog audio signals which are input to the respective input terminals and output with the watermark information superimposed thereon are mixed, the identification information superimposition unit superimposes the watermark information on the respective analog audio signals input to the respective input terminals such that the watermark information superimposed on one analog audio signal does not interfere with the watermark information superimposed on another audio signal.

It may be configured in that the identification information superimposition device further includes: multiple input terminals to which the analog audio signals to be supplied are input and which are provided in correspondence with the respective input reception units; and a setting unit that is adapted to set identification information in correspondence with the respective input terminals, and for each of the analog audio signals to be supplied, the watermark information superimposed by the identification information superimposition unit indicates the identification information which is set in correspondence with the input terminal to which the analog audio signal is supplied.

According to an aspect of the invention, there is provided a display method comprising: an input reception step in which analog audio signals, on which watermark information indicating its own identification information is superimposed, are input from respective audio devices to multiple input reception units; an extraction step of extracting the identification information from each of the analog audio signals input to the multiple input reception units; and a display step of performing display depending on the identification information extracted in the extraction step in correspondence with the input reception unit to which the analog audio signal, from which the identification information is extracted, is input.

According to an aspect of the invention, there is provided an audio signal processing method comprising: an input reception step in which analog audio signals, on which watermark information indicating its own identification information is superimposed, are input from respective audio devices to multiple input reception units; an extraction step of extracting the identification information from each of the analog audio signals input to the multiple input reception units; and a signal processing step of performing signal processing depending on the identification information extracted in the extraction step for the analog audio signal from which the identification information is extracted and outputting the processed analog audio signal.

The display device may be configured by comprising: a manipulation unit for inputting specific identification information different from the identification information; a mixing unit that is adapted to mix the analog audio signals input from the input reception unit each other; a superimposition unit that is adapted to superimpose the specific identification information input from the manipulation unit on the analog audio signals mixed by the mixing unit; and an output unit that outputs the analog audio signals superimposed by the superimposition unit.

The audio signal processing device may be configured by comprising: a manipulation unit for inputting specific identification information different from the identification information; a mixing unit that is adapted to mix the analog audio signals input from the input reception unit each other; a superimposition unit that is adapted to superimpose the specific identification information input from the manipulation unit on the analog audio signal mixed by the mixing unit; and an output unit that outputs the analog audio signals superimposed by the superimposition unit.

Therefore, even in the case of a multistage configuration, if the content of the specific identification information is configured to be easily understood by the user, the audio signal processing device can easily determine what is connected to the audio signal processing device with reference to the specific identification information.

It may be configured by further comprising a removal unit that is adapted to remove the identification information from the analog audio signals input from the input reception unit, wherein the mixing unit mixes the analog audio signals each other after the removal unit has removed the identification information.

Therefore, the audio signal processing device can reduce noise from the mixed sound signal.

It may be configured by further comprising a demodulation unit that is adapted to demodulate the analog audio signals input from the input reception unit to acquire the identification information, wherein the superimposition unit superimposes the specific identification information input from the manipulation unit and the identification information acquired by the demodulation unit on the analog audio signals mixed by the mixing unit.

Therefore, even in the case of a multistage configuration, the audio signal processing device can recognize a device connected to the upper-stage audio signal processing device with reference to the specific identification information and the identification information.

In addition, it may be configured by further comprising a display unit for displaying the identification information input from the input reception unit.

Therefore, the user merely gives the audio signal processing device a glance to understand the connections of the devices.

The audio signal processing device may be configured in that the signal processing unit includes multiple signal processing units, each of which process the respective analog audio signals, and the audio signal processing device includes: a scene memory in which scene data including association information between the multiple signal processing units and the respective audio devices are stored; an identification information detection unit that is adapted to detect the audio device connected to each of the input reception units on the basis of the identification information extracted by the extraction unit; and a connection control unit that is adapted to respectively connect the input reception units to the signal processing units on the basis of the detection result of the identification information detection unit such that each of the audio devices connected to the multiple input reception unit is connected to the signal processing unit according to the association information.

With the above-described configuration, the audio device (audio source) connected to the input terminal is identified on the basis of the identification information superimposed on the analog audio signal input from the input terminal. The scene memory memorizes the audio devices assigned to the respective signal processing units. The connection control unit connects the input terminals and the signal processing units such that the audio devices are connected to the signal processing units as assigned. Therefore, the audio devices and the signal processing units can be correctly connected to each other, regardless of the connection forms of the multiple audio devices to the multiple input terminals.

The audio signal processing device may be configured in that the signal processing unit includes multiple signal processing units that are respectively connected to the multiple input reception units and each perform audio signal processing based on signal processing parameters, and the audio signal processing device includes: a scene memory in which signal processing parameters for audio signals of the respective audio devices are stored; an identification information detection unit that is adapted to detect the audio device connected to the respective input reception units on the basis of the identification information extracted by the extraction stage; and a control unit that sets signal processing parameters corresponding to the signal processing units on the basis of the detection result of the identification information detection unit such that signal processing corresponding to the audio signal of each of the audio devices is performed.

With the above-described configuration, the audio device (audio source) connected to the input terminal is identified on the basis of the identification information superimposed on the analog audio signal input from the input terminal. The scene memory memorizes the signal processing parameters for the audio devices. The control unit sets the signal processing parameters in the signal processing units connected to the input terminals such that desired signal processing is performed for the audio signals of the audio devices. Therefore, the signal processing for the audio signals can be correctly performed, regardless of the connection forms of the multiple audio devices to the multiple input terminals.

When the identification information extracted from the input analog audio signal does not completely coincide with the identification information stored in the storage unit, the connection control unit retrieves an alternative signal processing unit on the basis of the extracted identification information and connects the retrieved alternative signal processing unit and the relevant input terminal.

That is, even when various kinds of information (serial number, manufacturer ID, and the like) included in the identification information are not completely identical, the identification information in which various kinds of information are partially identical is retrieved, and connection is provided to the associated signal processing unit. Therefore, even when an alternative device is connected, the audio devices and the signal processing units can be correctly connected to each other.

It may be configured in that the identification information includes a unique number of the relevant audio device, and the connection control unit retrieves identification information in which at least a part of information other than the unique number coincides with the extracted identification information, and retrieves the alternative signal processing unit.

When the unique number (serial number or the like) is included in the information which is included in the identification information, other kinds of information may be stored in an external server (database), and the audio devices connected to the input terminals may be detected through access to the external server. In this case, even when an alternative audio device is connected, the audio devices and the signal processing units can be correctly connected to each other.

According to an aspect of the invention, there is provided an audio signal processing system, comprising: an audio signal output device; an audio signal processing device; and a server device, wherein the audio signal output device includes identification information storage unit for storing identification information, and identification information superimposition unit for superimposing the identification information read from the identification information storage unit on analog audio signals and outputting the resultant analog audio signals, the audio signal processing device includes an extraction unit for extracting the identification information from the analog audio signals output from the audio signal output device, and a first communication unit for transmitting the identification information to the server device, the server device includes a setting information storage unit in which setting information, that corresponds to the identification information of the audio signal processing device for setting adjustment parameters of the analog audio signals, are stored in advance, and a second communication unit for, if the identification information is received from the audio signal processing device, transmitting the setting information corresponding to the identification information to the audio signal processing device, and the audio signal processing device further includes a signal processing unit for, if the first communication unit receives the setting information corresponding to the identification information transmitted to the server device from the server device, setting the adjustment parameters of the analog audio signal in accordance with the setting information.

It may be configured in that, in the server device, default setting information is stored in the setting information storage unit, and when the setting information corresponding to the identification information is not stored in the setting information storage unit, the second communication unit transmits the default setting information to the audio signal processing device.

It may be configured in that the audio signal processing device includes a manipulation unit for setting or changing the adjustment parameters of the audio signals, and if the adjustment parameters of the audio signals are set or changed by the manipulation unit, the first communication unit transmits the setting information of the adjustment parameters and the identification information to the server device, and if the second communication unit receives the setting information of the adjustment parameters and the identification information from the audio signal processing device, the server device causes the setting information storage unit to store the setting information and the identification information in association with each other.

Further, according to an aspect of the invention, there is provided an acoustic system comprising: multiple audio devices which form a closed loop; and the audio signal processing device, wherein each of the multiple audio devices superimposes characteristic information indicating the gain characteristic of output with respect to input of the audio device as the identification information on the analog audio signal and outputs the resultant analog audio signal.

It may be configured in that the signal processing unit of the audio signal processing device demodulates the characteristic information of the audio devices from the input analog audio signals to estimate the gain characteristic of the closed loop, and corrects the analog audio signals with the inverse characteristic of the estimated gain characteristic.

It may be configured in that the audio devices include multiple microphones, and for each of the analog audio signals output from the microphones, the signal processing unit corrects the relevant analog audio signal.

It may be configured in that the multiple audio devices superimpose information for identifying the audio devices as the identification information on the analog audio signals and output the resultant analog audio signals, and the signal processing unit stores the identification information and the characteristic information in association with each other for the respective audio devices in advance, and demodulates the identification information of the audio devices from the input analog audio signals and acquires the characteristic information corresponding to the identification information of the audio devices to estimate the gain characteristic of the closed loop.

Advantageous Effects of Invention

According to the invention, it is possible to provide a display device, an audio signal processing device, an audio signal processing system, a display method, and an audio signal processing method capable of enabling easy confirmation of the situation of the wirings connecting devices and a mixer.

According to the invention, even when the audio signal processing device has a multistage configuration, it is possible to easily determine what is connected to the upper stage from the audio signal processing device.

According to the invention, the audio sources (audio devices) can be associated with the signal processing units or the signal processing parameters on the basis of data stored in the scene memory. Therefore, signal processing can be correctly performed regardless of the connection forms of the multiple audio sources to the multiple input terminals.

Even when the connection form of the audio device is changed between storing timing and reading timing with respect to the scene memory, the setting can be correctly recovered.

According to the invention, the adjustment parameters of the analog audio signals can be automatically set with respect to the audio signal processing device, regardless of the location where the audio signal output device is used, and complicated adjustment is not necessary.

The invention is applied to howling prevention, such that howling can be prevented through estimation of the gain characteristic of the closed loop with a low load.

BRIEF DESCRIPTION OF DRAWINGS

FIG. 33 shows the connection form of audio sources at the time of storage of scene data according to the fourth embodiment.

FIG. 34 shows the relationship between the connection form of audio devices, the patching pattern of a patch bay 3022, and identification information at the time of reading of scene data according to the fourth embodiment.

FIG. 35 shows the relationship between the connection form of audio devices, the patching pattern of the patch bay 3022, and identification information at the time of reading of scene data according to the fourth embodiment.

FIG. 36 shows the relationship between the connection form of audio devices, the patching pattern of the patch bay 3022, and identification information at the time of reading of scene data according to the fourth embodiment.

FIG. 37 shows the relationship between the connection form of audio devices, the patching pattern of the patch bay 3022, and identification information at the time of reading of scene data according to the fourth embodiment.

FIG. 38 shows the relationship between the connection form of audio devices, the patching pattern of the patch bay 3022, and identification information at the time of reading of scene data according to the fourth embodiment.

FIG. 39 shows an example where association between input terminals and input channel modules is reset according to the fourth embodiment.

FIG. 43 is a table showing the relationship between identification information and setting information according to the fifth embodiment.

FIG. 53 shows an example of a device information list according to the sixth embodiment.

DESCRIPTION OF EMBODIMENTS

Embodiments of the invention will be described with reference to the drawings.

First Embodiment

Figure 1:
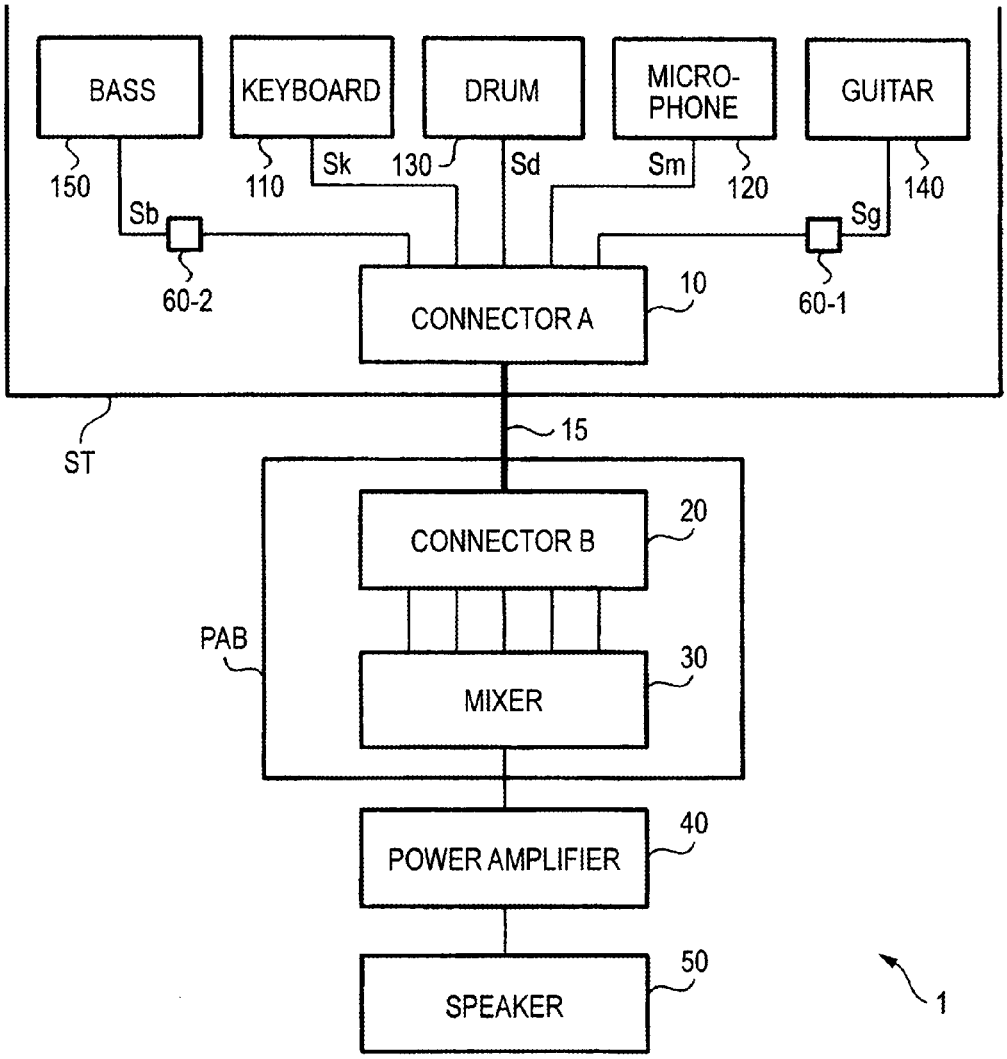
FIG. 1 is a block diagram showing the configuration of a PA system according to a first embodiment of the invention.

As shown in FIG. 1, a PA system 1 which is an example of an audio signal processing system according to a first embodiment of the invention has musical instruments (a keyboard 110, a microphone 120, a drum 130, a guitar 140, and a bass 150), an identification information superimposition device 60, and a connector A 10 installed on a stage ST, a connector B 20 and a mixer 30 installed in a PA booth PAB, a power amplifier 40, and a speaker 50. The connector A 10 and the connector B 20 are connected to each other by a multicable 15, such that audio signals are transmitted from the stage ST to the PA booth PAB. FIG. 1 is an explanatory view showing the configuration of the PA system 1.

The audio signals output from the musical devices installed on the stage ST are supplied to the mixer 30 provided in the PA booth PAB through the connector A 10, the multicable 15, and the connector B 20. In the mixer 30, the audio signals are subjected to signal processing, such as volume control, mixed, amplified by the power amplifier 40, and emitted from the speaker 50. Hereinafter, the configuration of the PA system 1 will be described.

The keyboard 110 is, for example, an electronic piano, and outputs an audio signal Sk in accordance with a performance of a performer. Identification information corresponding to the keyboard 110 is superimposed on the audio signal Sk as watermark information. In this example, identification information indicated by watermark information superimposed on the audio signal Sk is information indicating "keyboard". The identification information may be information unique to the keyboard 110, such as the model number, name, or the like of the keyboard 110. Further, these kinds of information may overlap each other.

With regard to a sound watermark method that carries out superimposition on the audio signal Sk as watermark information, various known methods using a spread spectrum or the like with little effect on the sense of hearing may be used. Of various methods, it is preferable to use a method in which multiple superimposition is possible such that information remains even when being mixed with another audio signal, for example, a method for using a pseudo noise signal with M series and Gold series.

The frequency band for superimposition of watermark information is preferably an inaudible range, but in the path of the audio signal of the PA system 1, it can be assumed that a usable frequency band is only an audible range, thus configuration is made such that an inaudible range is blocked. In this case, an audible range may be used, and it is preferable to superimpose watermark information with respect to a high-frequency band (for example, equal to or higher than 10 kHz), for reducing the effect on the sense of hearing. In the following description, the superimposition of watermark information on an audio signal may be carried out in the same manner as described above, thus description thereof will be omitted.

The microphone 120 is sound collection means, such as a microphone, and outputs collected sound as an audio signal Sm. Identification information "microphone" corresponding to the microphone 120 is superimposed on the audio signal Sm as watermark information. Unlike the usual microphone, the microphone 120 is configured to superimpose watermark information on an audio signal indicating collected sound.

The drum 130 is provided with a drum set, and a microphone which emits sound generated when the percussion instruments of the drum set are beaten. Similarly to the microphone 120, the microphone outputs collected sound as an audio signal Sd. Identification information "drum" is superimposed on the audio signal Sd as watermark information.

The guitar 140 is, for example, an electric guitar, and outputs an audio signal Sg in accordance with a performance of a performer. The bass 150 is an electric bass, and outputs an audio signal Sb in accordance with a performance of a performer. Unlike the audio signals Sk, Sm, and Sd, identification information is not superimposed on the audio signals Sg and Sb when being output from the guitar 140 and the bass 150.

Figure 2:
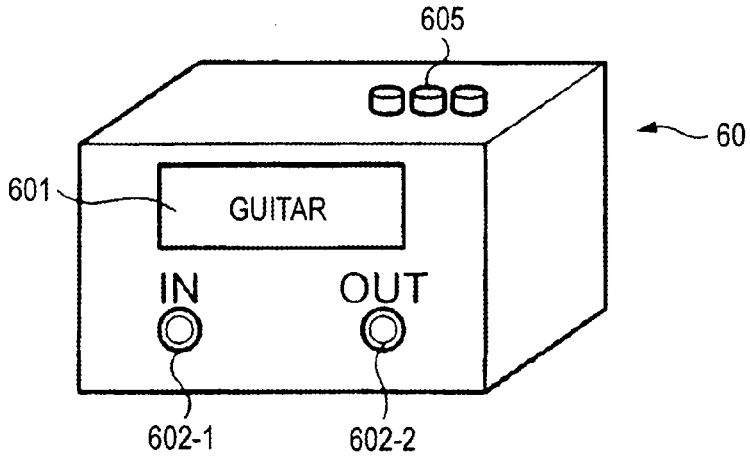
FIG. 2 is an appearance diagram of an identification information superimposition device according to the first embodiment.
Figure 3:
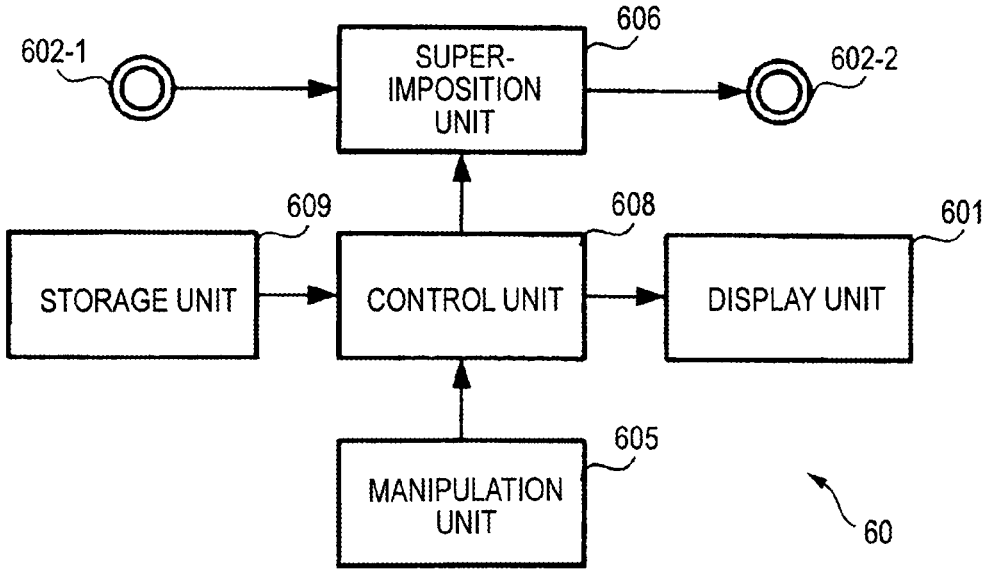
FIG. 3 is a block diagram showing the configuration of the identification information superimposition device according to the first embodiment.

Identification information superimposition devices 60-1 and 60-2 (hereinafter, referred to as identification information superimposition device 60 when discrimination is not made therebetween) are respectively supplied with the audio signals Sg and Sb from the guitar 140 and bass 150, superimpose watermark information indicating identification information on the audio signals Sg and Sb, and output the resultant audio signals. Here, the identification information superimposition device 60 will be described with reference to FIGS. 2 and 3. FIG. 2 shows the appearance of the identification information superimposition device 60. FIG. 3 is a block diagram showing the configuration of the identification information superimposition device 60.

First, the appearance of the identification information superimposition device 60 will be described. As shown in FIG. 2, the identification information superimposition device 60 has an input terminal 602-1 which is a terminal to which a cable is connected, and to which an audio signal is input, an output terminal 602-2 which is a terminal to which a cable is connected, and through which an audio signal is output in which watermark information is superimposed on the audio signal input to the input terminal, a display unit 601 which displays the content of identification information superimposed as watermark information, and a manipulation unit 605.

Next, the configuration of the identification information superimposition device 60 will be described. As shown in FIG. 3, the manipulation unit 605 has a manipulator for deciding the content of identification information which has to be superimposed as watermark information, and outputs a signal indicating the content of identification information decided by a manipulation of the user to a control unit 608. Although in this example, one of the contents which become multiple candidates is selected as identification information, characters may be input and decided as the content of the identification information.

A storage unit 609 is storage means, such as a nonvolatile memory, and stores the contents which are the candidates of the identification information. The control unit 608 reads identification information having the content corresponding to a signal input from the manipulation unit 605 from the storage unit 609, performs control such that the content of the read identification information is displayed on the display unit 601, and sets the content of the identification information with respect to a superimposition unit 606.

The superimposition unit 606 superimposes watermark information indicating identification information set in the control unit 608 on an audio signal input from the input terminal 602-1, and outputs the audio signal to the output terminal 602-2. Thus, the identification information superimposition device 60 superimposes watermark information indicating identification information on an input audio signal and outputs the resultant audio signal.

In this example, the identification information superimposition device 60-1 is configured to receive the audio signal Sg output from the guitar 140, to superimpose identification information "guitar" on the audio signal Sg as watermark information, and to output the resultant audio signal. The identification information superimposition device 60-2 is configured to receive the audio signal Sb output from the bass 150, to superimpose identification information "bass" on the audio signal Sb as watermark information, and to output the resultant audio signal. With the above, the description of the identification information superimposition device 60 is completed.

Returning to FIG. 1, the description will be continued. The connector A 10 is a connector box which has multiple input terminals to which a cable is connected and audio signals are input, and transmits the input audio signals to the connector B 20 through the multicable 15. In this example, the number of input terminals of the connector A 10 is five (five channels). The audio signals Sk, Sm, Sd, Sg, and Sb output from the keyboard 110, the microphone 120, the drum 130, and the identification information superimposition devices 60-1 and 60-2 are input to the input terminals and transmitted to the connector B 20 through the multicable 15.

Figure 4:
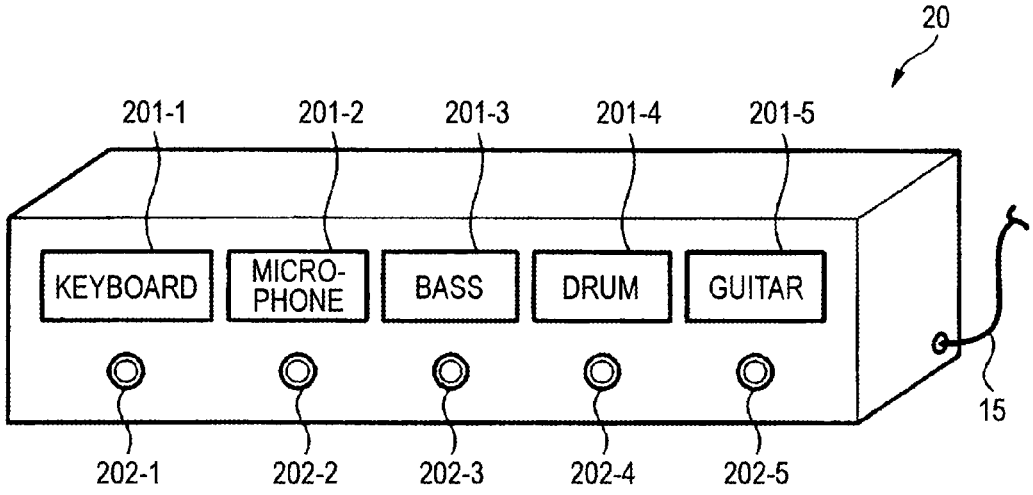
FIG. 4 is an appearance diagram of a connector B according to the first embodiment.
Figure 5:
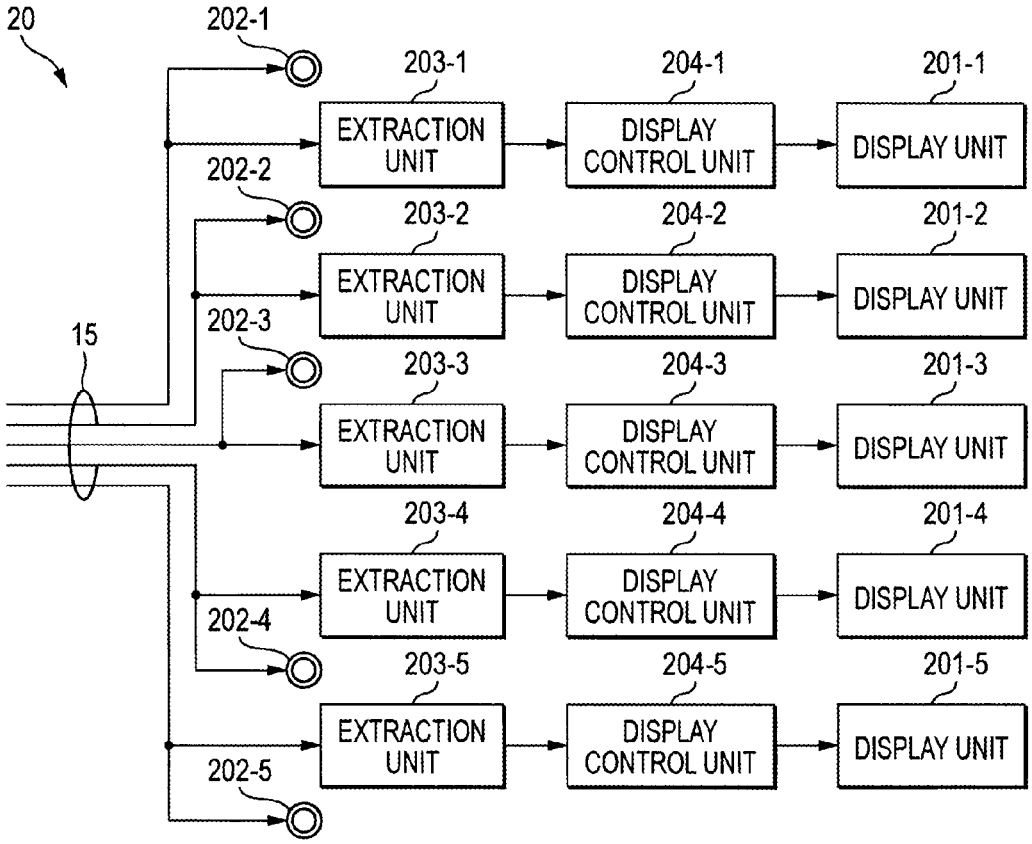
FIG. 5 is a block diagram showing the configuration of a connector B according to the first embodiment.

Next, the connector B 20 will be described with reference to FIGS. 4 and 5. FIG. 4 shows the appearance of the connector B 20. FIG. 5 is a block diagram showing the configuration of the connector B 20.

First, the appearance of the connector B 20 will be described. As shown in FIG. 4, the audio signals are input through the multicable 15 connected between the connector A 10 and the connector B 20, and are output from output terminals 202-1, 202-2, 202-3, 202-4, and 202-5 (hereinafter, referred to as an output terminal 202 when discrimination is not made therebetween) to which cables are connected. The contents of identification information indicated by the watermark information which is superimposed on the audio signals output from the output terminals 202 are displayed on display units 201-1, 201-2, 201-3, 201-4, 201-5 (hereinafter, referred to as a display unit 201 when discrimination is not made therebetween) provided to correspond to the output terminals 202.

Next, the configuration of the connector B 20 will be described. As shown in FIG. 5, the audio signals transmitted from the connector A 10 through the multicable 15 are respectively output from the output terminals 202. The audio signal (in this example, the audio signal Sk) supplied to the output terminal 202-1 through the multicable 15 is also input to an extraction unit 203-1.

The extraction unit 203-1 extracts the watermark information superimposed on the input audio signal Sk, and outputs the identification information indicated by the extracted watermark information. A display control unit 204-1 controls the display unit 201-1 to display the content ("keyboard") of the identification information output from the extraction unit 203-1. Extraction units 203-2, 203-3, 203-4, and 203-5 have the same function as the extraction unit 203-1. The audio signals which are input to the extraction units 203-2, 203-3, 203-4, and 203-5 are the audio signals Sm, Sb, Sd, and Sg, respectively.

Display control units 204-2, 204-3, 204-4, and 204-5 have the same configuration as the display control unit 204-1, and perform control of the display units 201-2, 201-3, 201-4, and 201-5 to display "microphone", "bass", "drum", and "guitar", respectively. When an audio signal is not transmitted to the connector B 20 due to cable disconnection, failure of the musical instruments, or the like, and an audio signal is not input, display of the display unit 201 may be non-display or display indicating that an audio signal has not been transmitted.

As described above, a musical instrument from which an audio signal output from each output terminal 202 is output can be recognized by confirming display on the display unit 201 provided to correspond to the output terminal 202, regardless of the connection relationship of the cables which connect the multiple input terminals of the connector A 10 provided on the stage ST and the multiple musical instruments, in the connector B 20 provided in the PA booth PAB. When an audio signal is not transmitted to the connector B 20 due to cable disconnection, failure of the musical instruments, or the like, the situation can also be recognized. With the above, the description of the connector B 20 is completed.

Figure 6:
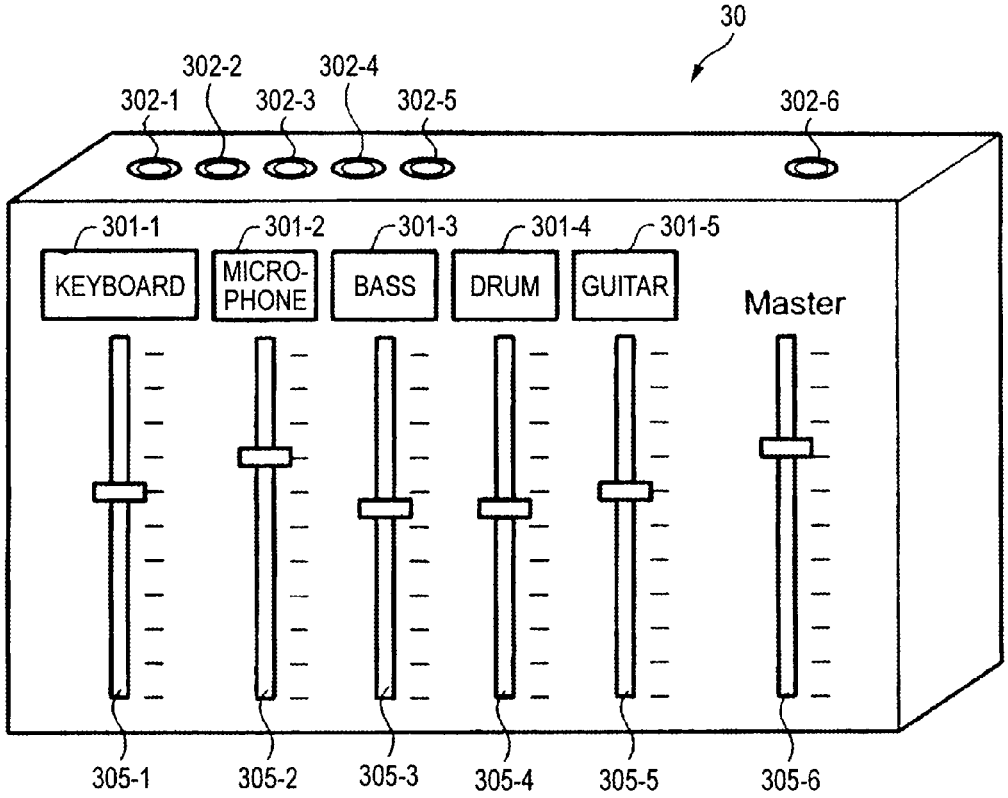
FIG. 6 is an appearance diagram of a mixer according to the first embodiment.
Figure 7:
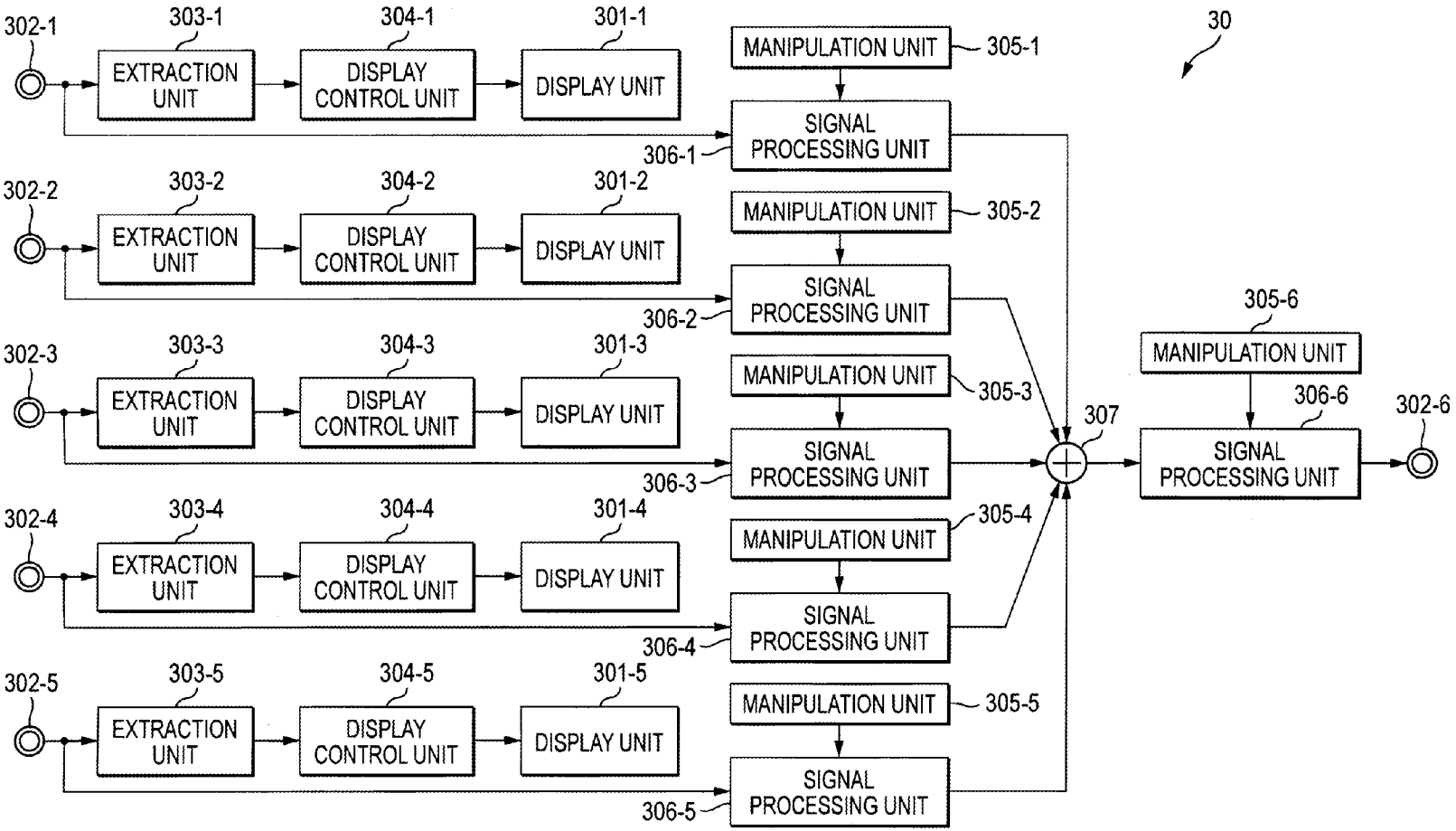
FIG. 7 is a block diagram showing the configuration of the mixer according to the first embodiment.

Returning to FIG. 1, the description will be continued. The mixer 30 is an example of the audio signal processing device and is connected to the output terminals 202 of the connector B 20 through cables. The mixer 30 adjusts the volume levels of the audio signals output from the output terminals 202 of the connector B 20, mixes the audio signals, and outputs the resultant audio signal. The mixer 30 will be described with reference to FIGS. 6 and 7. FIG. 6 shows the appearance of the mixer 30. FIG. 7 is a block diagram showing the configuration of the mixer 30.

First, the appearance of the mixer 30 will be described. As shown in FIG. 6, the mixer 30 has input terminals 302-1, 302-2, 302-3, 302-4, and 302-5 (hereinafter, referred to as an input terminal 302 when discrimination is not made therebetween) to which cables are connected and the audio signals are input, and an output terminal 302-6 through which a mixed audio signal St of the audio signals is output. That is, a five-channel input is received.

The mixer 30 has manipulation units 305-1, 305-2, 305-3, 305-4, and 305-5 (hereinafter, referred to as a manipulation unit 305 when discrimination is not made therebetween) which have manipulators for designating the volume levels of the audio signals of the respective channels input to the input terminals 302 and correspond to the channels, and a manipulation unit 305-6 which is a manipulator for designating the volume level of the audio signal St.

The mixer 30 also has display units 301-1, 301-2, 301-3, 301-4, and 301-5 (hereinafter, referred to as a display unit 301 when discrimination is not made therebetween) which are provided to correspond to the manipulators of the manipulation units 305, that is, the input terminals 302, and display the contents of the identification information indicated by the watermark information, which is superimposed on the audio signals of the respective channels input to the input terminals 302. In the PA booth PAB, the content of the identification information can be confirmed through either the display unit 201 or the display unit 301. Thus, when the display unit 301 is provided, the display unit 201 in the connector B 20 may not be provided. To the contrary, if the display unit 201 is provided in the connector B 20, the display unit 301 may not be provided.

Next, the configuration of the mixer 30 will be described. As shown in FIG. 7, the audio signal (in this example, the audio signal Sk) input to the input terminal 302-1 is output to an extraction unit 303-1 and a signal processing unit 306-1. The extraction unit 303-1 extracts the watermark information superimposed on the input audio signal Sk, and outputs the identification information indicated by the extracted watermark information. The display control unit 304-1 controls the display unit 301-1 to display the content ("keyboard") of the identification information output from the extraction unit 303-1. As described above, the extraction unit 303-1, the display control unit 304-1, and the display unit 301-1 respectively have the same functions as the extraction unit 203-1, the display control unit 204-1, and the display unit 201-1 in the connector B 20.

Similarly, extraction units 303-2, 303-3, 303-4, and 303-5 have the same function as the extraction unit 303-1. The audio signals which are input to the extraction units 303-2, 303-3, 303-4, and 303-5 are the audio signals Sm, Sb, Sd, and Sg, respectively. Display control units 304-2, 304-3, 304-4, and 304-5 have the same function as the display control unit

304-1, and control the display units 301-2, 301-3, 301-4, and 301-5 to display "microphone", "bass", "drum", and "guitar", respectively. When an audio signal is not transmitted to the mixer 30 due to cable disconnection, failure of the musical instruments, or the like, and an audio signal is not input, display of the display unit 301 may be non-display or display indicating that an audio signal has not been transmitted.

The signal processing unit 306-1 has a set amplification factor corresponding to the volume level designated by the manipulator of the manipulation unit 305-1, performs signal processing for amplifying the audio signal Sk input to the input terminal 302-1 with the set amplification factor, and outputs the resultant audio signal. Similarly to the signal processing unit 306-1, the signal processing units 306-2, 306-3, 306-4, and 306-5 have set amplification factors corresponding to the volume levels designated by the manipulators of the manipulation units 305-2, 305-3, 305-4, and 305-5, amplify the audio signals Sm, Sb, Sd, and Sg with the set amplification factors, respectively, and output the resultant audio signals.

An addition unit 307 adds the audio signals Sk, Sm, Sb, Sd, and Sg of the respective channels output from the signal processing units 306-1, 306-2, 306-3, 306-4, and 306-5 (hereinafter, referred to as a signal processing unit 306 when discrimination is not made therebetween) to mix (mixing) the audio signals each other, and outputs the result as the audio signal St.

The signal processing unit 306-6 has a set amplification factor corresponding to the volume level designated by the manipulator of the manipulation unit 305-6, performs signal processing for amplifying the audio signal St output from the addition unit 307 with the set amplification factor, and supplies the resultant audio signal to the output terminal 302-6.

As described above, in the mixer 30 provided in the PA booth PAB, display on the display units 301 arranged to correspond to the manipulators for designating the volume levels of the audio signals of the respective channels input to the respective input terminals 302 is confirmed, regardless of the connection relationship of the cables between the multiple input terminals of the connector A 10 provided on the stage ST and the multiple musical instruments, such that musical instruments which are the output sources of the audio signals in which the volume levels are designated by the manipulations of the manipulators can be recognized. When an audio signal is not transmitted to the mixer 30 due to cable disconnection, failure of the musical instruments, or the like, the situation can also be recognized. With the above, the description of the mixer 30 is completed.

Returning to FIG. 1, the description will be continued. The power amplifier 40 amplifies the audio signal St output from the output terminal 302-6 of the mixer 30 with an amplification factor set in advance, and outputs the resultant audio signal to the speaker 50. The speaker 50 emits the audio signal St amplified by the power amplifier 40.

As described above, according to the PA system 1 of the first embodiment of the invention, the watermark information indicating the identification information for specifying the musical instruments is superimposed on the audio signals output from the musical instruments installed on the stage ST, and the display unit 201 of the connector B 20 and the display unit 301 of the mixer 30 provided in the PA booth PAB display the contents of the identification information indicated by the watermark information superimposed on the respective audio signals.

For this reason, in the PA booth PAB, any connection relationship of the cables between the multiple input terminals of the connector A 10 provided on the stage ST and the multiple musical instruments can be confirmed. Further, a musical instrument which is an output source of an audio signal to be subjected to volume level control is recognized, and the corresponding manipulator is manipulated, such that the volume level can be designated. In addition, when an audio signal is not transmitted due to cable disconnection, failure of the musical instruments, or the like, the situation can also be recognized in the PA booth PAB.

Although the first embodiment of the invention has been described, as described below, the first embodiment may be carried out in various aspects.

<Modification 1>

Although in the above-described first embodiment, the signal processing units 306 and the signal processing unit 306-6 of the mixer 30 perform amplification processing with the set amplification factors as signal processing for the input audio signals, another signal processing, for example, equalizing processing of the set frequency characteristics, filter processing, or the like may be performed, or multiple processing may be performed. In this case, the manipulation units 305 may have manipulators for setting parameters required for performing the signal processing. With regard to such setting, the setting may be made such that signal processing is not performed, and if such a setting is made, the signal processing units 306 and the signal processing unit 306-6 output the input audio signals as they are.

<Modification 2>

Figure 8:
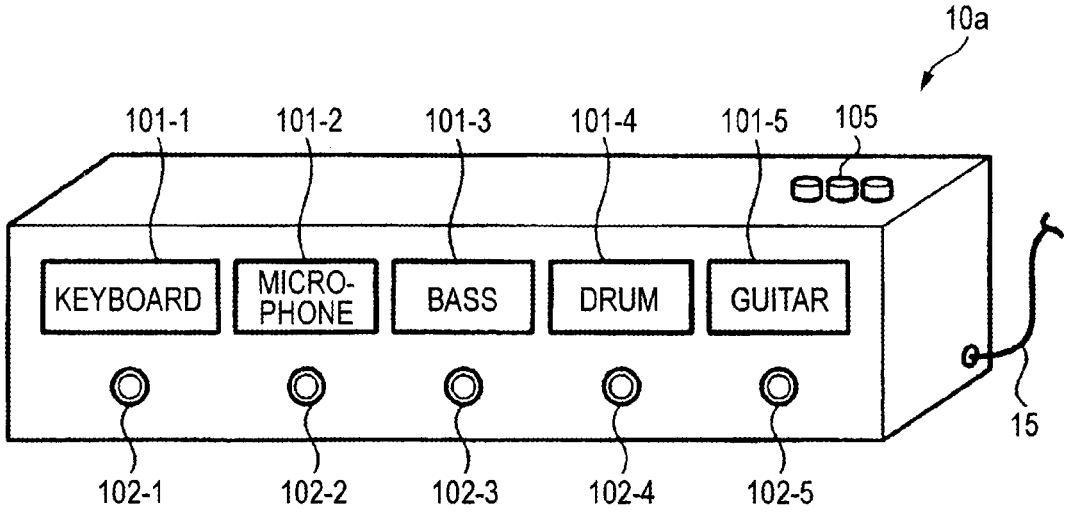
FIG. 8 is an appearance diagram of a connector A according to Modification 2 of the first embodiment.
Figure 9:
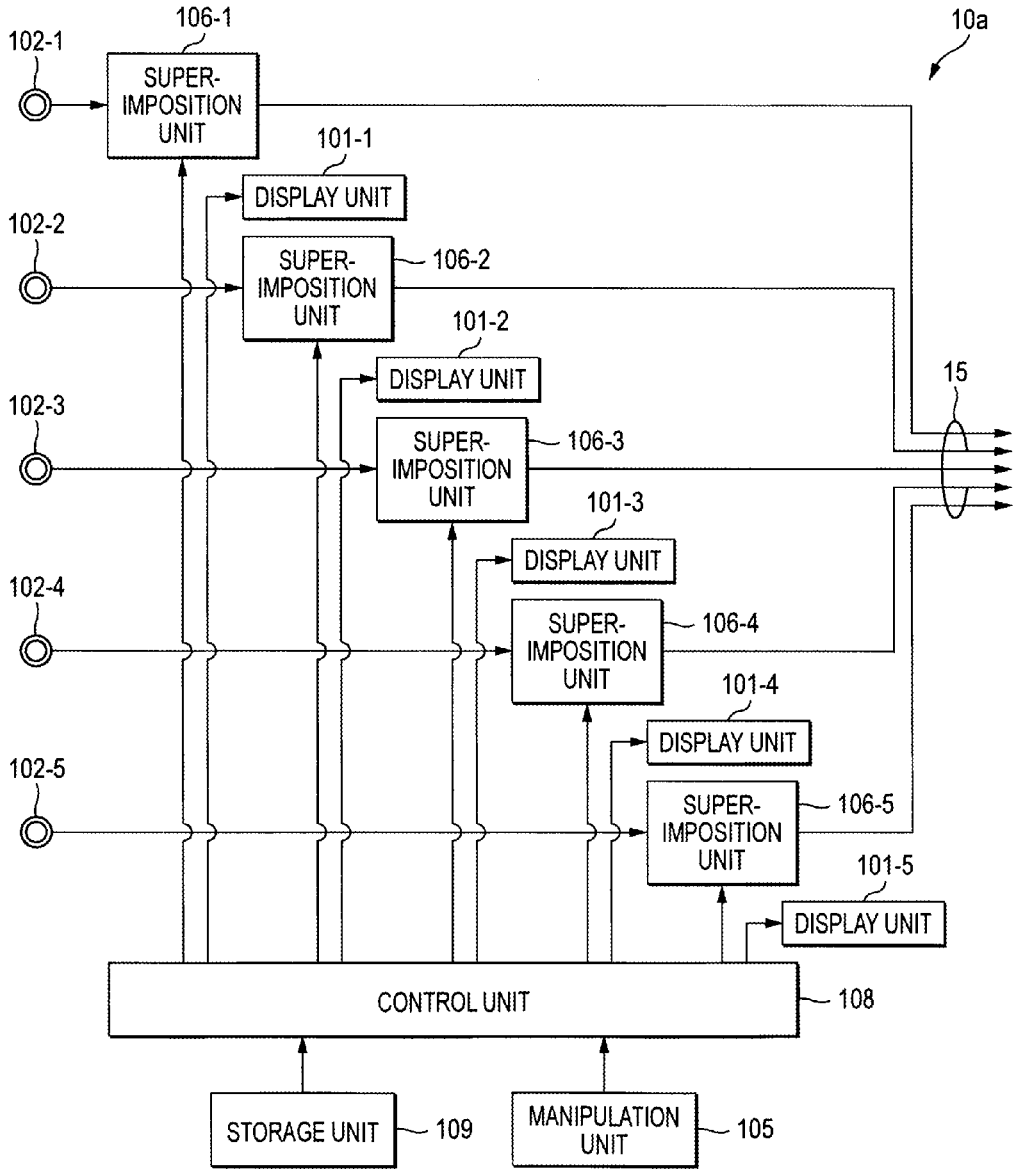
FIG. 9 is a block diagram showing the configuration of the connector A according to Modification 2 of the first embodiment.

With regard to the connector A 10 in the above-described first embodiment, a connector A 10*a* may be used which further has the function of the identification information superimposition device 60. The connector A 10*a* will be described with reference to FIGS. 8 and 9. FIG. 8 shows the appearance of the connector A 10*a*. FIG. 9 is a block diagram showing the configuration of the connector A 10*a*.

First, the appearance of the connector A 10*a* will be described. The connector A 10*a* has input terminals 102-1, 102-2, 102-3, 102-4, and 102-5 (hereinafter, referred to as input terminals 102 when discrimination is not made therebetween) to which cables are connected and audio signals are input, and a multicable 15 which transmits the audio signals, in which the watermark information indicating the identification information is superimposed on the audio signals input to the respective input terminals, to the connector B 20. The connector A 10*a* also has display units 101-1, 101-2, 101-3, 101-4, and 101-5 (hereinafter, referred to as display units 101 when discrimination is not made therebetween) which display the contents of the identification information indicated by the watermark information which is superimposed on the audio signals input to the respective input terminals, to correspond to the input terminals, and a manipulation unit 105.

Next, the configuration of the connector A 10*a* will be described. The manipulation unit 105 has manipulators for deciding the contents of the identification information which has to be superimposed as the watermark information on the audio signals input to the respective input terminals 102, and outputs signals indicating the contents of the identification information corresponding to the audio signals input to the respective input terminals 102 decided by a manipulation of the user to a control unit 108. Although in this example, one of the contents which become multiple candidates is selected as the identification information, characters may be input and decided as the content of the identification information.

A storage unit 109 is storage means, such as a nonvolatile memory, and stores the contents which become the candidates of the identification information. The control unit 108 reads the identification information having the contents corresponding to the signals input from the manipulation unit 105 from the storage unit 109 in correspondence with the input terminals 102, performs control such that the contents of the read identification information are displayed on the display units 101 corresponding to the input terminals 102, and sets the contents of the identification information with respect to superimposition units 106-1, 106-2, 106-3, 106-4, and 106-5 (hereinafter, referred to as superimposition units 106 when discrimination is not made therebetween) corresponding to the input terminals 102.

The respective superimposition units 106 superimpose the watermark information indicating the identification information set in the control unit 108 on the audio signals input to the respective input terminals 102, and output the resultant audio signals. Thus, the connector A 10*a* superimposes the watermark information indicating the identification information on the audio signals input to the respective input terminals 102, and outputs the resultant audio signals. In this example, the connector A 10*a* superimposes identification information "keyboard", "microphone", "bass", "drum", and "guitar" as watermark information on the audio signals input to the input terminals 102-1, 102-2, 102-3, 102-4, and 102-5, and outputs the resultant audio signals.

With this, it is not necessary to superimpose the watermark information indicating the identification information on the audio signals input to the input terminals 102 of the connector A 10*a* in advance, and general-use musical instruments can be used.

The connector A 10*a* may have a different configuration. In one example, the respective superimposition units 106 may superimpose the watermark information on the audio signals such that the watermark information superimposed on one audio signal does not interfere with the watermark information superimposed on another audio signal even when the audio signals output from the respective superimposition unit 106 are added and mixed, for example, while varying the frequency band. In this case, a superimposition method is preferably set in the connector A 10*a* in advance such that the watermark information can be extracted in the connector B 20 and the mixer 30.

The connection relationship between the connector A 10*a* and the connector B 20 is decided in advance, thus, for example, if the superimposition method in the superimposition unit 106-1 is set in the extraction unit 203-1, the watermark information can be extracted. Although the connection relationship between the connector A 10*a* and the mixer 30 is not necessarily decided, for example, the connection relationship may be decided such that the watermark information can be extracted in correspondence with all of the superimposition methods in the extraction units 303-1, 303-2, . . . , and 303-5.

With this, the watermark information superimposed on the audio signals before mixing remain in the audio signal St output from the mixer 30, thus if the watermark information is extracted from the audio signal St and the identification information is recognized, the musical instruments which are the output sources of the audio signals before mixing of the audio signal St can be specified.

In another example, as in the first embodiment, when the watermark information is superimposed on the audio signals input to the input terminals 102, watermark information indicating different identification information may be further superimposed. For example, information indicating identification information, such as the channel number of the input terminal 102 to which the audio signal is input, may be superimposed. Thus, watermark information indicating multiple identification information is superimposed on the output audio signal.

<Modification 3>

Figure 10:
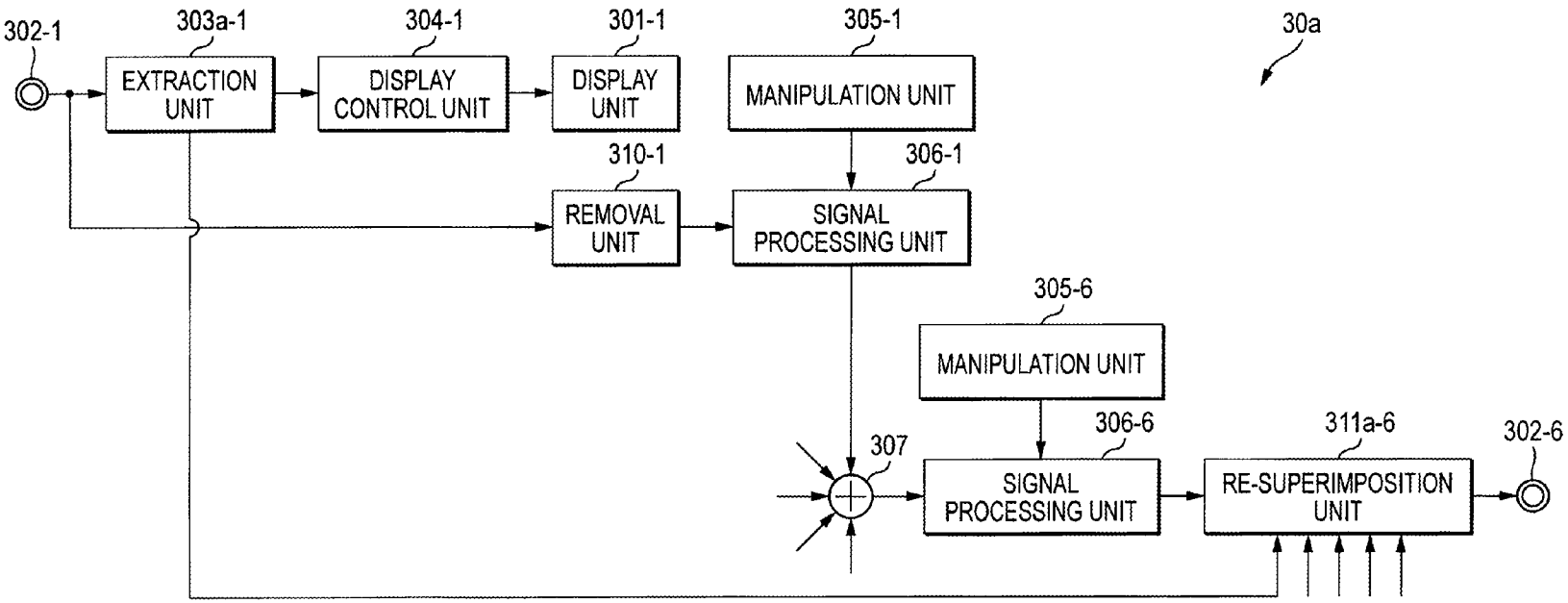
FIG. 10 is a block diagram showing the configuration of a mixer according to Modification 3 of the first embodiment.

In the above-described first embodiment, the mixer 30 merely extracts the watermark information superimposed on the audio signals. In order to use the watermark information, however, with respect to the mixed audio signal St, the watermark information superimposed on the audio signals before mixing may be temporarily removed and re-superimposed on the audio signal St. In this case, the mixer 30 may be a mixer 30*a* which is configured as shown in FIG. 10. FIG. 10 is a block diagram showing only the configuration on the path, through which the audio signal input from the input terminal 302-1 is processed, from the configuration of the mixer 30*a*.

As shown in FIG. 10, an extraction unit 303*a*-1 extracts the watermark information superimposed on the input audio signal, and outputs the identification information indicated by the extracted watermark information to the display control unit 304-1 and also to a re-superimposition unit 311*a*-6. A removal unit 310-1 is provided on the signal path from the input terminal 302-1 to the signal processing unit 306-1, and removes the watermark information superimposed on the input audio signal.

The identification information is input to a re-superimposition unit 311*a*-6 from the extraction units 303*a*-1, 303*a*-2, . . . , and 303*a*-5 corresponding to the input terminals 302. The re-superimposition unit 311*a*-6 superimposes watermark information indicating the collected contents of all of the input identification information on the audio signal St output from the signal processing unit 306-6, and supplies the resultant audio signal to the output terminal 302-6. Other configurations are the same as the mixer 30 in the first embodiment, thus description thereof will be omitted. With this, the watermark information indicating the musical instruments which are the output sources of the audio signals before mixing can be superimposed on the mixed audio signal St.

If watermark information is not required for the mixed audio signal St, the re-superimposition unit 311*a*-6 is not provided. In this case, the watermark information is removed from the audio signal by the removal unit 310-1, improving the audio quality of the audio signal. The removal unit 310-1 may be provided on the signal path from the signal processing unit 306-1 to the addition unit 307, but from the viewpoint of having little effect on signal processing and efficient removal of the watermark information, the removal unit 310-1 may be provided before signal processing in the signal processing unit 306-1.

<Modification 4>

Figure 11:
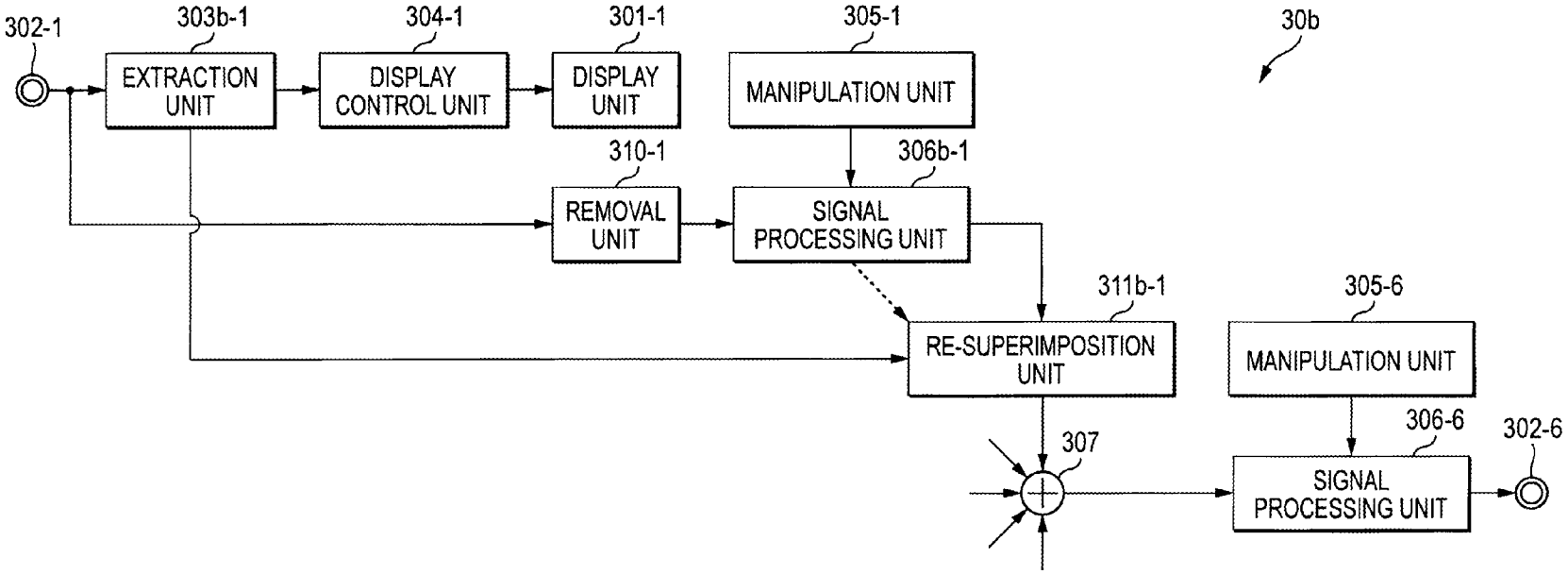
FIG. 11 is a block diagram showing the configuration of a mixer according to Modification 4 of the first embodiment.

Although in the above-described first embodiment, the mixer 30 merely extracts the watermark information superimposed on the audio signals, the watermark information superimposed on the audio signals input to the input terminals 302 may be temporarily removed and re-superimposed after signal processing. In this case, the mixer 30 may be a mixer 30*b* which is configured as shown in FIG. 11. FIG. 11 is a block diagram showing only the configuration on the path, through which the audio signal input from the input terminal 302-1 is processed, from the configuration of the mixer 30*b*.

As shown in FIG. 11, an extraction unit 303*b*-1 extracts the watermark information superimposed on the input audio signal, and outputs the identification information indicated by the extracted watermark information to the display control unit 304-1 and also to a re-superimposition unit 311*b*-1. The removal unit 310-1 is provided on the signal path from the input terminal 302-1 to the signal processing unit 306*b*-1, and removes the watermark information superimposed on the input audio signal.

The re-superimposition unit 311*b*-1 superimposes the watermark information indicating the identification information input from the extraction unit 303*b*-1 on the audio signal output from the signal processing unit 306*b*-1. At this time, as shown in Modification 2, the re-superimposition unit 311*b*-1 superimposes the watermark information such that the watermark information superimposed on one audio signal does not interfere with the watermark information superimposed on another audio signal even when the audio signals output from other re-superimposition units 311*b*-2, 311*b*-3, 311*b*-4, and 311*b*-5 are added and mixed. Similarly, other re-superimposition units 311*b*-2, 311*b*-3, 311*b*-4, and 311*b*-5 superimpose the watermark information such that one watermark information does not interfere with another watermark information. The re-superimposition unit 311*b*-1 may acquire the contents of the signal processing in the signal processing unit 306*b*-1, for example, information, such as the amplification factor, the volume level, additive acoustic effects (reverb and the like), and the like, and may add the contents to the identification information.

Other configurations are the same as the mixer 30 in the first embodiment, thus description thereof will be omitted. With this, the watermark information indicating the musical instruments which are the output sources of the audio signals before mixing can be superimposed on the mixed audio signal St.

<Modification 5>

Figure 12:
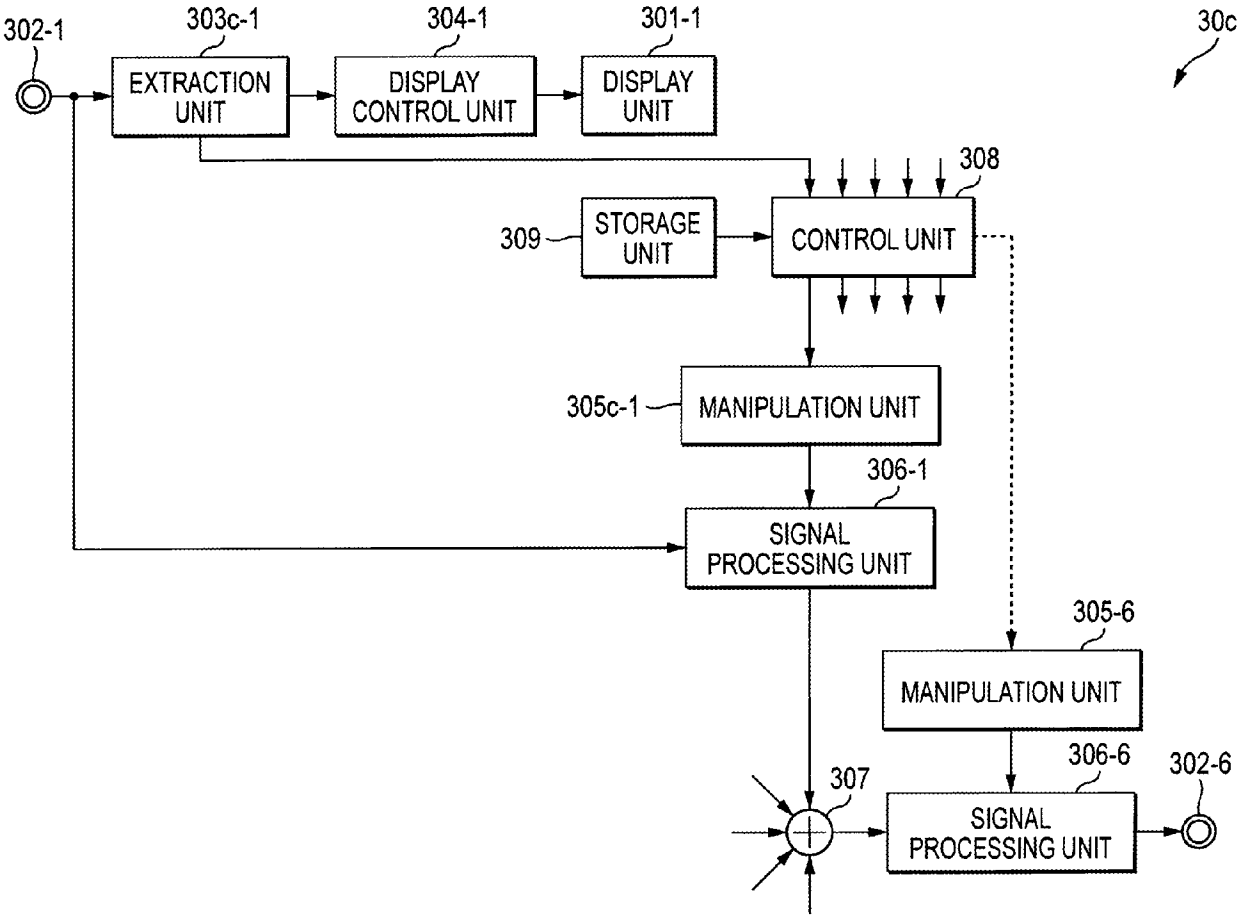
FIG. 12 is a block diagram showing the configuration of a mixer according to Modification 5 of the first embodiment.

Although in the above-described first embodiment, the mixer 30 designates the volume levels of the audio signals in accordance with the manipulations of the manipulators of the manipulation units 305, the signal processing contents, such as the volume level, may be designated in accordance with the contents of the identification information indicated by the watermark information superimposed on the audio signals. In this case, the mixer 30 may be a mixer 30*c* which is configured as shown in FIG. 12. FIG. 12 is a block diagram showing only the configuration on the path, through which the audio signal input from the input terminal 302-1 is processed, from the configuration of the mixer 30*c*.

As shown in FIG. 12, an extraction unit 303*c*-1 extracts the watermark information superimposed on the input audio signal, and outputs the identification information indicated by the extracted watermark information to the display control unit 304-1 and also to a control unit 308. A storage unit 309 is storage means, such as a nonvolatile memory, and stores a table in which the contents ("keyboard", "microphone", and the like) of the identification information and the contents (volume level) of the signal processing in the signal processing unit 306 are associated with each other.

A manipulation unit 305*c*-1 is configured such that the manipulator of the manipulation unit 305-1 in the first embodiment is moved under the control of the control unit 308. That is, the volume level is designated in accordance with not only the manipulation of the user but also the control of the control unit 308.

The control unit 308 reads the volume level, which is the content of the signal processing corresponding to the content of the identification information input from the extraction unit 303*c*-1, from the storage unit 309, and moves the manipulator of the manipulation unit 305*c*-1 to designate the read volume level. Similarly, the control unit 308 reads the volume levels corresponding to the contents of the identification information input from the extraction units 303*c*-2, 303*c*-3, 303*c*-4, and 303*c*-5 from the storage unit 309, and moves the manipulators of the manipulation units 305*c*-2, 305*c*-3, 305*c*-4, and 305*c*-5 to respectively designate the read volume levels.

The control unit 308 may move the manipulator of the manipulation unit 305*c*-6 to designate the volume level according to the combination of the identification information input from the extraction units 303*c*-1, 303*c*-2, 303*c*-3, 303*c*-4, and 303*c*-5 (hereinafter, referred to as extraction units 303*c* when discrimination is not made therebetween). In this case, a table in which the combination of the identification information and the contents of the signal processing are associated with each other may be stored in the storage unit 309, and the control unit 308 may move the manipulator of the manipulation unit 305*c*-6 in accordance with the correspondence relationship.

The control of the control unit 308 may be performed when the identification information is initially input from the extraction units 303*c* or when a manipulation of manipulation means (not shown) is made. With this, the position of the manipulator moved by the control unit 308 can be used as initial setting, and subsequently, the designated volume level can be changed in accordance with a manipulation of the user. Other configuration is the same as the mixer 30 in the first embodiment, thus description thereof will be omitted.

The control unit 308 may directly control the contents of the signal processing of the signal processing unit 306-1, instead of moving the manipulator of the manipulation unit 305*c*-1. In this case, the table of the storage unit 309 includes the amplification factor, not the volume level. With regard to the designation of the volume level by the manipulator of the manipulation unit 305*c*-1, the signal processing unit 306-1 may treat a designation as invalid or a designation for relatively changing the amplification factor.

As shown in Modification 1, when the signal processing unit 306 performs signal processing other than amplification processing according to the volume level, for example, equalizing processing, the table of the storage unit 309 may include the identification information and parameter indicating frequency characteristics for equalizing in association with each other. Signal processing according to the identification information may be changed over time. In this case, the table of the storage unit 309 includes the identification information and sequence data indicating changes in the contents of signal processing in association with each other. The start timing of sequence data may be the timing when the start is designated by manipulating the manipulation means (not shown). In this way, signal processing according to the identification information indicated by the watermark information superimposed on the input audio signal can be performed for the audio signal. In this case, the display unit 301 may not be provided.

<Modification 6>

Although in the above-described first embodiment, the power amplifier 40 amplifies the audio signal St input from the mixer 30, a display unit may be provided, and as shown in Modifications 2 and 3, the mixer 30 may have an extraction unit which, when the watermark information is superimposed on the audio signal St, extracts the watermark information, and a display control unit which causes the display unit to display the identification information indicated by the extracted watermark information.

<Modification 7>

Figure 13:
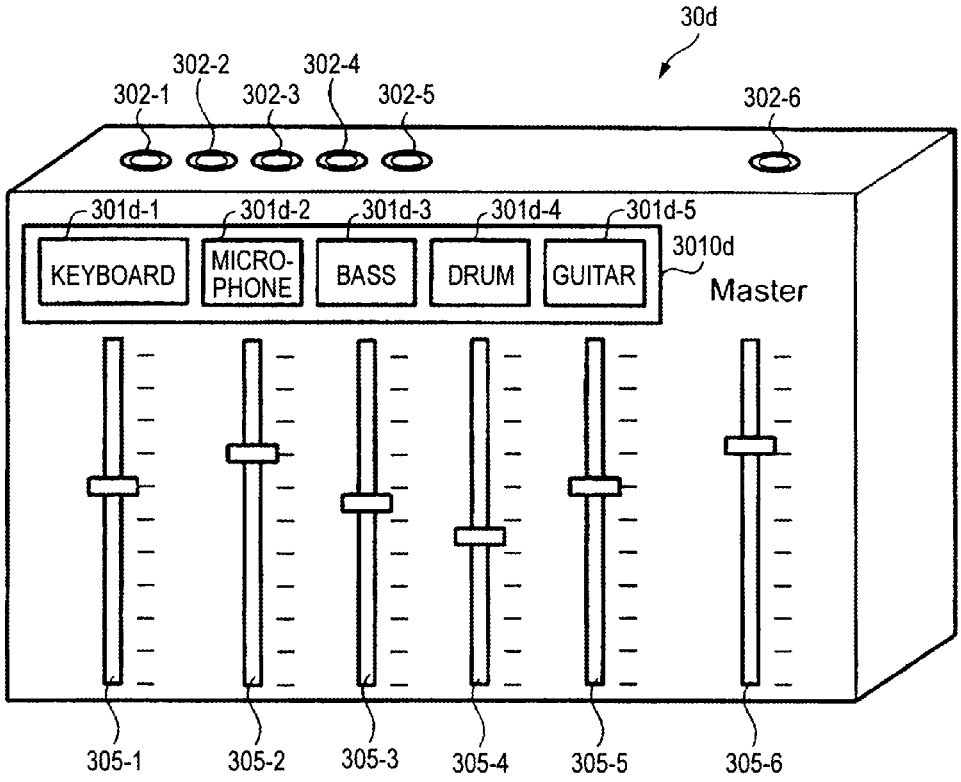
FIG. 13 is an appearance diagram of a mixer according to Modification 7 of the first embodiment.

Although in the above-described first embodiment, the multiple display units 301 are provided in the mixer 30, the display area of a single display unit may be divided into multiple areas and display may be performed. For example, a mixer 30*d* having the appearance shown in FIG. 13 may be used. The mixer 30*d* has a display unit 3010*d*, and display is performed for divided display areas 301*d*-1, 301*d*-2, . . . , and 301*d*-5. In this case, a display control unit may be provided which controls the display contents of the display unit 3010*d*, and the display control unit may control the display contents of the display areas 301*d*-1, 301*d*-2, . . . , and 301*d*-5 in accordance with the identification information output from the extraction units 303-1, 303-2, . . . , and 303-5 so as to display the contents of the corresponding identification information.

Figure 14:
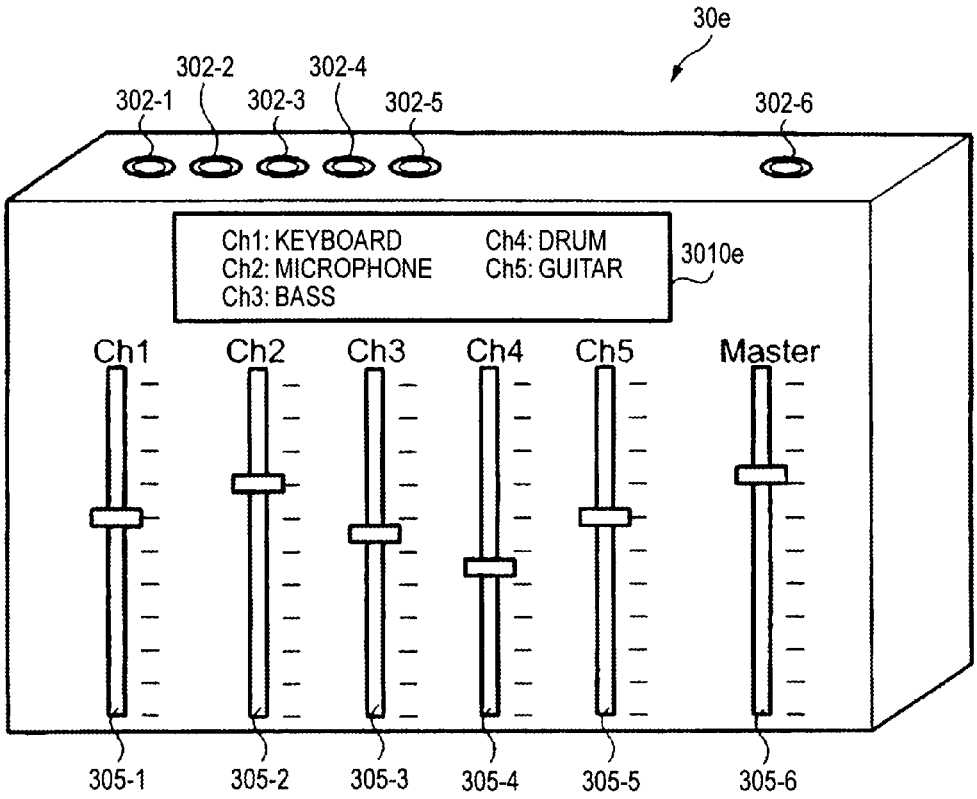
FIG. 14 is an appearance diagram of the mixer according to Modification 7 of the first embodiment.

In another aspect, a mixer 30*e* having the appearance shown in FIG. 14 may be used. The mixer 30*e* has a display unit 3010*e*, and causes display to be performed in association with the input channels. The input channels Ch1, Ch2, . . . , and Ch5 correspond to the input terminals 302-1, 302-2, . . . , and 302-5. In this case, a display control unit may be provided which controls the display contents of the display unit 3010*e*, and the display control unit may cause the display unit 3010*e* to display the contents of the identification information output from the extraction units 303-1, 303-2, . . . , and 303-5 in association with the input channels.

In this way, if display of the identification information is performed in correspondence with the input terminals 302, any display aspect may be used. The same is applied to the display units 201 of the connector B 20.

<Modification 8>

Although in the above-described first embodiment, the display units 301 of the mixer 30 are configured to display the contents of the identification information, any display may be performed insofar as display corresponds to the content of the identification information. In this case, a storage unit may be provided which stores a table, in which the contents of the identification information and the display contents are associated with each other, and, for example, the display control unit 304-1 which controls the display content of the display unit 301-1 may read the display content corresponding to the identification information input from the extraction unit 303-1 from the storage unit, and may cause the display unit 301-1 to display the read display content. The same is applied to the display units 201 of the connector B 20.

<Modification 9>

In the above-described first embodiment, the watermark information superimposed on the audio signal may be constantly superimposed or regularly superimposed. In each device having a superimposition function, when an instruction for superimposition is made by a manipulation of the manipulation unit or the like, superimposition may be carried out.

<Modification 10>

Figure 15:
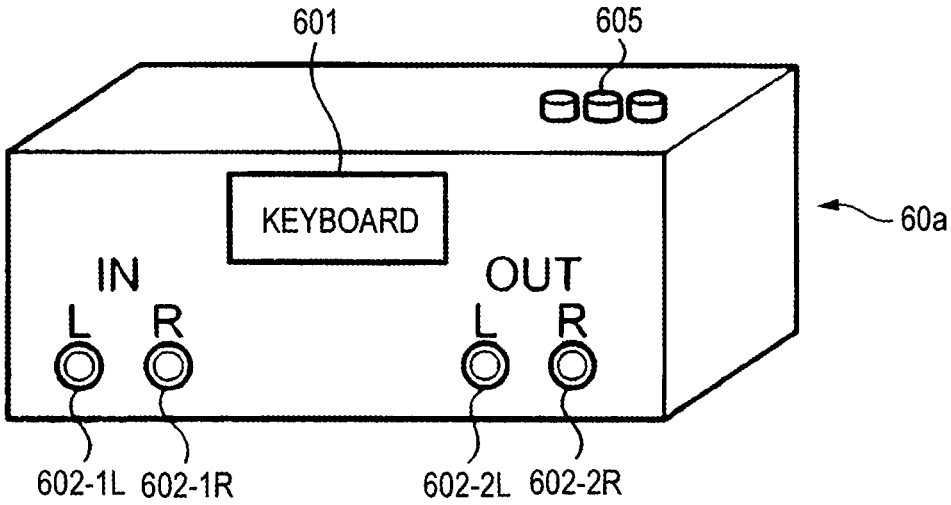
FIG. 15 is an appearance diagram of an identification information superimposition device according to Modification 10 of the first embodiment.

In the above-described first embodiment, as shown in FIG. 15, the identification information superimposition device 60 may be a stereo-compliant identification information superimposition device 60*a*. In this case, instead of the input terminal 602-1 and the output terminal 602-2, an Lch input terminal 602-1L, an Rch input terminal 602-1R, an Lch output terminal 602-2L, and an Rch output terminal 602-2R may be provided.

Figure 16:
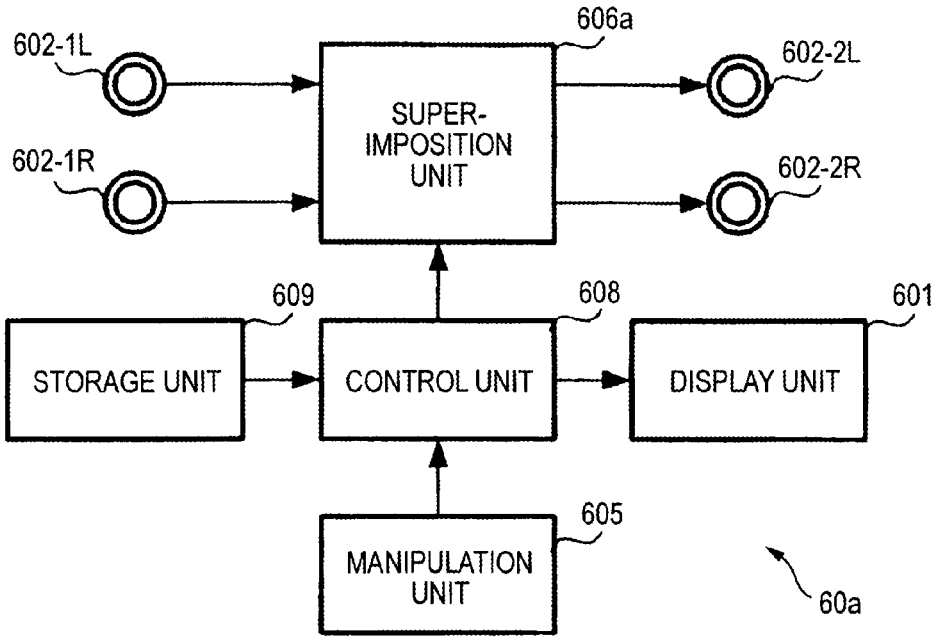
FIG. 16 is a block diagram showing the configuration of the identification information superimposition device according to Modification 10 of the first embodiment.

The configuration of the identification information superimposition device 60*a* will be described with reference to FIG. 16. A superimposition unit 606*a* superimposes watermark information indicating identification information "keyboard Lch", in which "Lch" is added to the identification information "keyboard" set in the control unit 608, on an audio signal input from the Lch input terminal 602-1L, and outputs the resultant audio signal to the Lch output terminal 602-2L. Meanwhile, the superimposition unit 606*a* superimposes watermark information indicating identification information "keyboard Rch", in which "Rch" is added to the identification information "keyboard" set in the control unit 608, on an audio signal input from the Rch input terminal 602-1R, and outputs the resultant audio signal to the Rch output terminal 602-2R. Other configurations are the same as the identification information superimposition device 60 in the first embodiment, thus description thereof will be omitted.

Therefore, when a musical instrument, for example, the keyboard 110 corresponds to the stereo 2*ch*, if there is no function for superimposing watermark information on an output audio signal, even when the watermark information is not superimposed on the Lch and Rch audio signals by using multiple identification information superimposition devices 60, the watermark information may be superimposed by the single identification information superimposition device 60*a*.

Second Embodiment

Figure 17:
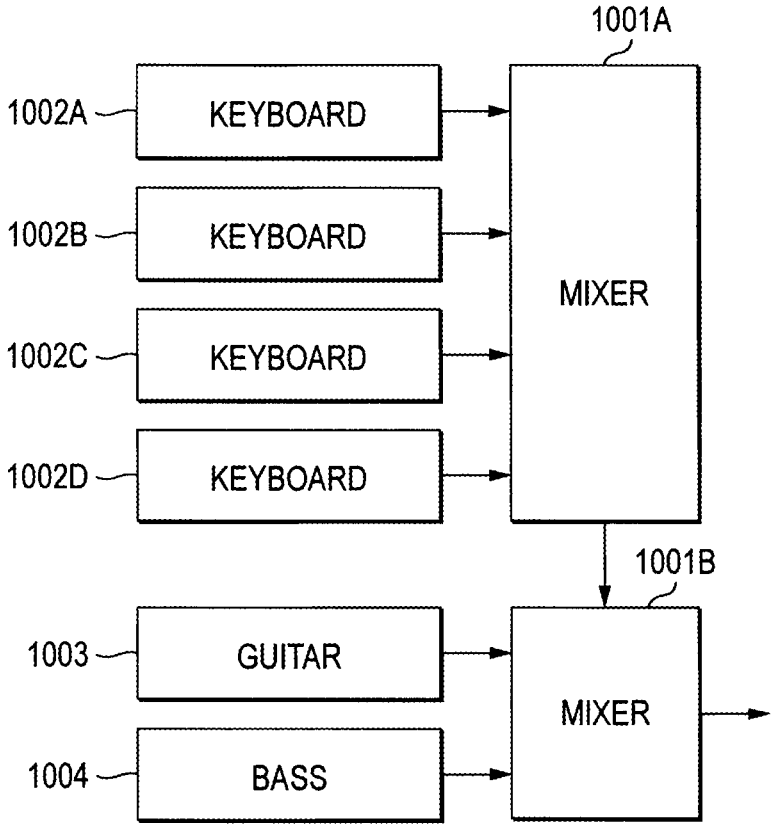
FIG. 17 is an explanatory view illustrating an example of the use of an audio signal processing device according to a second embodiment of the invention.

An audio signal processing device according to a second embodiment of the invention will be described with reference to FIG. 17. FIG. 17 is an explanatory view illustrating an example of the use of the audio signal processing device.

As shown in FIG. 17, a PA system includes two audio signal processing devices (hereinafter, referred to as mixers) 1001A and 1001B. Keyboards 1002A to 1002D are connected to the mixer 1001A. The mixer 1001A, a guitar 1003, and a bass 1004 are connected to the mixer 1001B. The mixer 1001A mixes audio signals output from the keyboards 1002A to 1002D, and outputs the resultant audio signal to the mixer 1001B. The mixer 1001B mixes the audio signal mixed by the mixer 1001A and the audio signals from the guitar 1003 and the bass 1004, and outputs the resultant audio signal. In this way, in the PA system, if the mixer has a multistage configuration, the audio signals output from more devices (for example, microphones, musical instruments, and the like) are mixed. The number of mixers is not limited to two.

Figure 18:
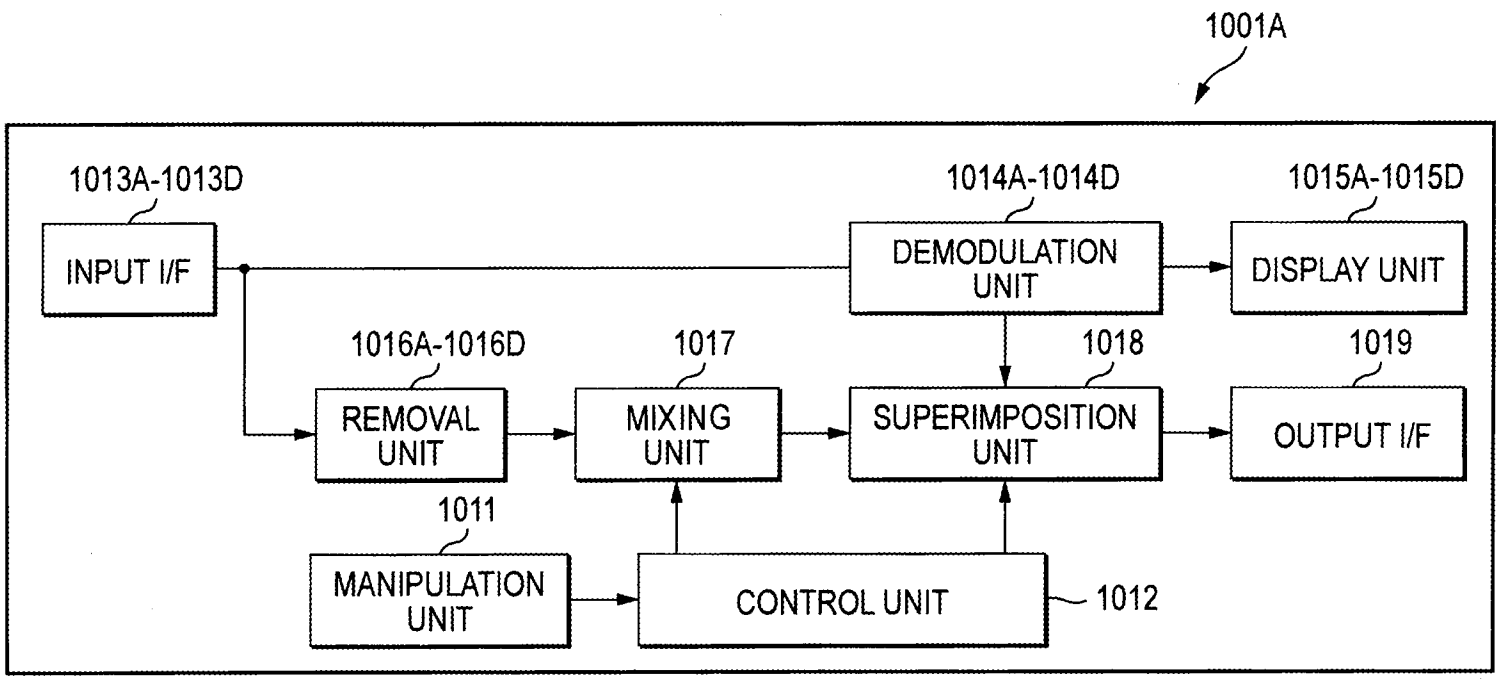
FIG. 18 is a block diagram showing the function and configuration of the audio signal processing device according to the second embodiment.
Figure 19:
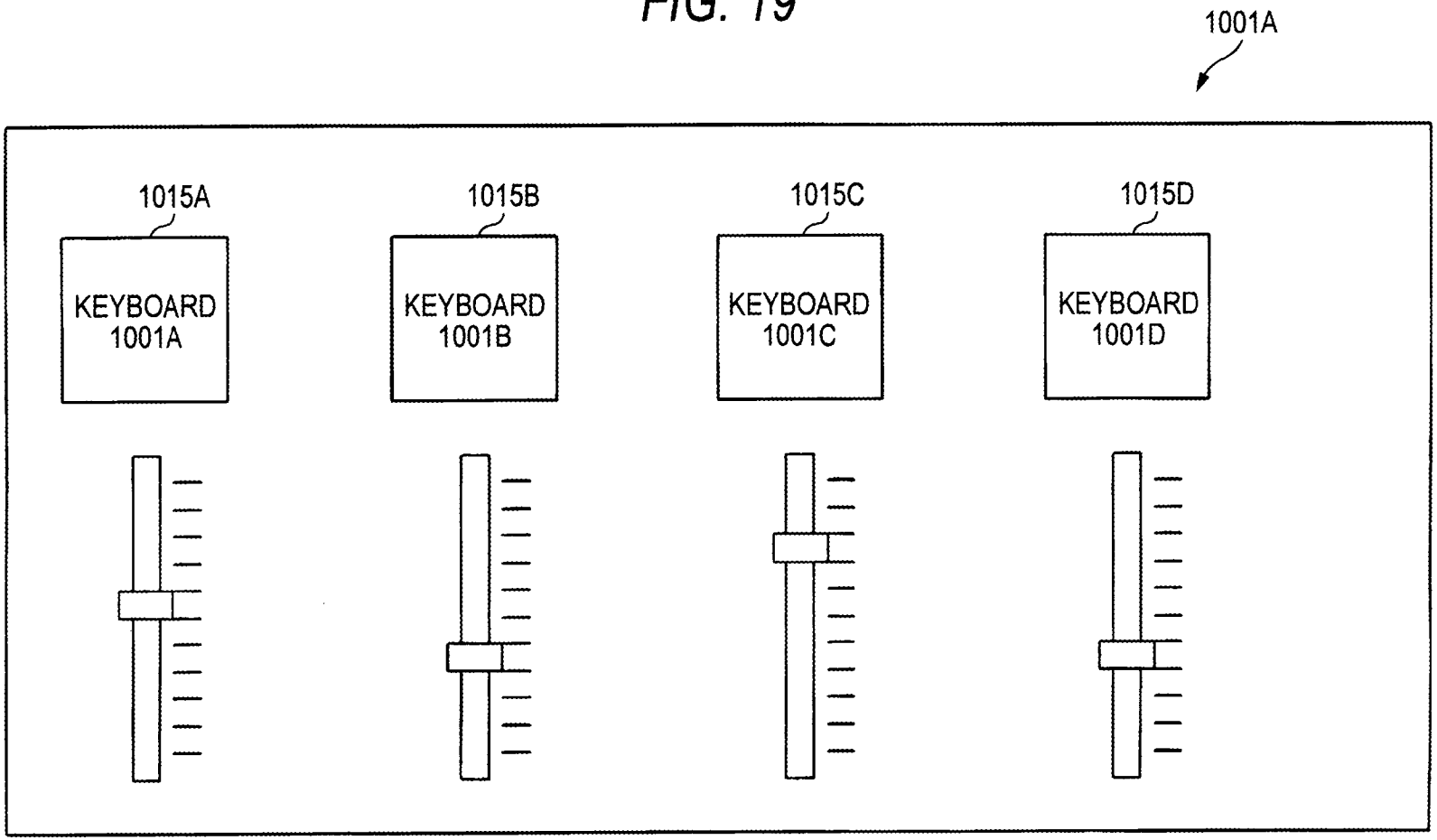
FIG. 19 shows an example of identification information which is displayed on the audio signal processing device according to the second embodiment.

Next, the function and configuration of the mixer 1001A and 1001B will be described with reference to FIGS. 18 and 19. FIG. 18 is a block diagram showing the function and configuration of the audio signal processing device. FIG. 19 shows an example of identification information which is displayed on the audio signal processing device. The mixer 1001A and 1001B have the same function and configuration, thus the mixer 1001A will be described as an example. The description will be provided assuming that the mixer 1001A has four channels and can be connected to four devices. The mixer 1001A includes a manipulation unit 1011, a control unit 1012, input I/Fs 1013A to 1013D, demodulation units 1014A to 1014D, display units 1015A to 1015D, removal units 1016A to 1016D, a mixing unit 1017, a superimposition unit 1018, and an output I/F 1019.

The manipulation unit 1011 receives a manipulation input from the user and outputs the manipulation input content to the control unit 1012. For example, the manipulation unit 1011 receives the input of specific identification information different from the identification information superimposed on the audio signals input to the mixer 1001A or the input of the mixing amount designating the mixing rate of the audio signals input from the input I/Fs 1013A to 1013D.

As the specific identification information, an arbitrary name may be used, and a name convenient for the user is used. Specifically, as the specific identification information, for example, a name indicating the type of device connected, such as "guitar group" or "drum set", or a name indicating the use purpose after mixing, such as "for xxx music", is used. Further, as the specific identification information, a name indicating a person in charge of mixing, such as "arrangement in charge of xxx", or a name indicating a mixer itself, such as "mixer 1001A", is used. In addition, as the specific identification information, a name indicating the feature of music to be played, such as "setting for jazz" or "setting for rock", or a name indicating a musical instrument with a high mixing rate, such as "guitar accented", is used. Hereinafter, in this embodiment, description will be provided assuming that the specific identification information is "keyboard group".

The control unit 1012 controls the functional units on the basis of the manipulation input content input from the manipulation unit 1011. For example, the control unit 1012 outputs the specific identification information input from the manipulation unit 1011 to the superimposition unit 1018 or controls the mixing unit 1017 on the basis of the mixing amount input from the manipulation unit 1011.

As many input I/Fs 1013A to 1013D are provided as there are channels (four channels) of the mixer 1001A, and are correspondingly connected to the devices (the keyboards 1002A to 1002D). The keyboards 1002A to 1002D generate audio signals in accordance with the play manipulation of the user. The keyboards 1002A to 1002D superimpose identification information (for example, the name of the keyboard, the product number of the keyboard, or the like) for identifying the keyboards 1002A to 1002D on a frequency band A (see (A) in FIG. 20) in the inaudible range of the generated audio signals, and input the resultant audio signals to the input I/Fs 1013A to 1013D. The input I/Fs 1013A to 1013D respectively output the audio signals from the keyboards 1002A to 1002D to the demodulation units 1014A to 1014D and the removal units 1016A to 1016D. Hereinafter, description will be provided assuming that the keyboards 1002A to 1002D have identification information "keyboard 1002A" to "keyboard 1002D", respectively.

As many demodulation units 1014A to 1014D are provided as there are channels of the mixer 1001A. The demodulation units 1014A to 1014D respectively demodulate the audio signals input from the input I/Fs 1013A to 1013D, and acquire the identification information. At this time, the demodulation units 1014A to 1014D acquire the identification information from the frequency band A (see (A) in FIG. 20). The demodulation units 1014A to 1014D output the acquired identification information to the display units 1015A to 1015D and the superimposition unit 1018.

As shown in FIG. 19, as many display units 1015A to 1015D are provided as there are channels of the mixer 1001A. The display units 1015A to 1015D respectively display the identification information input from the demodulation units 1014A to 1014D so as to correspond to the input I/Fs 1013A to 1013D to which the audio signals are input and the manipulation buttons of the channels.

The removal units 1016A to 1016D are, for example, low-pass filters and as many provided as there are channels of the mixer 1001A. The removal units 1016A to 1016D respectively remove the high range starting from the frequency band (frequency band A (see (A) in FIG. 20)), on which the identification information is superimposed, from the audio signals input from the input I/Fs 1013A to 1013D, and output the resultant audio signals to the mixing unit 1017.

The mixing unit 1017 mixes the audio signals input from the removal units 1016A to 1016D on the basis of an instruction from the control unit 1012, and outputs the resultant audio signal to the superimposition unit 1018.

The superimposition unit 1018 superimposes the specific identification information input from the control unit 1012 and the identification information input from the demodulation units 1014A to 1014D on different frequency bands of the mixed audio signal input from the mixing unit 1017, and outputs the resultant audio signal to the output I/F 1019. At this time, the specific identification information is superimposed on the frequency band A (see (B) in FIG. 20), and the identification information of the keyboards 1002A to 1002D is superimposed on a frequency band B (see (B) in FIG. 20) higher than the frequency band A. The details of the frequency bands on which the specific identification information and the identification information are superimposed will be described below.

The output I/F 1019 outputs the mixed audio signal to the lower-stage mixer 1001B of the mixer 1001A.

With this, the mixer 1001A displays the identification information of the audio signals input to the mixer 1001A on the display units 1015A to 1015D in association with the input I/Fs 1013A to 1013D and the manipulation buttons of the channels. For this reason, the user gives the display units 1015A to 1015D of the mixer 1001A a glance to understand the channels connected to the keyboards 1002A to 1002D. Further, even when the keyboards 1002A to 1002D are erroneously connected, the user can easily determine such an erroneous connection.

Figure 20:
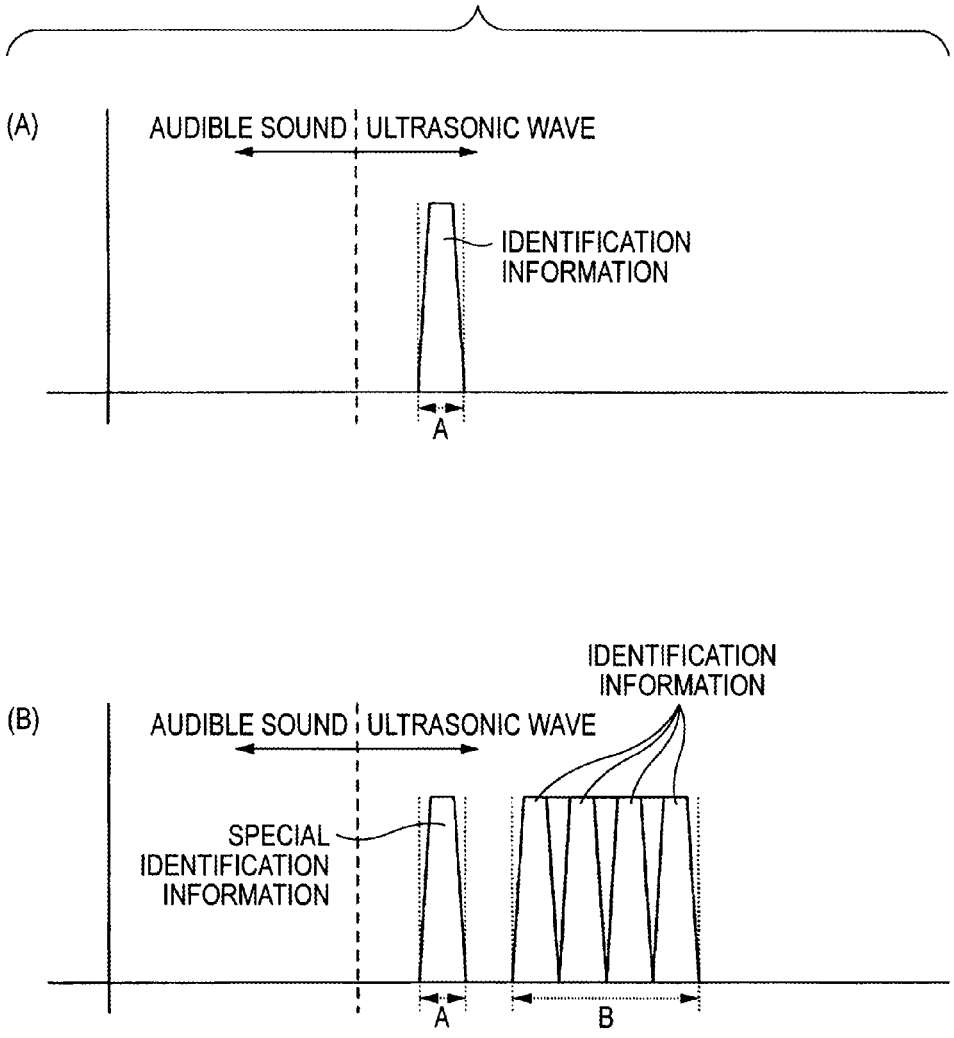
FIG. 20 is an explanatory view regarding a frequency band for superimposition of identification information and specific identification information according to the second embodiment.

Next, the frequency bands on which the specific identification information and the identification information are superimposed will be described with reference to FIG. 20. FIG. 20 is an explanatory view regarding the frequency bands on which the identification information and the specific identification information are superimposed.

As shown by (A) in FIG. 20, the keyboards 1002A to 1002D superimpose the identification information on the frequency band A in the inaudible range and output the resultant audio signals to the mixer 1001A. The mixer 1001A acquires the identification information from the frequency band A and also removes the high range starting from the frequency band A. Then, as shown by (B) in FIG. 20, the mixer 1001A superimposes the specific identification information input from the manipulation unit 1011 on the frequency band A, and superimposes the identification information superimposed on the audio signals of the keyboards 1002A to 1002D in the frequency band B higher than the frequency band A. The mixer 1001A superimposes the identification information of the keyboards 1002A to 1002D on the different frequency bands.

Similarly, the mixer 1001B acquires the identification information of the guitar 1003 and the bass 1004 and the specific identification information of the mixer 1001A from the frequency band A, and also removes the high range starting from the frequency band A. The mixer 1001B performs display of the keyboard group, the guitar 1003, and the bass 1004 on the display units 1015A to 1015C of the channels. In the mixer 1001B, the specific identification information input from the manipulation unit 1011 is superimposed on the frequency band A, and the identification information of the guitar 1003 and the bass 1004 and the specific identification information of the mixer 1001A are superimposed on the frequency band B higher than the frequency band A.

As described above, specific identification information or identification information of a device directly connected to the mixer is superimposed on the frequency band A, and only when a mixer is provided at the upper stage of the device, identification information of the device connected to the upper-stage mixer is superimposed on the frequency band B. For this reason, the mixer 1001B can reliably acquire the specific identification information of the upper-stage mixer 1001A or the identification information of the guitar 1003 and the bass 1004, and the identification information of the keyboards 1002A to 1002D connected to the mixer 1001A.

When the mixer has a multistage configuration, if the mixers mix the audio signals without removing the identification information, multiple identification information is superimposed on the same frequency band, causing noise. For this reason, the mixer 1001A mixes the audio signals after the identification information is removed. Thus, the mixer 1001A can reduce noise from the mixed audio signal.

Figure 21:
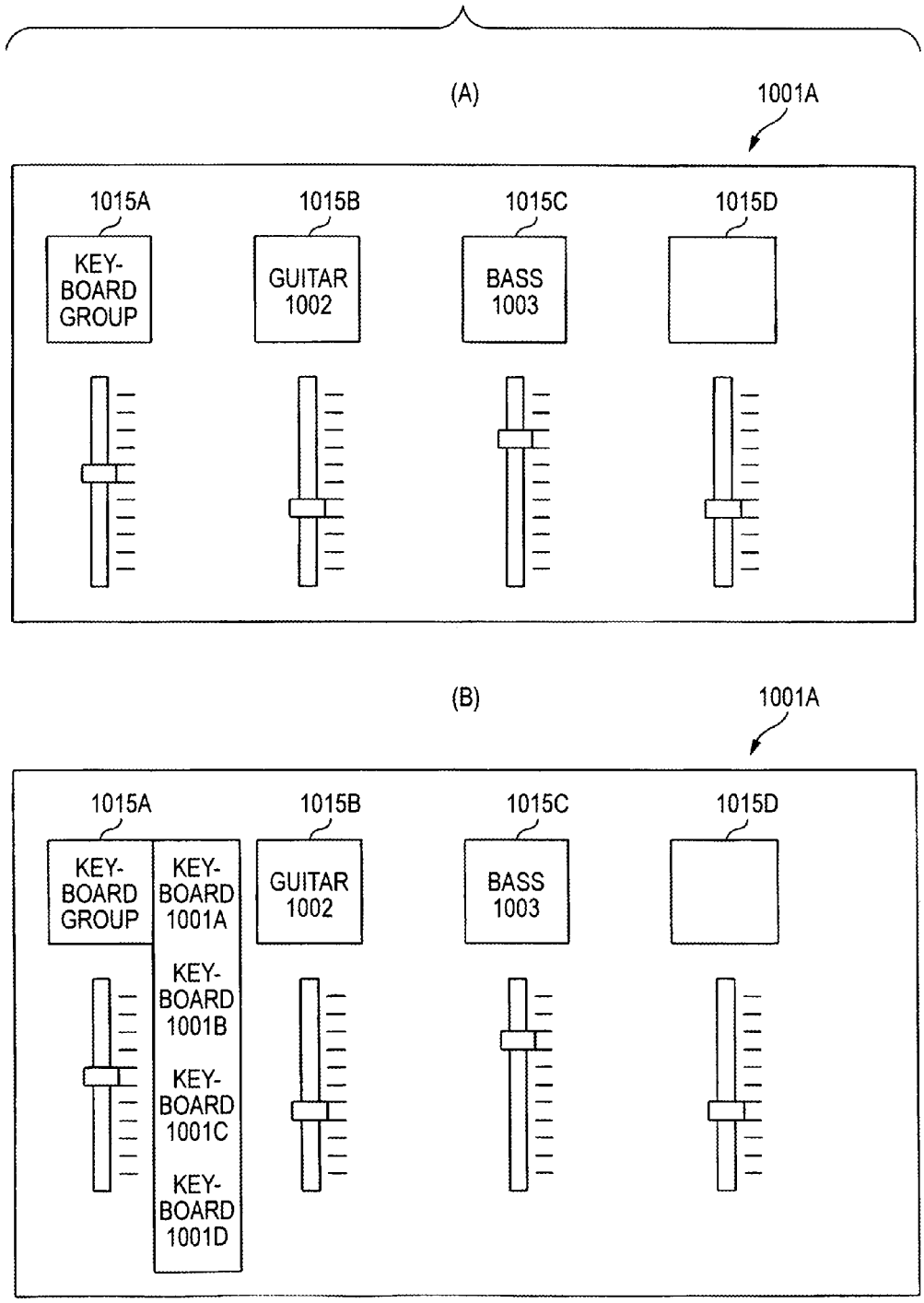
FIG. 21 shows an example of identification information which is displayed on a lower-stage audio signal processing device according to the second embodiment.

Next, the identification information which is displayed on the lower-stage mixer 1001B will be described with reference to FIG. 21. FIG. 21 shows an example of identification information which is displayed on a lower-stage audio signal processing device. In FIG. 21, (A) shows an example where specific identification information is displayed, and in FIG. 21, (B) shows an example where specific identification information and identification information are displayed.

As shown by (A) in FIG. 21, the mixer 1001A is connected to the input I/F 1013A of the mixer 1001B. Thus, the mixer 100B acquires the specific identification information "keyboard group" from the frequency band A, and displays the specific identification information "keyboard group" on the display unit 1015A. Further, the guitar 1003 and the bass 1004 are respectively connected to the input I/Fs 1013B and 1013C of the mixer 1001B, respectively. Thus, the mixer 1001B acquires the identification information "guitar 1003" and "bass 1004" from the frequency band A, and respectively displays the identification information "guitar 1003" and "bass 1004" on the display units 1015B and 1015C. Nothing is connected to the input I/F 1013D of the mixer 1001B, and an audio signal is not input. Thus, nothing is displayed on the display unit 1015D. When the wiring is disconnected, an audio signal is not input, thus nothing is displayed on the display unit. For this reason, the user understands that the wiring of a connected device is disconnected.

As described above, even when the mixers 1001A and 1001B are connected to each other in a multistage manner, the user understands the devices connected to the channels of the lower-stage mixer 1001B at a glance. Further, if the mixer 1001B and the devices (the mixer 1001A, the guitar 1003, and the bass 1004) are correctly connected, the user understands that the mixer 1001A at the upper stage of the mixer 1001B is erroneously connected to the devices. For this reason, the user confirms the connection between the mixer 1001A at the upper stage of the mixer 1001B and the devices (the keyboards 1002A to 1002D) to easily find an erroneous connection.

As shown by (B) in FIG. 21, the mixer 1001B may display the specific identification information "keyboard group" acquired from the frequency band A and the identification information "keyboard 1002A" to "keyboard 1002D" acquired from the frequency band B on the display unit 1015A. In this case, the user can know the details of the devices connected to the upper-stage mixer 1001A.

Although in the above-described second embodiment, the mixer 1001A superimposes the identification information acquired from the audio signals on the mixed audio signal together with the specific identification information, if information of the devices connected to the mixer 1001A is not necessary, re-superimposition may not be carried out.

Although in the above-described second embodiment, the mixer 1001A mixes the audio signals after the identification information is removed, the mixer may mix the audio signals without removing the identification information. In this case, the removal units 1016A to 1016D are not essential parts.

In the above-described second embodiment, the superimposition unit 1018 superimposes the specific identification information and the identification information on the different frequency bands by using a frequency-division multiplexing method. Alternatively, the superimposition unit 1018 may superimpose the specific identification information and the identification information by using a time-division multiplexing method, a spread code multiplexing method, an acoustic watermark technique for an audible range, or the like.

Figure 22:
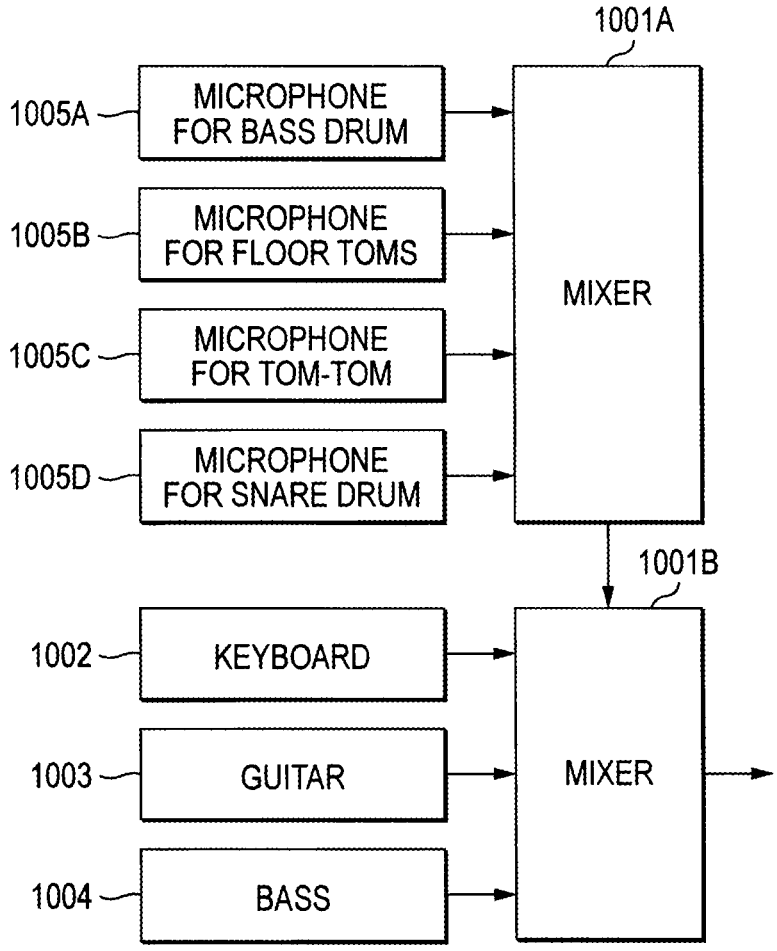
FIG. 22 is an explanatory view illustrating another example of the use of the audio signal processing device according to the second embodiment.

Although in the above-described second embodiment, the keyboards 1002A to 1002D are connected to the upper-stage mixer 1001A, the devices which are to be connected are not limited to the keyboards. FIG. 22 is an explanatory view illustrating another example of the use of an audio signal processing device. As shown in FIG. 22, the mixer 1001A may mix the audio signals from the drum set. The drum set includes multiple drums (for example, a bass drum, floor toms, a tom-tom, and a snare drum). Sound emitted from the drums is collected by microphones 1005A to 1005D to generate the audio signals from the drum set.

If the name or product number of the microphone is input from the upper-stage mixer 1001A as identification information, the lower-stage mixer 1001B does not understand the sound source (drums) of the audio signals input to the upper-stage mixer 1001A. Thus, the mixer 1001A mixes the audio signals from the drums, superimposes specific identification information "drum set" on the mixed audio signal, and outputs the resultant audio signal. Therefore, the user can know that the sound source of the audio signals input to the upper-stage mixer 1001A is the drums.

For example, the mixer 1001A may be connected to different musical instruments, such as a keyboard, a guitar, and a bass.

Third Embodiment

An audio mixer 2001 is a device which receives multiple audio signals, performs equalization, amplification, and the like for the audio signals, mixes the audio signals, and outputs the resultant audio signals to one or multiple channels (buses).

Figure 23:
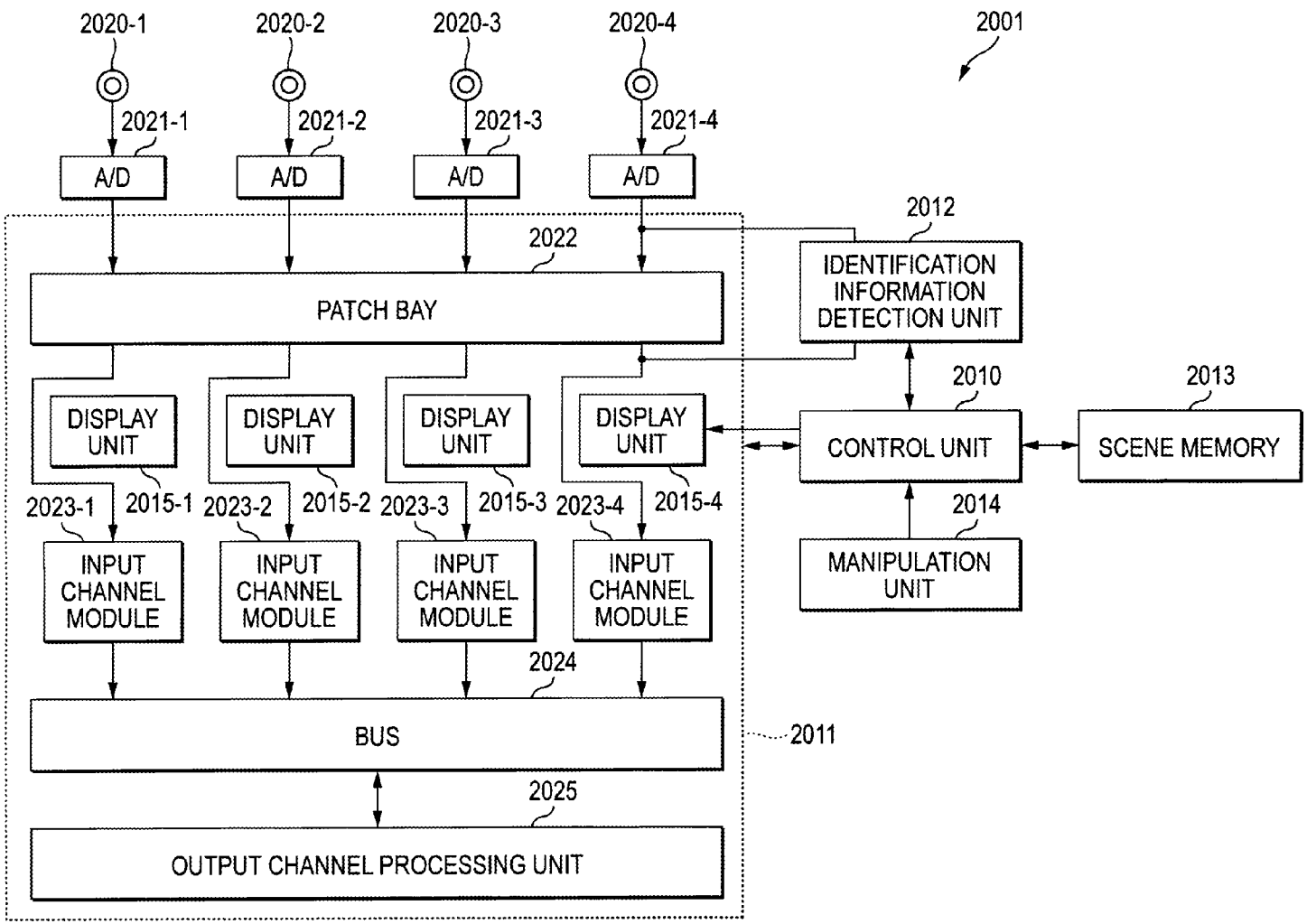
FIG. 23 is a block diagram of an audio mixer according to a third embodiment of the invention.

The audio mixer 2001 shown in FIG. 23 includes a control unit 2010, a signal processing unit 2011, an identification information detection unit 2012, a scene memory 2013, a manipulation unit 2014, multiple display units 2015-1 to 2015-4, and multiple analog input terminals 2020-1 to 2020-4, and A/D converters 2021-1 to 2021-4. The signal processing unit 2011 is constituted by one or multiple DSPs, and includes a patch bay 2022, multiple input channel modules 2023-1 to 2023-4, a bus group 2024, and an output channel processing unit 2025. The input channel modules correspond to the signal processing units of this embodiment. When the input terminals 2020 are digital input terminals, the A/D converters 2021 are not provided.

The A/D converters 2021-1 to 2021-4 are connected to the input terminal 2020-1 to 2020-4 to convert analog audio signals input from the input terminals 2020-1 to 2020-4 to digital audio signals. The input channel modules 2023-1 to 2023-4 have the configuration shown in FIG. 24 to equalize and amplify the input (digital) audio signals and to output the resultant audio signals to the designated bus. The patch bay 2022 is a circuit unit which assigns (connects) the input terminals 2020-1 to 2020-4 (A/D converters 2021-1 to 2021-4) to the input channel modules 2023-1 to 2023-4 one by one. In the default (initial setting), the patch bay 2022 provides a straight connection, that is, connects the input terminal 2020-1 to the input channel module 2023-1, the input terminal 2020-2 to the input channel module 2023-2, the input terminal 2020-3 to the input channel module 2023-3, and the input terminal 2020-4 to the input channel module 2023-4. The patching pattern (connection form) regarding which input terminal (audio source) and which input channel module are connected to each other is switched/controlled by the control unit 2010.

Figure 24:
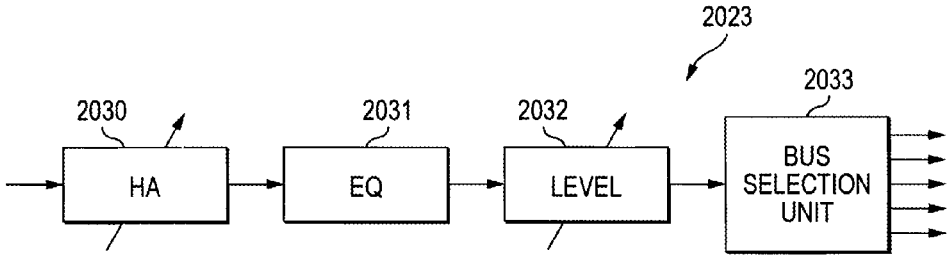
FIG. 24 is a block diagram of an input channel module of the audio mixer according to the third embodiment.

As shown in FIG. 24, the input channel module 2023 has a head amplifier 2030, an equalizer 2031, a fader 2032, and a bus selection unit 2033. The bus selection unit 2033 includes PAN control to control the output rate with respect to the L/R stereo bus. The gain of the head amplifier 2030, the equalizing setting of the equalizer 2031, the level setting of the fader 2032, and the selection/setting of the bus selection unit 2033 are input in accordance with the manipulations of the manipulation unit 2014 by the operator and set in the input channel module 2023 by the control unit 2010.

The bus group 2024 has multiple buses including the stereo bus and multiple mix buses. The term "bus" refers to an input/output buffer in which multiple audio signals can be input and added/mixed.

The output channel processing unit 2025 is a circuit unit which outputs the audio signals of the buses of the bus group 2024 to the outside or inputs the audio signals of the buses to another bus again. The audio mixer selects a bus to which the signal of the input channel module 2023 is input, and selects a bus from which a signal is output to the outside, outputting multiple audio signals in various mixing forms.

Identification information for identifying the audio sources or audio devices is superimposed on the audio signals input to the audio mixer 2001 as acoustic watermark information. The term "audio source" refers to a source which generates the audio signal, for example, a musical instrument or a vocalist microphone, or the like. The term "audio device" refers to a device which generates an audio signal or performs signal processing, such as amplification or modulation, for the audio signal, and is a concept including the audio source.

As the method of superimposing identification information on audio signals as watermark information, various known methods may be used which use a spread spectrum with little effect on the sense of hearing. For example, a pseudo noise code using M series and Gold series is signalized and superimposed, and the phase is inverted/non-inverted in each cycle, such that information can be superimposed. As the frequency band for superimposition of the watermark information, an inaudible frequency band, such as ultrasonic waves, is preferably used on the sense of hearing, but the frequency band has to be used which is equal to or lower than the Nyquist frequency of the A/D converter 2021.

Figure 25:
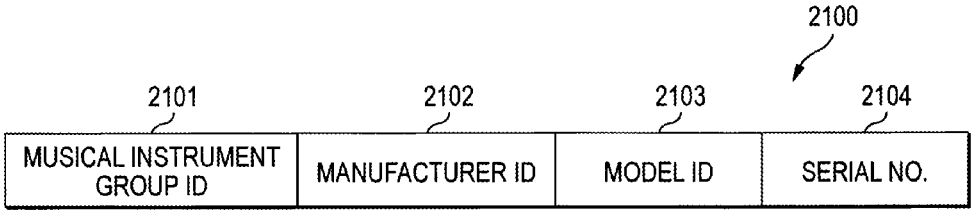
FIG. 25 shows an example of identification information which is superimposed on an audio signal input to the audio mixer according to the third embodiment.

FIG. 25 shows an example of identification information which is superimposed on an audio signal. Identification information 2100 includes a musical instrument group ID 2101, a manufacturer ID 2102, a model ID 2103, and a serial number 2104. The musical instrument group ID 2101 is identification information in the widest category which indicates what kind of musical instrument the audio source is. For example, the musical instrument group ID 2101 includes 001 indicating pianos, 017 indicating keyboards (other than pianos), 025 indicating guitars, and the like. The manufacturer ID 2102, the model ID 2103, and the serial number 2104 are information for identifying the individual musical instrument and, when the same multiple musical instruments are used at the same time (connected to the audio mixer 2001), are used to identify the musical instruments.

The identification information detection unit 2012 extracts and reads the identification information superimposed on the audio signals input from the input terminals 2020-1 to 2020-4, and inputs the identification information to the control unit 2010.

The identification information detection unit 2012 reads the identification information of the audio signals input from the input terminals 2020-1 to 2020-4 between the input terminals 2020 and the patch bay 2022, and reads the identification information of the audio signals input to the input channel modules 2023-1 to 2023-4 between the patch bay 2022 and the input channel modules 2023.

The scene memory 2013, the manipulation unit 2014, and the display units 2015-1 to 2015-4 are connected to the control unit 2010. The manipulation unit 2014 is a functional unit which receives a manipulation of the fader or the like by the operator. The display units 2015-1 to 2015-4 display the names of the audio sources which are assigned to the input channel modules 2023-1 to 2023-4.

The scene memory 2013 is a memory which stores scene data generated by the operator.

The term "scene data" refers to data which includes various setting contents of the signal processing unit 2011, for example, the gain of the head amplifier 2030, the setting of the equalizer 2031, the level setting of the fader 2032, and the bus selection information/send level in each of the input channel modules 2023-1 to 2023-4, the identification information of the audio sources assigned to the input channel modules 2023-1 to 2023-4, and the like. Of these, the gain of the head amplifier 2030, the setting of the equalizer 2031, the level setting of the fader 2032, and the bus selection information/send level in each of the input channel modules 2023-1 to 2023-4 correspond to the signal processing parameters of this embodiment.

The operator of the audio mixer 2001 manipulates the manipulation unit 2014 to set the input channel module 2023 and the like of the signal processing unit 2011 variously. If a store manipulation is made through the manipulation unit 2014, the setting content of the signal processing unit 2011 at that time is stored in the scene memory 2013 as scene data. At this time, the identification information of the audio signals input to the input channel modules 2023-1 to 2023-4 read by the identification information detection unit 2012 is stored as the identification information of the audio sources assigned to the input channel modules 2023-1 to 2023-4.

If a recall (read) manipulation is made in accordance with a manipulation of the manipulation unit 2014 by the operator, scene data is read from the scene memory 2013 and set in the signal processing unit 2011. The scene memory 2013 may store multiple (for example, 300) scene data, and at the time of recall, the operator may designate the scene number.

With the recall, the signal processing parameters, such as gain of the head amplifier 2030, the setting of the equalizer 2031, the level setting of the fader 2032, and the bus selection information/send level in each of the input channel modules 2023-1 to 2023-4 of read scene data are set in each of the input channel modules 2012-1 to 2012-4.

Meanwhile, the patching pattern of the patch bay 2022 is set on the basis of the identification information of the audio sources assigned to the input channel modules 2023-1 to 2023-4 in scene data. That is, the identification information detection unit 2012 reads the identification information from the audio signals input from the input terminals 2020-1 to 2020-4 and detects the audio sources connected to the input terminals 2020-1 to 2020-4. The control unit 2010 compares the detection result with the identification information of the audio sources assigned to the input channel modules 2023-1 to 2023-4, and sets the patching pattern of the patch bay 2022 such that both coincide with each other.

Thus, even when the audio sources connected to the input terminals 2020-1 to 2020-4 are replaced at the time of storage and recall of scene data, the control unit 2010 automatically changes the setting of the patching pattern of the patch bay 2022, such that at the time of recall, the audio signal of the same audio source as that at the time of storage can be input to the same input channel module 2023.

Figure 26:
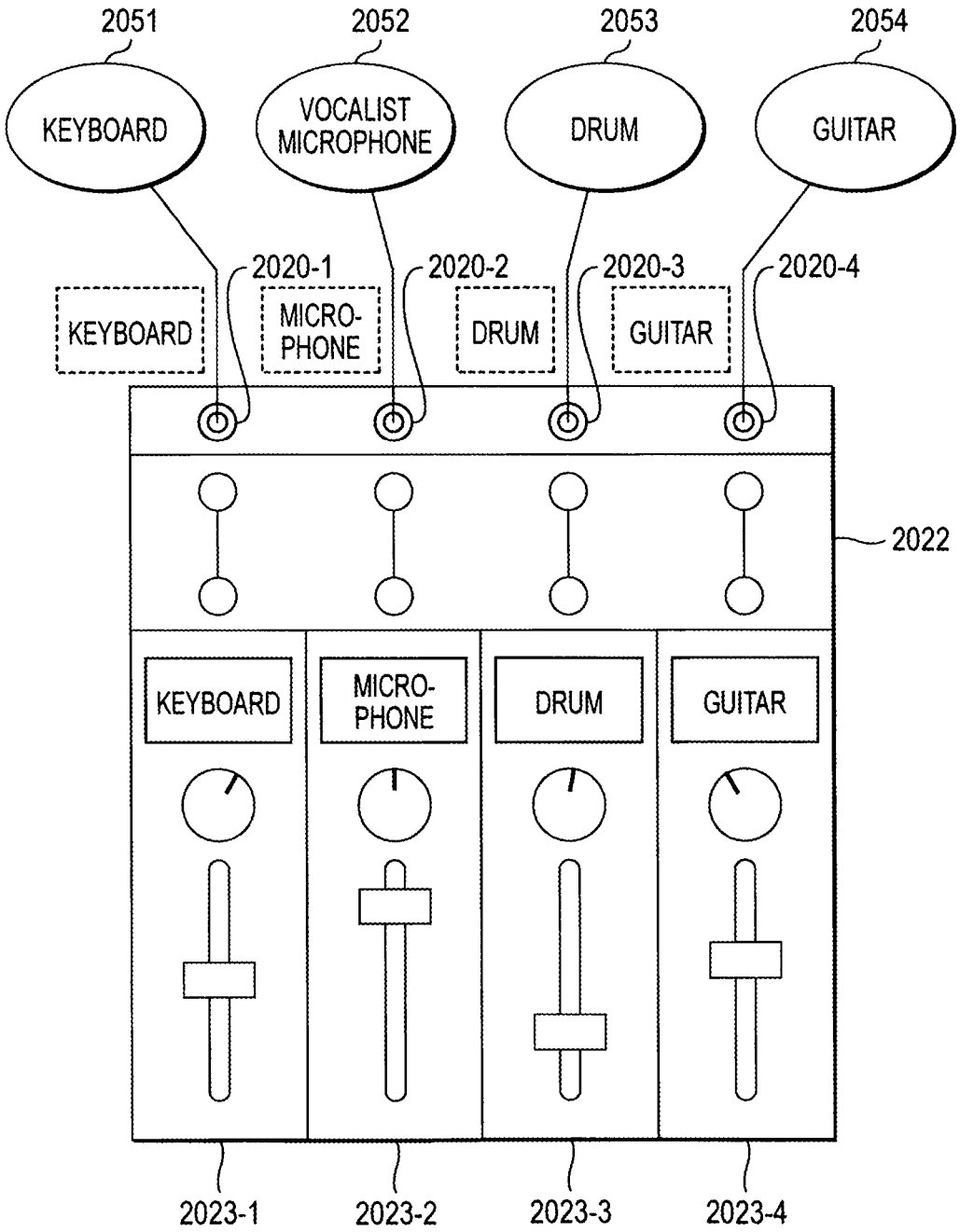
FIG. 26 shows the connection form of audio sources at the time of storage of scene data according to the third embodiment.
Figure 27:
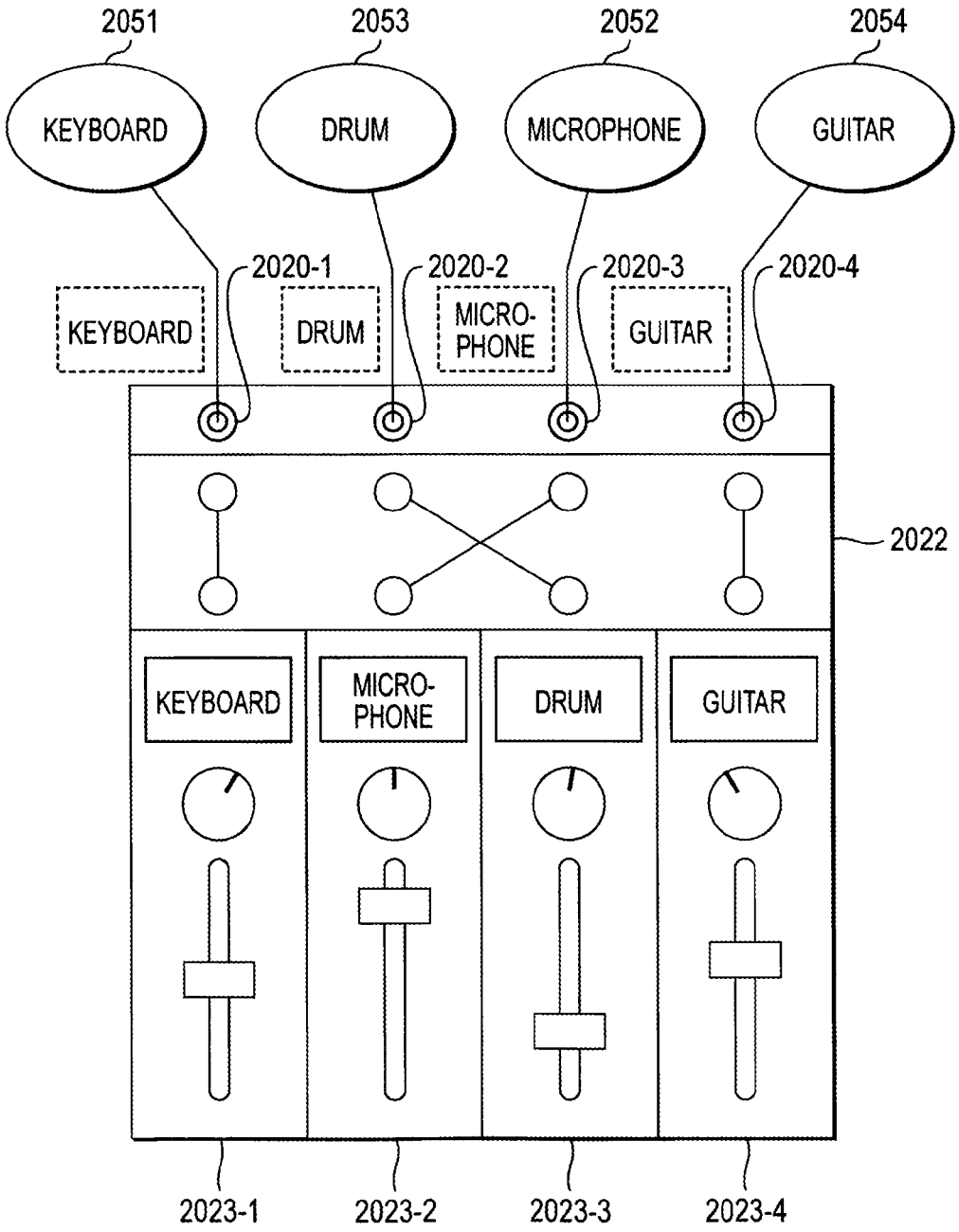
FIG. 27 shows the connection form of audio sources and a patching pattern of a patch bay at the time of recall of scene data according to the third embodiment.

The connection form of the audio sources and the patching pattern of the patch bay 2022 at the time of storage and recall will be described with reference to FIGS. 26 and 27. FIG. 26 shows the connection form of the audio sources and the patching pattern of the patch bay 2022 at the time of storage of scene data. FIG. 27 shows the connection form of the audio sources and the patching pattern of the pattern bay 2022 at the time of recall of scene data.

Referring to FIG. 26, a keyboard 2051 is connected to the input terminal 2020-1, a vocalist microphone 2052 is connected to the input terminal 2020-2, a drum 2053 is connected to the input terminal 2020-3, and a guitar 2054 is connected to the input terminal 2020-4. The patching pattern of the patch bay 2022 is a default straight connection.

After this setting is stored in the scene memory 2013 as scene data, the audio sources 2051 to 2054 are separated from the audio mixer 2001. Then, after the audio sources 2051 to 2054 are connected to the audio mixer 2001 again, stored scene data is recalled. The input channel modules 2023 are set on the basis of scene data so as to be the same as that at the time of storage. Meanwhile, the patch bay 2022 sets the patching pattern on the basis of the detection result of the identification information detection unit 2012 such that the same audio sources as that at the time of storage are connected to the input channel modules 2023-1 to 2023-4.

In the example of FIG. 27, the keyboard 2051 is connected to the input terminal 2020-1, the drum 2053 is connected to the input terminal 2020-2, the vocalist microphone 2052 is connected to the input terminal 2020-3, and the guitar 2054 is connected to the input terminal 2020-4. Meanwhile, in order to assign the audio sources to the input channel modules 2023-1 to 2023-4 in the same manner as at the time of storage, the patch bay 2022 connects the input terminal 2020-2 to the input channel module 2023-3, and connects the input terminal 2020-3 to the input channel module 2023-2.

Thus, the operator of the audio mixer 2001 does not have to confirm the connection form of the audio sources 2051 to 2054, and can restore the setting at the time of storage only by recalling scene data.

Figure 28:
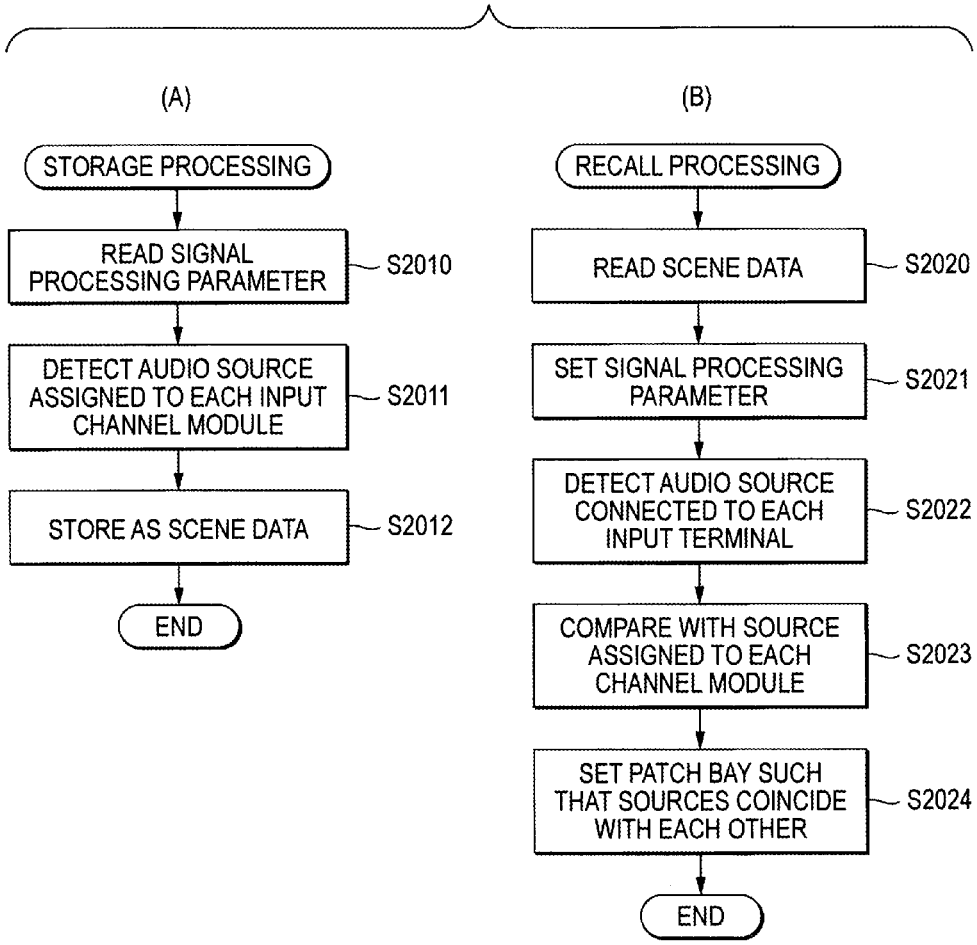
FIG. 28 is a flowchart showing the operations of a control unit at the time of storage and recall of scene data according to the third embodiment.

FIG. 28 is a flowchart showing the operations of the control unit 2010 at the time of storage and recall of scene data.

In FIG. 28, (A) shows the operation at the time of storage. If a store manipulation is made by the operator, the operation is carried out. First, the signal processing parameters set in the input channel modules 2023 and the output channel processing unit 2025 are read (S2010). Next, the identification information detection unit 2012 reads the identification information from the audio signals between the patch bay 2022 and the input channel modules 2023-1 to 2023-4 to detect the audio sources assigned to the input channel modules 2023-1 to 2023-4 (S2011). Information collected in S2010 and S2011 is stored in the scene memory 2013 as scene data (S2012).

In FIG. 28, (B) shows the operation at the time of recall. If a recall manipulation is made by the operator, the operation is carried out. First, scene data is read from the scene memory 2013 (S2020). Of scene data, the signal processing parameters which are setting data of the input channel module 2023 or the output channel processing unit 2025 are set in the corresponding functional unit (S2021). Next, the identification information detection unit 2012 reads the identification information from the audio signals between the input terminals 2020-1 to 2020-4 and the patch bay 2022 to detect the audio sources connected to the input terminals 2020-1 to 2020-4 (S2022). The detected audio sources are compared with the audio sources assigned to the input channel modules 2023-1 to 2023-4 included in read scene data (S2023), and the patching pattern of the patch bay 2022 is set such that both coincide with each other (S2024).

Although in the above-described embodiment, the patching pattern of the patch bay 2022 is controlled such that the audio sources assigned to the input channel modules 2023-1 to 2023-4 coincide with the contents of recalled scene data, the patch bay 2022 may replace the settings of the input channel modules 2023-1 to 2023-4 so as to coincide with the audio sources connected to the input terminals 2020-1 to 2020-4 as the default straight connection.

Figure 29:
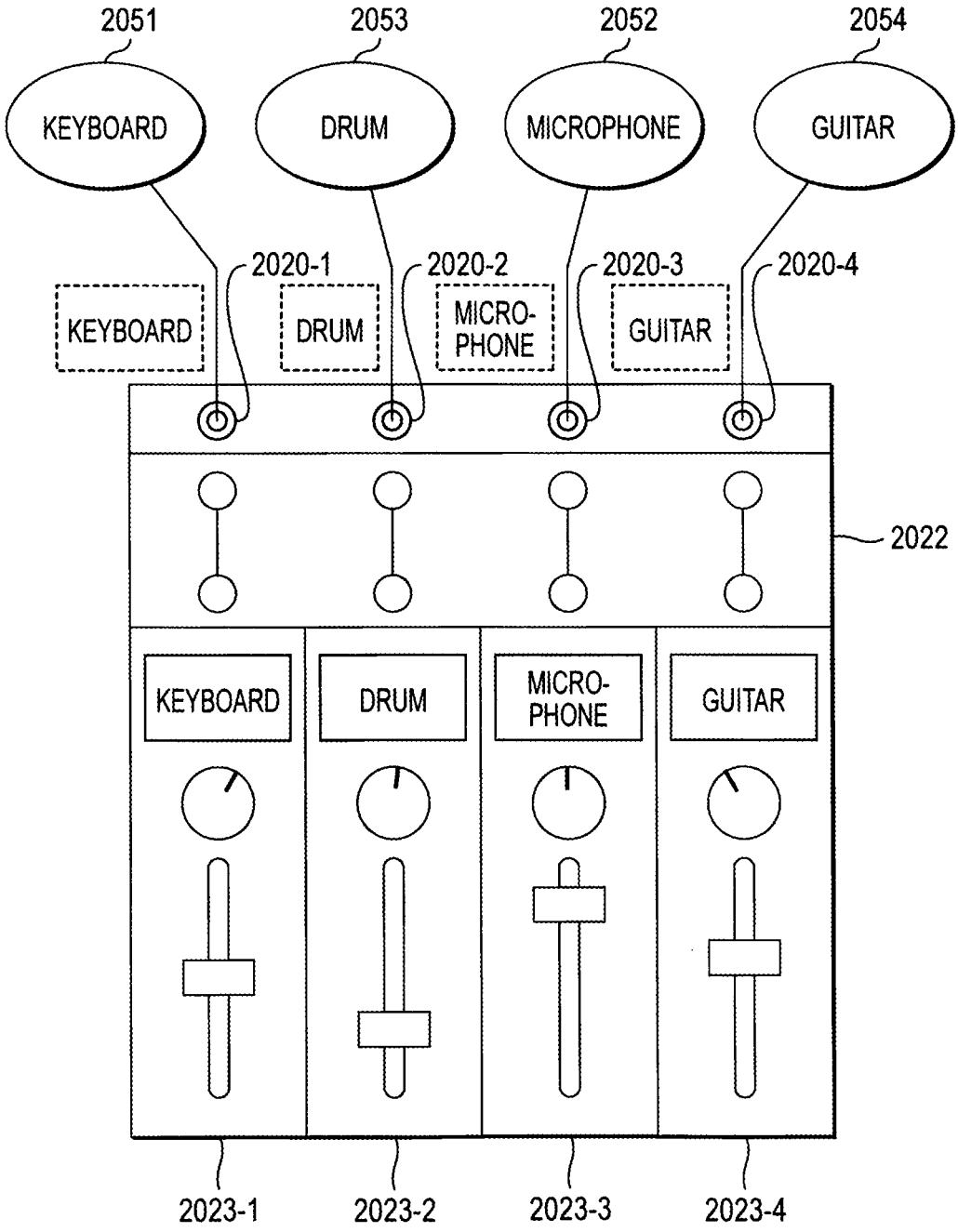
FIG. 29 shows an example where association between input terminals and input channel modules is reset according to the third embodiment.
Figure 30:
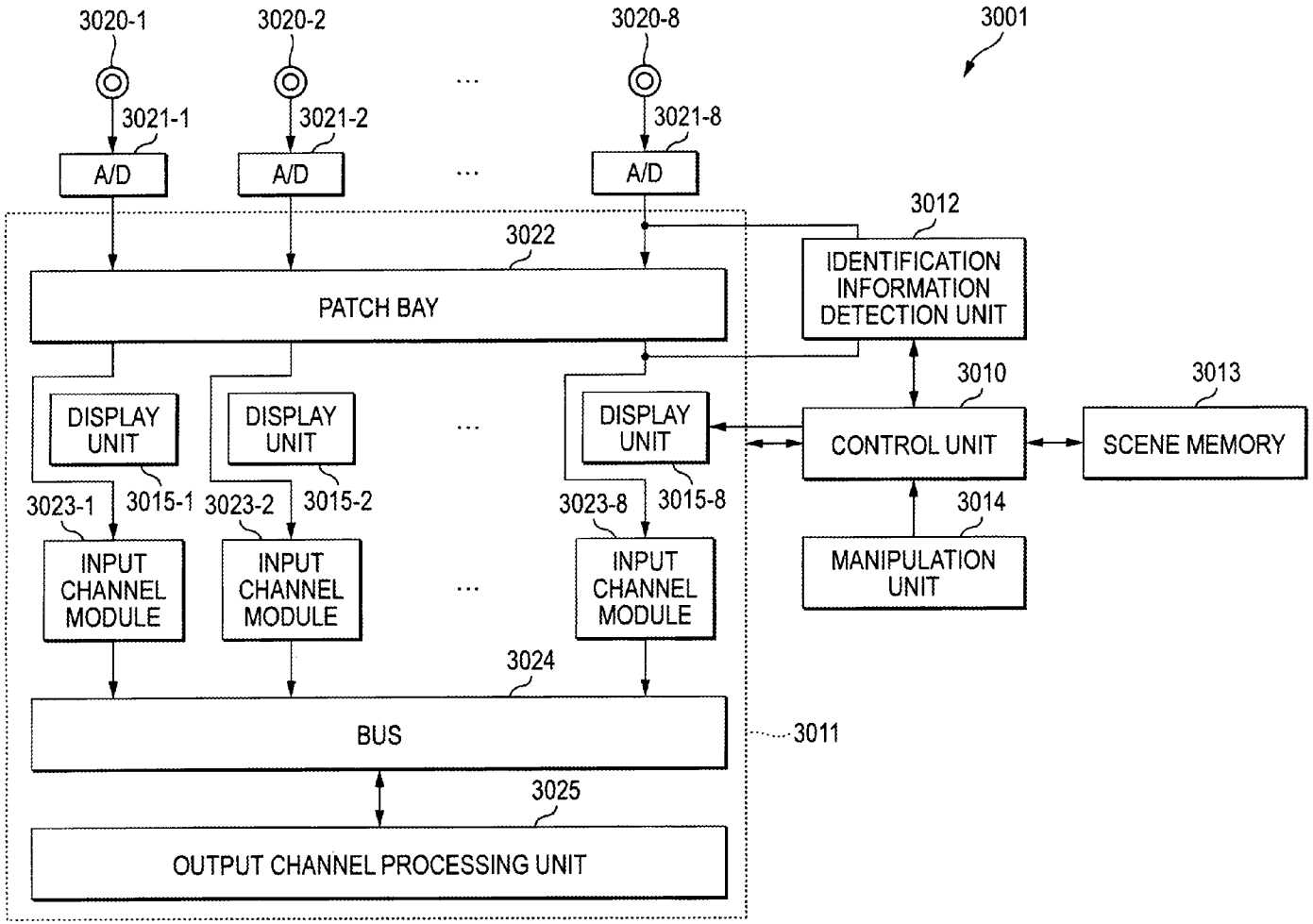
FIG. 30 is a block diagram of an audio mixer according to a fourth embodiment of the invention.

That is, when scene data is stored in accordance with the setting of FIG. 26, and when the connection form of the audio sources 2051 to 2054 is as shown in FIG. 27 at the time of recall of scene data, as shown in FIG. 29, the setting of the input channel module 2023-2 and the setting of the input channel module 2023-3 are replaced with each other.

Thus, when the patching pattern of the patch bay 2022 is complicated, the default straight connection can be returned. Further, even in the case of an audio mixer with no patch bay 2022, the association between the audio sources and the settings of the input channel modules can be automatically carried out.

The determination whether or not the audio source connected to the input terminal 2020 completely coincide with the audio source assigned to the input channel module 2023 may be made on the condition that the identification information shown in FIG. 25 is completely identical, on the condition that the musical instrument group ID 2101, the manufacturer ID 2102, and the model ID 2103 are identical, or on the condition that only the musical instrument group ID 2101 is identical. At the same time, the condition may be decided in accordance with the relationship with the audio source connected to another input terminal. That is, if another musical instrument of the same kind is not connected, the coincidence condition is eased, and when a number of musical instruments of the same kind are connected, the coincidence condition is made strict.

Although in the above-described third embodiment, the audio mixer has been described as an example, the application of the invention is not limited to the audio mixer. The invention may be applied to a PA system in which multiple devices, such as an audio mixer, a patch bay, an effects unit, and an input connector box, are combined. In this case, the assignment pattern of the audio sources in the respective devices may be stored as scene data.

In the above-described third embodiment, the number of input terminals 2020 and the number of input channel modules are not limited to four.

Although in the third embodiment, the audio sources superimpose the identification information on the generated audio signal, a setting mode may be provided in each of the audio sources, and in the setting mode, the audio sources may transmit the identification information separately. When the identification information is superimposed on the audio sources, after the setting of the audio mixer 2001 is completed, superimposition of the identification information may be stopped (in a real performance).

The audio mixer 2001 may remove the identification information from the audio signals.

Fourth Embodiment

An audio mixer 3001 is a device which receives multiple sound signals (audio signals), performs equalizing, amplification, and the like for the audio signals, mixes the audio signals, and outputs the resultant audio signals to one or multiple output channels. In this embodiment, description will be provided for mixer which receives an eight-channel sound signal and carries out signal processing. The number of channels is not limited to eight.

The audio mixer 3001 includes a control unit 3010, a signal processing unit 3011, an identification information detection unit 3012, a scene memory 3013, a manipulation unit 3014, multiple display units 3015-1 to 3015-8, multiple analog input terminals 3020-1 to 3020-8, and multiple A/D converters 3021-1 to 3021-8. The signal processing unit 3011 is constituted by one or multiple DSPs, and includes a patch bay 3022, multiple input channel modules 3023-1 to 3023-8, a bus group 3024, and an output channel processing unit 3025. The input channel modules correspond to the signal processing unit of this embodiment.

The A/D converters 3021-1 to 3021-8 are connected to the input terminals 3020-1 to 3020-8. The A/D converters 3021-1 to 3021-8 respectively convert analog audio signals input from the input terminal 3020-1~3020-8 to digital audio signals. When the input terminals have digital inputs, the A/D converters are not provided. The input channel modules 3023-1 to 3023-8 have the configuration shown in FIG. 31 to perform equalizing and amplification for the input digital audio signals and to output the resultant audio signals to the designated bus.

The patch bay 3022 is a circuit unit which connects the input terminals 3020-1 to 3020-8 (A/D converters 3021-1 to 3021-8) to the input channel modules 3023-1 to 3023-8 one by one. In the initial setting, the patch bay 3022 provides a straight connection to connect the input terminals 3020-1 to 3020-8 to the input channel modules 3023-1 to 3023-8, respectively. The connection between the input terminal (audio device) and the input channel module is switched/controlled by the control unit 3010.

Figure 31:
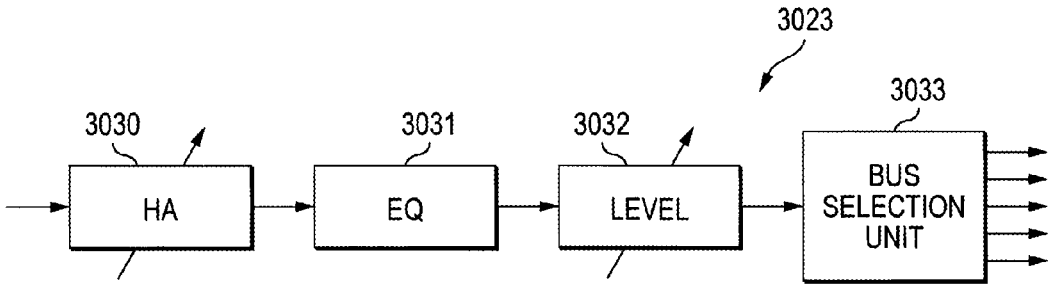
FIG. 31 is a block diagram of an input channel module of the audio mixer according to the fourth embodiment.

As shown in FIG. 31, each of the input channel modules 3023-1 to 3023-8 has a head amplifier 3030, an equalizer 3031, a fader 3032, and a bus selection unit 3033. The bus selection unit 3033 includes PAN control to control the output rate with respect to the L/R stereo bus. The gain of the head amplifier 3030, the equalizing setting of the equalizer 3031, the level setting of the fader 3032, and the selection and setting of the bus selection unit 3033 are input by the manipulations of the manipulation unit 3014 in accordance with the operator, and set in the input channel module 3023 by the control unit 3010.

The bus group 3024 has multiple buses including the stereo bus and multiple mix buses. The term "bus" refers to an input/output buffer in which multiple audio signals can be input and added/mixed.

The output channel processing unit 3025 is a circuit unit which outputs the audio signals of the buses of the bus group 3024 to the outside or inputs the audio signals of the buses to another bus again. The audio mixer selects a bus to which the signal of the input channel module 3023 is input, and selects a bus from which a signal is output to the outside, outputting multiple audio signals in various mixing forms.

The audio device connected to the audio mixer superimposes the identification information thereof on the audio signal as acoustic watermark information, and outputs the resultant audio signal. The audio device is, for example, a musical instrument, a vocalist microphone, or the like.

Although any method may be used to superimpose the identification information, for example, a spread spectrum or the like with little effect on the sense of hearing is used. As the frequency band for superimposition of the watermark information, an inaudible frequency band is preferably used on the sense of hearing, and the frequency band is used which is equal to or lower than the Nyquist frequency of the A/D converter 3021.

Figure 32:
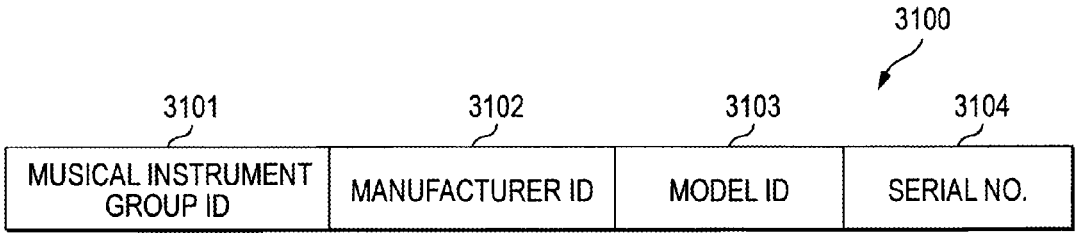
FIG. 32 shows an example of identification information which is superimposed on an audio signal input to the audio mixer according to the fourth embodiment.

FIG. 32 shows an example of identification information which is superimposed on an audio signal. Identification information 3100 includes a device group ID 3101, a manufacturer ID 3102, a model ID 3103, and a serial number 3104. The device group ID 3101 is text information which indicates what kind of audio device the audio source is, and identification information in the widest category. When the device group IDs are identical, it can be determined that the devices belong to the same category. For example, with regard to the device group ID 3101, Mic indicates microphone, Guitar indicates guitar, Drum indicates drum, and the like. The device group ID 3101 is not limited to text information, and may be a number or the like. For example, with regard to the device group ID, 001 indicates a microphone, 002 indicates guitar, and the like.

The manufacturer ID 3102 is information for identifying the manufacturer or distributor of the device. It can be determined that the devices having the same manufacturer ID 3102 have the same manufacturer or distributor. The model ID 3103 includes information regarding the models of each manufacturer. For example, with regard to the model ID 3103, GT-1 indicates Stratocaster of electric guitars, GT-2 indicates Les Paul, and the like. Even when the model IDs 3103 are identical, if the manufacturer IDs 3102 are different, it can be determined that the products are different. The serial number 3104 is information unique to each device (information for identifying the individual). The serial number 3104 may be information for identifying the individual, for example, a MAC address or the like. Even when the serial numbers 3104 are identical, if the manufacturer IDs 3102 or the model IDs 3103 is/are different, it can be determined that the products are different.

The identification information detection unit 3012 extracts and reads the identification information superimposed on the audio signals input from the input terminals 3020-1 to 3020-8, and inputs the identification information to the control unit 3010. The identification information detection unit 3012 reads the identification information of the audio signals between the input terminals 3020 and the patch bay 3022, and also reads the identification information of the audio signals between the patch bay 3022 and the input channel modules 3023. The control unit 3010 compares the identification information extracted between the input terminals 3020 and the patch bay 3022 with the identification information extracted between the patch bay 3022 and the input channel modules 3023 to know the patching pattern (connection information) of the patch bay 3022.

The scene memory 3013 which is the storage unit of the invention, the manipulation unit 3014, and the display units 3015-1 to 3015-8 are connected to the control unit 3010. The manipulation unit 3014 is a functional unit which receives the manipulation of the fader or the like by the operator. The display units 3015-1 to 3015-8 display the audio source names (for example, the device group IDs) of the audio signals input to the input channel modules 3023-1 to 3023-8.

The scene memory 3013 is a memory in which scene data generated by the operator is stored. The term "scene data" refers to data indicating various setting contents of the signal processing unit 3011, the identification information included in the audio signals, and the connection information of the patch bay 3022. Various setting contents of the signal processing unit 3011 include the gain of the head amplifier 3030, the equalizing setting of the equalizer 3031, the level setting of the fader 3032, the bus selection information/send level, and the like in each of the input channel modules 3023-1 to 3023-8.

The operator of the audio mixer 3001 manipulates the manipulation unit 3014 to set the input channel module 3023 and the like of the signal processing unit 3011 variously. If a store manipulation is made by the operator through the manipulation unit 3014, the setting content of the signal processing unit 3011 at that time is stored in the scene memory 3013 as scene data. At this time, the identification information of the audio signals input to the input channel modules 3023-1 to 3023-8 read by the identification information detection unit 3012 is stored as the identification information of the audio sources connected to the input channel modules 3023-1 to 3023-8.

FIG. 33 shows an example where scene data is stored. In FIG. 33, an example is shown where microphones 3051 to 3055 are connected to the input terminals 3020-1 to 3020-5, a guitar 3056 and a guitar 3057 are connected to the input terminals 3020-6 and 3020-7, and a drum (electronic drum) 3058 is connected to the input terminal 3020-8. In FIG. 33, the patching pattern of the patch bay 3022 is a straight connection in the initial setting.

The identification information detection unit 3012 extracts and reads the identification information superimposed on the audio signals input from the input terminals 3020-1 to 3020-8 (referred to as input CH1 to CH8), and inputs the identification information to the control unit 3010. (Mic, YAMAHA, MC-1, 100) are extracted from the audio signal of the input CH1 as (device group ID, manufacturer ID, model ID, serial number). (Mic, YAMAHA, MC-1, 101) are extracted from the audio signal of the input CH2. (Mic, YAMAHA, MC-2, 100) are extracted from the audio signal of the input CH3. (Mic, YAMAHA, MC-3, 200) are extracted from the audio signal of the input CH4. (Mic, B Company, MM-1, 100) are extracted from the audio signal of the input CH5. (Guitar, YAMAHA, GT-1, 100) are extracted from the audio signal of the input CH6. (Guitar, YAMAHA, GT-2, 200) are extracted from the audio signal of the input CH7. (Drum, YAMAHA, DR-1, 500) are extracted from the audio signal of the input CH8.

If the store manipulation is made by the operator through the manipulation unit 3014, the control unit 3010 stores the extracted identification information in the scene memory 3013 in association with the input channel modules 3023-1 to 3023-8 (referred to as module CH1 to CH8). The signal processing parameters of the input channel modules at that time are also stored. The connection information of the patch bay 3022 is also stored in the scene memory 3013.

Meanwhile, if the read manipulation is made by the operator through the manipulation unit 3014, the control unit 3010 reads scene data from the scene memory 3013, and performs setting of the signal processing unit 3011. Multiple (for example, 300) scene data can be stored in the scene memory 3013, and at the time of reading, the operator may designate the scene number.

The signal processing unit 3011 sets the signal processing parameters, such as the gain of the head amplifier 3030, the setting of the equalizer 3031, the level setting of the fader 3032, and the bus selection information/send level, in each of the input channel modules 3023-1 to 3023-8, in accordance with scene data.

The control unit 3010 receives the identification information read by the identification information detection unit 3012 from the audio signals input from the input terminals 3020-1 to 3020-8, compares the identification information with the identification information associated with the module CH1 to CH8 in scene data, and sets the patching pattern of the patch bay 3022. First, the control unit 3010 sets the patching pattern such that the channels whose identification information completely coincides with each other are connected to each other. Thereafter, the control unit 3010 retrieves the channels whose device group IDs 3101, manufacturer IDs 3102, and model IDs 3103 coincide with each other, and sets the patching pattern. The channels whose device group IDs 3101 and manufacturer IDs 3102 coincide with each other are retrieved, and the patching pattern is set. Finally, the channels whose device group IDs 3101 only coincide with each other are retrieved, and the patching pattern is set.

Thus, even when the devices connected to the input terminals 3020-1 to 3020-8 are replaced at the time of storage and reading of scene data, the audio signal of the same device as that at the time of storage can be input to the same input channel module 3023, and the setting can be easily restored with no confirmation of the connection state by the operator. Further, even when the device breaks down, and an alternative audio device is connected to another channel, that is, a device different from that at the time of storage of scene data is connected, the channels whose identification information is partially identical are connected, such that the setting can be restored as the alternative device being connected.

Hereinafter, restoration when an alternative device is connected will be specifically described. FIGS. 34 to 38 show the relationship between the connection form of the audio devices, the patching pattern of the patch bay 3022, and identification information at the time of reading of scene data.

FIG. 34 shows an example where a microphone 3061 is connected to the input CH1, a microphone 3062 to the input CH2, a microphone 3051 to the input CH3, a guitar 3056 to the input CH4, a microphone 3063 to the input CH5, a microphone 3064 to the input CH6, and a drum 5308 to the input CH8. Nothing is connected to the input CH7.

The identification information detection unit 3012 extracts and reads the identification information superimposed on the audio signals input from the input CH1 to CH8, and inputs the identification information to the control unit 3010. (Mic, YAMAHA, MC-2, 200) are extracted from the audio signal of the input CH1 as (device group ID, manufacturer ID, model ID, serial number). (Mic, YAMAHA, MC-1, 102) are extracted from the audio signal of the input CH2. (Mic, YAMAHA, MC-1, 100) are extracted from the audio signal of the input CH3. (Guitar, YAMAHA, GT-1, 100) are extracted from the audio signal of the input CH4. (Mic, YAMAHA, MC-4, 200) are extracted from the audio signal of the input CH5. (Mic, C Company, MI-10, 300) are extracted from the audio signal of the input CH6. No identification information is extracted from the audio signal of the input CH7. (Drum, YAMAHA, DR-1, 500) are extracted from the audio signal of the input CH8.

If the read manipulation is made by the operator through the manipulation unit 3014, the control unit 3010 reads scene data from the scene memory 3013, and performs comparison of the identification information. The comparison of the identification information is performed, for example, in ascending order of the channel numbers. First, as shown in FIG. 34, the control unit 3010 sets the patching pattern such that the channels whose identification information is completely identical are connected to each other. That is, first, the identification information extracted from the audio signal of the input CH3 completely coincide with the module CH1 of scene data, thus the input terminal 3020-3 and the input channel module 3023-1 are connected to each other. Next, the identification information extracted from the audio signal of the input CH4 completely coincides with the module CH6 of scene data, thus the input terminal 3020-4 and the input channel module 3023-6 are connected to each other. Further, the identification information extracted from the audio signal of the input CH8 completely coincides with the module CH8 of scene data, the input terminal 3020-8 and the input channel module 3023-8 are connected to each other. Therefore, the audio signal of the same device as that at the time of storage can be input to the same input channel module 3023.

Next, as shown in FIG. 35, the control unit 3010 retrieves the channels whose device group IDs 3101, manufacturer IDs 3102, and model IDs 3103, excluding the serial number 3104, coincide with each other, and sets the patching pattern. That is, the device group 101, the manufacturer ID 3102, and the model ID 3103 of the identification information extracted from the audio signal of the input CH1 coincide with the module CH3 of scene data, thus the input terminal 3020-1 and the input channel module 3023-3 are connected to each other. Further, the device group ID 3101, the manufacturer ID 3102, and the model ID 3103 of the identification information extracted from the audio signal of the input CH2 coincide with the module CH2 of scene data, thus the input terminal 3020-2 and the input channel module 3023-2 are connected to each other. In this case, although the serial numbers are different, other IDs are identical, thus the setting can be restored as the alternative device of the same model by the same manufacturer being connected.

Next, as shown in FIG. 36, the control unit 3010 retrieves the channels whose device group IDs 3101 and manufacturer IDs 3102, excluding the model ID 3103, coincide with each other, and sets the patching pattern. That is, the device group ID 3101 and the manufacturer ID 3102 of the identification information extracted from the audio signal of the input CH5 coincide with the module CH4 of scene data, thus the input terminal 3020-5 and the input channel module 3023-4 are connected to each other. In this case, although the models are different, the type and manufacturer of the device are identical, thus the setting can be restored as the alternative device being connected.

As shown in FIG. 37, the control unit 3010 retrieves the channels whose device group IDs 3101 excluding the manufacturer ID 3102, coincide with each other, and sets the patching pattern. That is, the device group ID 3101 of the identification information extracted from the audio signal of the input CH6 coincides with the module CH5 of scene data, thus the input terminal 3020-6 and the input channel module 3023-5 are connected to each other. In this case, although the models and the manufacturers are different, the type of device is identical, thus the setting can be restored as the alternative device being connected.

Finally, as shown in FIG. 38, the control unit 3010 maintains the patching pattern as it is with respect to the input CH all of whose IDs are not identical. That is, no identification information is extracted from the input CH7, and there are no channels whose IDs coincide with each other. Thus, it is estimated to be a connection error, and the input terminal 3020-7 and the input channel module 3023-7 are still connected to each other. When the connection information is also stored in scene data and when, in the initial setting, the connection to a different input channel module 3023 has been provided, the connection to one input channel module 3023 of the remaining free channels may be provided. At this time, a message indicating that channels which coincide with each other are not found may be displayed on the display unit 3015, and the operator may select a channel for connection manually. In the connection operations shown in FIGS. 34 to 37, an indication that the connection is switched may be displayed on the display unit 3015.

In the retrieval operations shown in FIGS. 34 to 37, when there are multiple alternative channels, the connection to an alternative channel which is the same as the channel of the input terminal may be preferentially provided, or the connection to an alternative channel with a small number may be preferentially provided. Further, an indication that there are multiple candidates may be displayed on the display unit 3015, and the operator may select one of the candidates.

After the connection shown in FIG. 38 is made, scene data of the scene memory 3013 may be rewritten in accordance with the relevant connection aspect. In this case, an indication that the scene memory will be rewritten may be displayed on the display unit 3015, and the operator may select rewriting of the scene memory.

Although in the above-described example, an example has been described where, if the read manipulation is made by the operator through the manipulation unit 3014, the control unit 3010 reads scene data, for example, the current setting of the mixer when the audio mixer is activated or the device connection is changed and the identification information of the connected terminal may be compared with each other, and the patch bay may be switched.

Although in the above-described embodiment, the configuration has been made such that the identification information includes the device group ID 3101, the manufacturer ID 3102, the model ID 3103, and the serial number 3104, all of which are stored in the scene memory 3013, an aspect may be made such that the identification information may include only the serial number 3104, and the scene memory 3013 may store information indicating the correspondence relationship between the serial number 3104 and the module CH. In this case, the serial number 3104 is a completely unique ID so as not to overlap between the audio devices. In this case, a database which indicates the correspondence relationship between the serial number 3104 and different information (device group ID 3101, manufacturer ID 3102, model ID 3103, and serial number 3104) is prepared in an external server. The audio mixer accesses the server through a network, transmits the serial number 3104 included in the identification information to acquire the device group ID 3101, the manufacturer ID 3102, the model ID 3103, and the serial number 3104, and performs the above-described retrieval operation.

Although in this example, an example has been described where, as the rule for selection of an alternative device, an alternative device is searched on the basis of the priority of the device group ID, the manufacturer ID, the model ID, and the serial number, the manufacturer ID may be excluded from the priority, or the selection may be carried out while the device group ID is divided into multiple steps, such as a large classification including microphone, guitar, and the like, or a small classification including capacitor microphone, dynamic microphone, and the like. Further, the operator may change the rule of priority regarding retrieval of an alternative device.

Although in the above-described embodiment, the patching pattern is controlled such that the audio devices connected to the input channel modules 3023-1 to 3023-8 coincide with the contents of scene data, the patch bay 3022 may replace the settings of the input channel modules 3023-1 to 3023-8 so as to coincide with the default audio devices connected to the input terminals 3020-1 to 3020-8 as the default straight connection.

That is, when scene data is stored in accordance with the setting of FIG. 33, and when the connection form of the audio devices is as shown in FIGS. 34 to 38 at the time of reading of scene data, as shown in FIG. 39, the setting of the input channel module 3023-1 and the setting of the input channel module 3023-3 are replaced. Further, the setting of the input channel module 3023-4 is set in the input channel module 3023-6, the setting of the input channel module 3023-5 is set in the input channel module 3023-4, and the setting of the input channel module 3023-6 is set in the input channel module 3023-5.

Thus, when the patching pattern of the patch bay 3022 is complicated, the default straight connection can be returned. Further, even in the case of an audio mixer with no patch bay 3022, the association between the audio sources and the settings of the input channel modules can be automatically carried out.

Although in the above-described embodiment, the audio mixer has been described as an example, the application of the invention is not limited to the audio mixer. The invention may be applied to a PA system in which multiple devices, such as an audio mixer, a patch bay, an effects unit, and an input connector box, are combined.

The audio mixer may remove the identification information from the audio signals.

Fifth Embodiment

First, the schematic configuration and operation of an audio signal processing system according to a fifth embodiment of the invention will be described. An audio signal processing system includes an audio signal output device, an audio signal processing device, and a server device. The audio signal output device superimposes the identification information thereof on the audio signal as sound watermark information, and outputs the audio signal to the audio signal processing device. If the audio signal is input, the audio signal processing device extracts the identification information (sound watermark information) superimposed on the signal, and transmits the identification information to the server device. The server device registers setting information of adjustment parameters of the audio signal in advance in accordance with the identification information. If the identification information is received, the server device reads the setting information corresponding to the identification information, and transmits the setting information to the audio signal processing device. The audio signal processing device sets the adjustment parameters (volume, frequency characteristic, effect, and the like) of the audio signal on the basis of the received setting information. As described above, in the audio signal processing system, even when the audio signal output device is used by any audio signal processing device, the setting information of the adjustment parameters can be read from the server device. Therefore, the user can use the audio signal processing device casually in any facility without individually setting the adjustment parameters.

Next, the specific configuration and operation of the audio signal processing system will be described. In the following description, a karaoke system which is an example of the audio signal processing system will be described.

Figure 40:
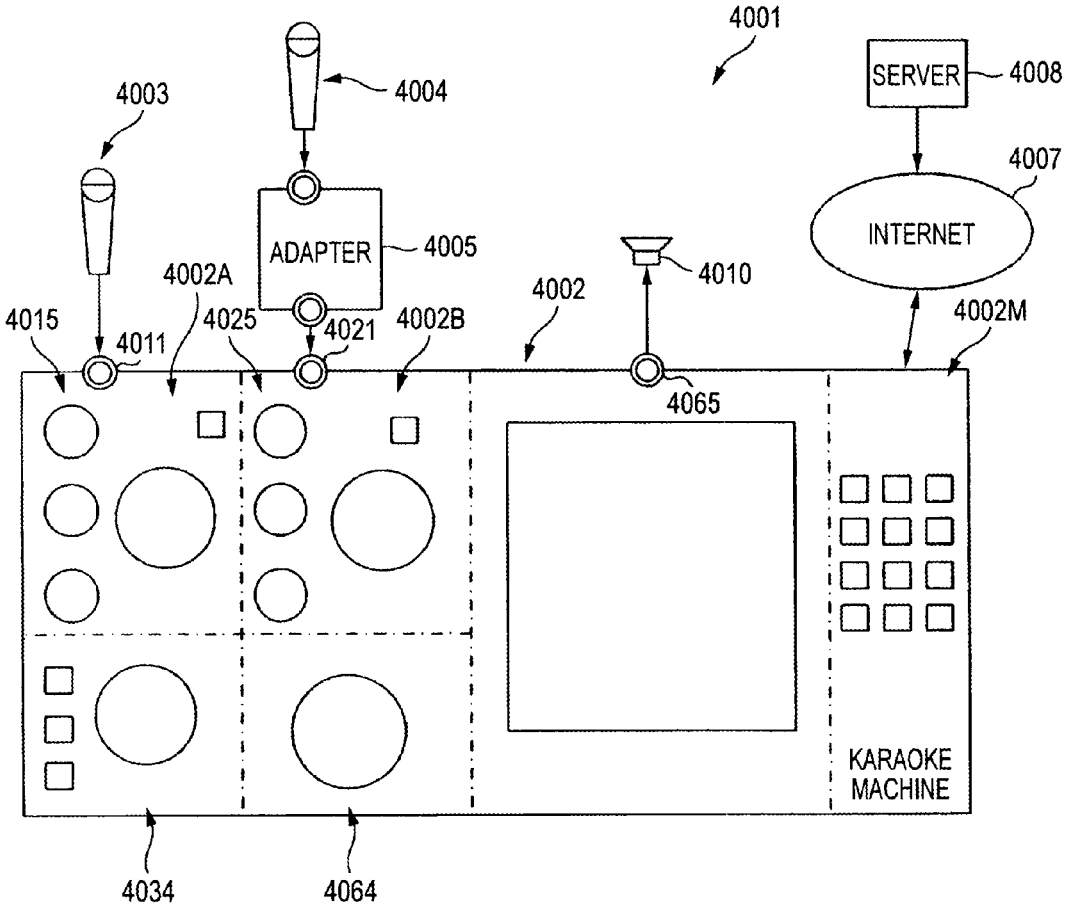
FIG. 40 is a block diagram showing the schematic configuration of a karaoke system according to a fifth embodiment of the invention.

FIG. 40 is a block diagram showing the schematic configuration of a karaoke system according to the fifth embodiment of the invention. In the following description, an example will be described where sound collected by a microphone which is an example of the audio signal output device is amplified by a karaoke machine which is an example of the audio signal processing device.

A karaoke system 4001 includes a karaoke machine 4002 serving as the audio signal processing device, a microphone 4003 serving as the audio signal output device, an adapter 4005 to which another microphone 4004 is connected, and a server (server device) 4008. The microphone 4003 is connected to an input terminal 4011 of the karaoke machine 4002, and the microphone 4004 is connected to an input terminal 4021 through the adapter 4005. A speaker 4010 is connected to an output terminal 4065 of the karaoke machine 4002. The karaoke machine 4002 is connected to the server 4008 through Internet 4007. The karaoke machine 4002 includes a manipulation unit 4015, a manipulation unit 4025, a manipulation unit 4035, a manipulation unit 4064 which have switches or knobs to adjust the levels, such as volume, frequency characteristic, and effect.

Figure 41:
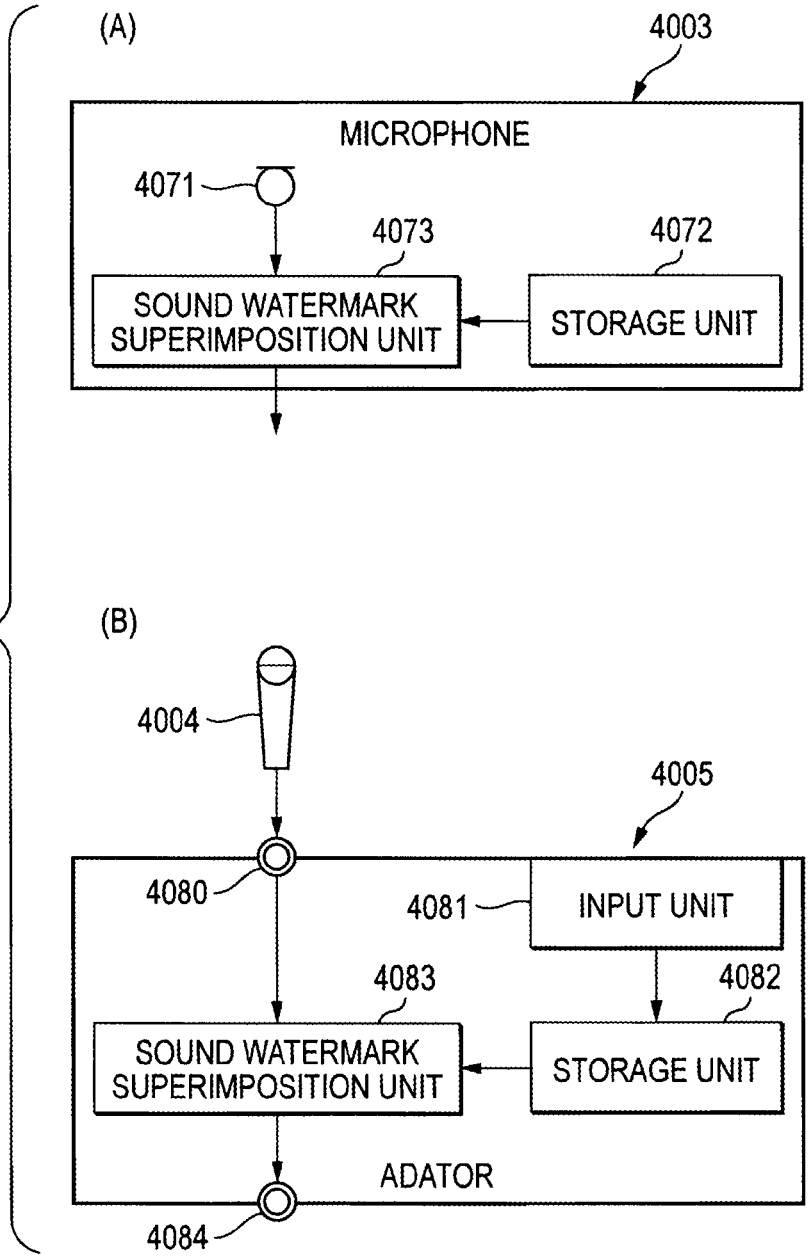
FIG. 41 is a block diagram showing the detailed configuration of a microphone and an adapter according to the fifth embodiment.

Next, the details of the respective units of the karaoke system will be described. First, the microphone 4003, the microphone 4004, and the adapter 4005 will be described. FIG. 41 is a block diagram showing the detailed configuration of the microphone and the adapter.

As shown by (A) in FIG. 41, the microphone 4003 includes a sound collection element 4071, a storage unit (identification information storage means) 4072, and a sound watermark superimposition unit (identification information superimposition means) 4073. The storage unit 4072 stores identification information. The storage unit 4072 stores the model name (model number) and manufacturing number (serial number) of the microphone as the identification information of the microphone 4003, that is, information for discriminating the audio signal output devices.

The identification information stored in the storage unit 4072 is not limited to the model name and manufacturing number of the microphone 4003, and may include other information, such as the manufacturer name or the date of manufacture. Thus, information regarding the microphone increases, thus the microphone 4003 can be identified more simply and reliably.

With respect to the microphone 4003, the identification information stored in the storage unit 4072 may be updated/changed. In this case, when the setting information of the adjustment parameters are registered in the server 4008, or the like, the serial number may be allocated from the server 4008 and stored in the storage unit 4072.

The sound watermark superimposition unit 4073 reads the identification information from the storage unit 4072 to generate a sound watermark, and superimposes the sound watermark on the sound signal collected by the sound collection element 4071. Then, the sound watermark superimposition unit 4073 outputs the sound signal (audio signal) with the sound watermark superimposed through the output terminal (not shown).

The sound watermarks generated by the sound watermark superimposition unit 4073 and a sound watermark superimposition unit 4083 of the adapter 4005 described below are not limited to the sound watermark used in the known technique, and information may be superimposed on the sound signal using an inaudible range. As the identification information, text information may be used which represents the model name (model number), the manufacturing number, or the like in detail. Further, information may be simply represented by numerals, symbols, or the like.

As shown by (B) in FIG. 41, the adapter 4005 is a device which superimposes identification information on an audio signal output from the general microphone 4004 having no sound watermark superimposition unit 4073, like the microphone 4003. The adapter 4005 includes an input terminal 4080, an input unit 4081, a storage unit (identification information storage means) 4082, a sound watermark superimposition unit (identification information superimposition means) 4083, and an output terminal 4084. The microphone 4004 is connected to the input terminal 4080, to which an audio signal (sound signal) from the microphone 4004 is input. The input unit 4081 allows the user to input the identification information of the microphone 4004 serving as the audio signal output device, such as the model name (model number) or the manufacturing number of the microphone 4004. The input unit 4081 may be configured such that the identification information is input through a manipulation key (not shown), or such that a connection unit (not shown) is provided to which an input device, such as a personal computer, is connected, and the connection is connected to the input device to input the identification information. The storage unit 4082 stores the identification information input from the input unit 4081. The sound watermark superimposition unit 4083 reads the identification information from the storage unit 4082 to generate a sound watermark, and superimposes the sound watermark on the sound signal output from the microphone 4004. Then, the sound watermark superimposition unit 4083 outputs the audio signal (sound signal) with the sound watermark superimposed to the input terminal 40021 of the karaoke machine 4002 through the output terminal 3084.

Figure 42:
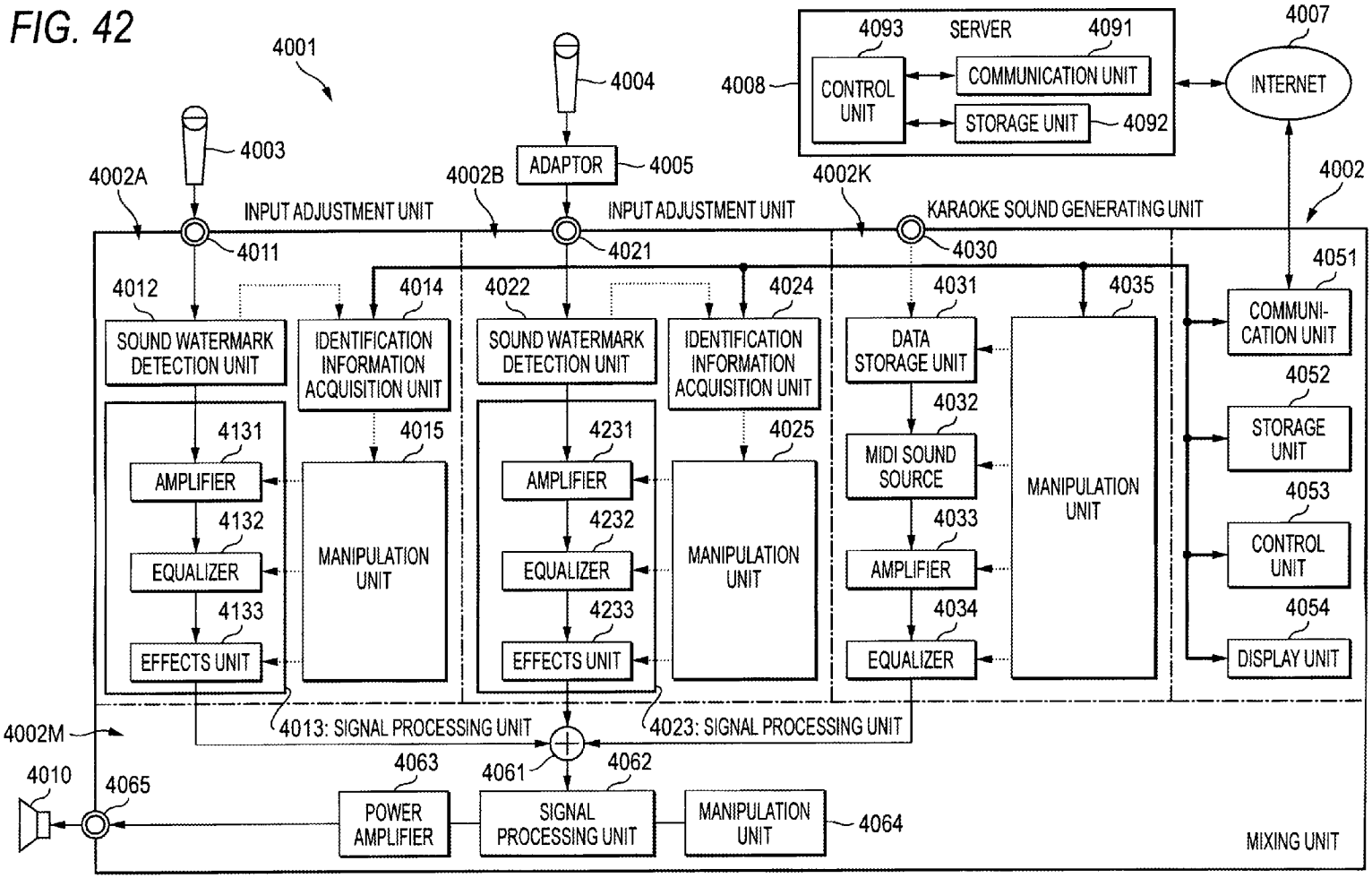
FIG. 42 is a block diagram showing the detailed configuration of the karaoke machine according to the fifth embodiment.

Next, the details of the karaoke machine 4002 will be described. FIG. 42 is a block diagram showing the detailed configuration of the karaoke machine.

The karaoke machine 4002 includes an input adjustment unit 4002A, an input adjustment unit 4002B, a karaoke sound generating unit 4002K, and a mixing unit 4002M. The input adjustment unit 4002A and the input adjustment unit 4002B have the same configuration. Although in the following description, the audio signal output devices connected to the input terminals are different, thus different operations will be described, the input adjustment units are configured to perform the same processing and operation.

The input adjustment unit 4002A includes an input terminal (signal input means) 4011, a sound watermark detection unit (extraction means) 4012, a signal processing unit (signal processing means) 4013, an identification information acquisition unit 4014, and a manipulation unit 4015. The signal processing unit 4013 includes an amplifier 4131, an equalizer 4132, and an effects unit 4133.

The input adjustment unit 4002B has the same configuration as the input adjustment unit 4002A, and includes an input terminal (signal input means) 4021, a sound watermark detection unit (extraction means) 4022, a signal processing unit (signal processing means) 4023, an identification information acquisition unit 4024, and a manipulation unit 4025. The signal processing unit 4023 includes an amplifier 4231, an equalizer 4232, and an effects unit 4233.

The karaoke sound generating unit 4002K includes a data storage unit 4031, a MIDI sound source 4032, an amplifier 4033, an equalizer 4034, and a manipulation unit 4035.

The mixing unit 4002M includes an adder 4061, a signal processing unit 4062, a power amplifier 4063, a manipulation unit 4064, and an output terminal 4065.

The identification information acquisition unit 4014 of the input adjustment unit 4002A and the identification information acquisition unit 4024 of the input adjustment unit 4002B communicate with a communication unit (first communication means) 4051, a storage unit 4052, a control unit 4053, and a display unit 4054.

The microphone 4003 is connected to the input terminal 4011 in the input adjustment unit 4002A.

If the audio signal output from the microphone 4003 is input through the input terminal 4011, the sound watermark detection unit 4012 of the input adjustment unit 4002A extracts the sound watermark from the audio signal, and outputs the identification information included in the sound watermark to the identification information acquisition unit 4014. The sound watermark detection unit 4012 outputs the audio signal to the amplifier 4131 of the signal processing unit 4013.

If the identification information is input from the sound watermark detection unit 4012, the identification information acquisition unit 4014 acquires the setting information corresponding to the identification information from the communication unit 4051. Then, the identification information acquisition unit 4014 outputs the acquired setting information to the manipulation unit 4015 to adjust the amplifier 4131, the equalizer 4132, and the effects unit 4133 to the settings suitable for the microphone 4003.

The manipulation unit 4015 includes volumes or switches shown in FIG. 40 for adjusting the respective units of the signal processing unit 4013, and a mechanism unit (motor or solenoid (not shown)) for changing the settings of the volume or switches. If the setting information from the identification information acquisition unit 4014 is input, the manipulation unit 4015 adjusts the amplifier 4131, the equalizer 4132, and the effects unit 4133 in accordance with the setting information. Of course, similarly to the usual manipulation unit, the manipulation unit 4015 may also be operated manually.

The amplifier 4131 adjusts the gain (volume) of the audio signal in accordance with the setting. The gain of the amplifier 4131 is narrowed to a predetermined value (for example, a value of 12 dB to in the initial state.

The equalizer 4132 corrects the frequency characteristic of the audio signal in accordance with the setting and outputs the audio signal to the adder 4061. The equalizer 4132 is set with the flat characteristic in the initial state.

The effects unit 4133 performs effect processing, such as echo or chorus, for the audio signal.

The respective units of the input adjustment unit 4002B are operated in the same manner as the respective units of the input adjustment unit 4002A.

In the karaoke sound generating unit 4002K, the data storage unit 4031 stores data of karaoke music. The manipulation unit 4035 manipulates and controls the data storage unit 4031, the MIDI sound source 4032, the amplifier 4033, and the equalizer 4034. That is, the manipulation unit 4035 can select karaoke music from the data storage unit 4031 or can control the MIDI sound source 4032 to change the pitch of karaoke music. The manipulation unit 4035 can control the amplifier 4033 to adjust the volume (gain) of karaoke music or can control the equalizer 4034 to correct the frequency characteristic of the audio signal.

The data storage unit 4031 can acquire data of karaoke music from an external device through a terminal 4030.

In the mixing unit 4002M, the adder 4061 adds (mixes) the audio signals output from the signal processing unit 4013, the signal processing unit 4023, and the equalizer 4031, and outputs the resultant audio signal to the signal processing unit 4062.

The signal processing unit 4062 includes a fader for adjusting the level of the audio signal output from the output terminal 4065, or an effects unit for adding an effect to the audio signal, and is set in accordance with the manipulation through the manipulation unit 4064.

The audio signal output from the signal processing unit 4062 is output to the power amplifier 4063. The power amplifier 4063 amplifies the audio signal, and causes audio to be emitted from the speaker 4009 at volume (gain) set by the manipulation unit 4064.

The communication unit 4051 transmits the identification information output from the identification information acquisition unit 4014 to the server 4008 through Internet 4007, acquires the setting information corresponding to the identification information from the server 4008, and outputs the setting information to the identification information acquisition unit 4014. The communication unit 4051 outputs the identification information to the storage unit 4052, then the identification information is stored in the storage unit 4052.

The control unit 4053 controls the respective units of the karaoke machine 4002. The control unit 4053 causes the display unit 4054 to display the contents according to the signals output from the identification information acquisition unit 4014 and the identification information acquisition unit 4024.

The server 4008 includes a communication unit (second communication means) 4091, a storage unit (setting information storage means) 4092, and a control unit 4093. The storage unit 4092 stores the identification information of the microphone, such as the model name (model number) or the manufacturing number of the audio signal output device, such as the microphone 4003 or the microphone 4004, and the setting information of the adjustment parameters of the audio signal corresponding to the identification information in association with each other. The storage unit 4092 also stores default setting information with respect to the adjustment parameters of the audio signal. The default setting information sets the values of the adjustment parameters of the typical audio signal for each model of the microphone.

The server 4008 stores the identification information and the setting information in the storage unit 4092 in association with each other in a table format, as shown in FIG. 43. FIG. 43 is a table showing the relationship between the identification information and the setting information. The storage unit 4092 of the server 4008 stores the manufacturer name, model name (model number), and the manufacturing number (serial number) as the identification information. The storage unit 4092 also stores volume, frequency characteristic, and presence/absence of effect as the setting information.

For example, in the case of an A company's microphone with the model name M-1 and the manufacturing number 0032, volume (gain) is 4, effect (for example, echo) is ON, and the setting of the three-band equalizer is 3, 4, and 1.

Next, the input adjustment unit 4002B will be described. The microphone 4004 is connected to the input terminal (signal input means) 4021 through the adapter 4005. The microphone 4004 is a general microphone, and includes no configuration for superimposition of a sound watermark. For this reason, in order to connect the microphone 4004 to the karaoke machine 4002 to automatically set the gain, effect, or the like, the adapter 4005 which can superimpose a sound watermark on a sound signal is connected between the microphone 4004 and the karaoke machine 4002.

If the audio signal output from the adapter 4005 is input through the input terminal 4021, the sound watermark detection unit (extraction means) 4022 of the input adjustment unit 4002B extracts the sound watermark from the audio signal, and outputs the identification information included in the sound watermark to the identification information acquisition unit 4024. The sound watermark detection unit 4022 also outputs the audio signal to the amplifier 4231 of the signal processing unit 4023.

The identification information acquisition unit 4024 performs the same processing and operation as the identification information acquisition unit 4014. The signal processing unit 4023 and the manipulation unit 4025 respectively perform the same processing and operation as the signal processing unit 4013 and the manipulation unit 4015. The signal processing unit 4023 outputs the audio signal adjusted by the respective units to the adder 4061.

The identification information acquisition unit 4014 or the identification information acquisition unit 4024 may be configured to output, to the control unit 4053, a signal indicating that no audio signal output device is connected to the input terminal 4011 or the input terminal 4021. If the signal is received, the control unit 4053 causes the display unit 4054 to display the indication that no audio signal output device is connected to the input terminal 4011 or the input terminal 4021. Thus, although the audio signal output device is connected to the input terminal 4011 or the input terminal 4021, when defective connection occurs or the like, it is possible to remind the user of trouble.

Figure 44:
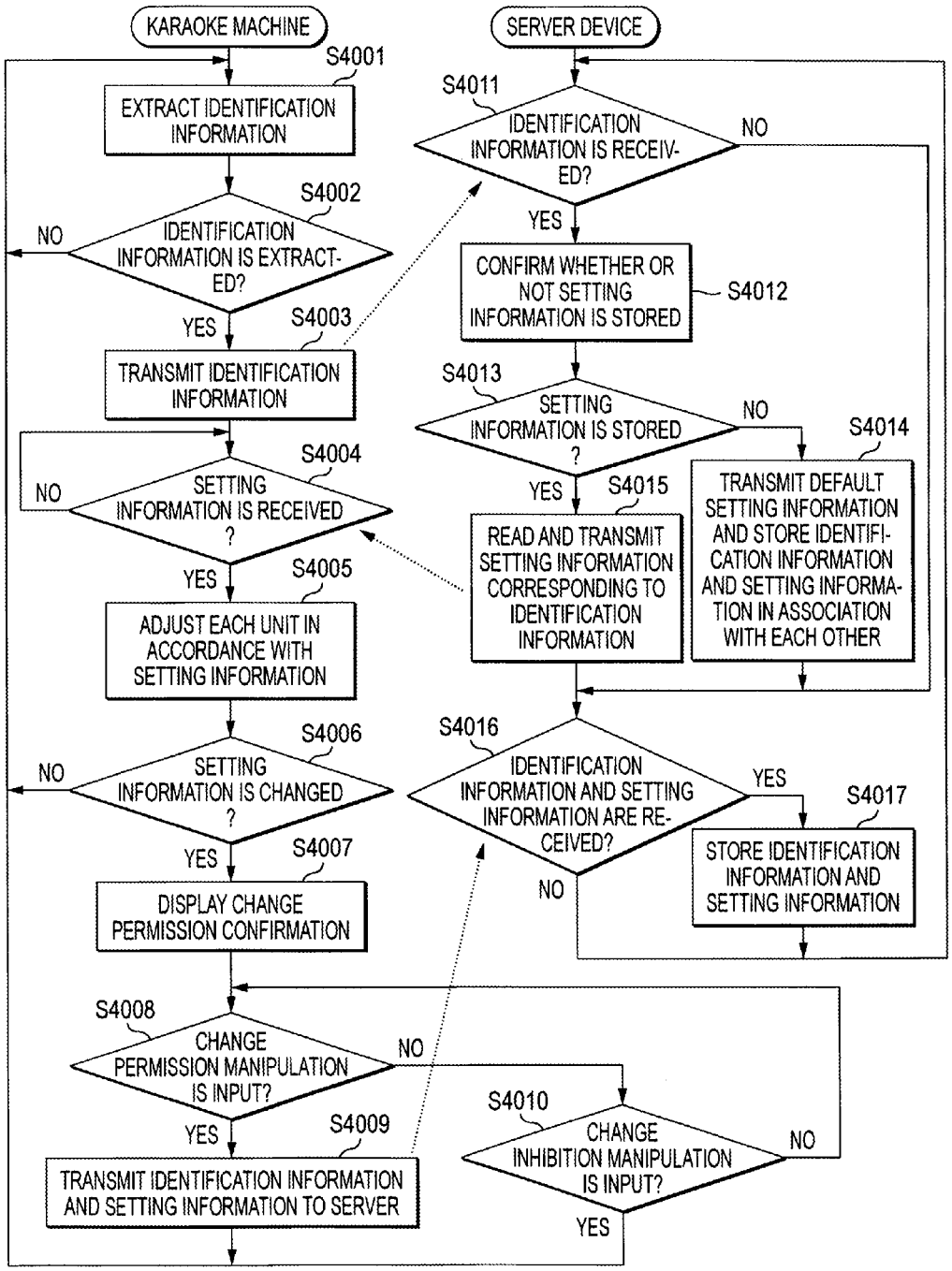
FIG. 44 is a flowchart illustrating the processing operation of the karaoke system according to the fifth embodiment.

Next, the processing operation of the karaoke system 4001 will be described. FIG. 44 is a flowchart illustrating the processing operation of the karaoke system.

In the karaoke system 4001, when the microphone 4003 is initially used, the setting information corresponding to the identification information of the microphone is not registered in the server 4008. In this case, the control unit 4053 of the karaoke machine 4002 controls the respective units as follows to transmit the identification information to the server 4008. That is, if the audio signal is input from the microphone 4003, the sound watermark detection unit 4012 carries out processing for extracting the identification information of the microphone 4003 (s4001). When the identification information of the microphone 4003 cannot be extracted from the audio signal (s4002: N), the sound watermark detection unit 4012 carries out processing of Step s4001. Meanwhile, when the identification information of the microphone 4003 can be extracted from the audio signal (s4002: Y), the sound watermark detection unit 4012 outputs the identification information to the identification information acquisition unit 4014. The identification information passes through the identification information acquisition unit 4014 and the communication unit 4051, and is then transmitted to the server 4008 through Internet 4007 (s4003).

If the identification information of the microphone 4003 is received (s4011: Y), the control unit 4093 of the server 4008 confirms whether or not the storage unit 4092 stores the setting information (s4012). When the storage unit 4092 does not store (register) the setting information of the microphone 4003 (s4013: N), the control unit 4093 reads the default setting information from the storage unit 4092 and transmits the default setting information. The control unit 4093 also stores the identification information of the microphone 4003 and the default setting information in association with each other (s4014).

When the storage unit 4092 stores (registers) the setting information of the microphone 4003 (s4013: Y), the control unit 4093 reads the setting information corresponding to the identification information from the storage unit 4092 and transmits the setting information (s4015).

If the communication unit 4051 receives the default setting information or the setting information corresponding to the identification information (s4004: Y), the karaoke machine 4002 transmits the setting information to the manipulation unit 4015 through the identification information acquisition unit 4014. If the default setting information is input, the manipulation unit 4015 automatically adjusts the amplifier 4131, the equalizer 4132, and the effects unit 4133 in accordance with the setting information (adjustment parameters) (s4005).

When the user is dissatisfied with automatic setting, the user manipulates the manipulation unit 4015, the manipulation unit 4025, the manipulation unit 4035, or the manipulation unit 4064 to change the setting of volume, frequency characteristic, or effect.

If one of the manipulation unit 4015, the manipulation unit 4025, the manipulation unit 4035, and the manipulation unit 4064 is operated, and it is detected that the setting information of the adjustment parameters of the audio signal is changed (s4006: Y), the control unit 4053 causes the display unit 4054 to display the content for confirmation whether or not it is desirable to change the setting information registered in the server (s4007). If a manipulation indicating that it is desirable to change the setting information is received (s4008: Y), the control unit 4053 causes the communication unit 4051 to transmit the identification information of the microphone 4003 and the changed setting information to the server 4008 (s4009).

If a manipulation indicating that the change of the setting information is inhibited is received (s4010: N), the control unit 4053 carries out processing of Step s4001 without communicating with the server 4008.

If the identification information of the microphone 4003 and the setting information are received (s4011: N, s4016: Y), the control unit 4093 of the server 4008 discards the setting information stored in the storage unit 4092, and causes the storage unit 4092 to store the received identification information and setting information in association with each other (s4017). Then, processing of Step s4011 is carried out.

In Step s4001, when no audio signal is input, the control unit 4053 of the karaoke machine 4002 carries out Step s4006. When there is no change in the setting information, Step s4001 is carried out. That is, the karaoke machine 4002 is in a standby state until an audio signal is input or the setting information is changed.

In Step s4011, when the identification information is not received, the control unit 4093 of the server device carries out Step s4016. When the identification information and the setting information are not received, Step s4011 is carried out. That is, the server device is in a standby state until information is received from the karaoke machine 4002.

As described above, the karaoke machine 4002 can set the setting information according to information included in the identification information in the signal processing unit 4013 or the signal processing unit 4023, such that the optimum setting is made automatically just by connecting the device. For this reason, the user does not have to conduct the setting manually, and even a beginner can enjoy karaoke casually. Further, even in the case of a heavy user who carries his/her own personal microphone (my microphone), since the adjustment parameters, such as volume, frequency characteristic, and effect, are automatically set, regardless of karaoke shops, the user can concentrate on singing without concerning the setting of the adjustment parameters.

Although in the above description, an example has been described where the adjustment parameters, such as volume, frequency characteristic, and effect, are set and changed on the basis of the setting information, the invention is not limited thereto. For example, the settings of volume of BGM (karaoke music), pitch of music, frequency characteristic, and the like, may be stored in the server 4008. Thus, the manipulation unit 4035 of the karaoke machine 4002 automatically adjusts the amplifier 4033 or the equalizer 4034 to set volume or pitch of karaoke music to a desired value. Therefore, even a user who has a loud (quiet) voice can sing casually without adjusting the pitch every time, and BGM can be constantly reproduced with preferred frequency characteristics.

An AV amplifier or a personal computer may be used as the audio signal processing device, a musical instrument, such as guitar, or an audio device, such as a DVD player or a tuner, may be used as the audio signal output device.

In the audio signal processing system of this embodiment, the audio signal output device superimposes the identification information thereof on the audio signal, and outputs the audio signal to the audio signal processing device. If the audio signal is input, the audio signal processing device extracts the identification information superimposed on the signal, and transmits the identification information to the server device. The server device stores the setting information of the adjustment parameters of the audio signal according to the identification information in advance. If the identification information is received, the server device reads the setting information corresponding to the identification information, and transmits the setting information to the audio signal processing device. The audio signal processing device sets the adjustment parameters of the audio signal on the basis of the received setting information. The adjustment parameters of the audio signal refer to volume, frequency characteristic, effect, and the like. As described above, in the audio signal processing system, the setting information of the adjustment parameters can be read from the server device, regardless of the audio signal processing device which uses the audio signal output device. Therefore, the user does not have to individually set the adjustment parameters, and can casually use the audio signal processing device in any facility.

The server device also stores the default setting information in the setting information storage means. When the setting information corresponding to the identification information of the audio signal output device is not stored, the server device transmits the default setting information to the audio signal processing device. Therefore, if the default setting information is set to a general value, in the audio signal processing system, the audio signal output device can be used with no problem even when the audio signal output device is used for the first time.

If the adjustment parameters of the audio signal are set or changed through the manipulation means, the audio signal processing device transmits the setting information of the adjustment parameters and the identification information to the server device. If the setting information of the adjustment parameters and the identification information are received from the audio signal processing device, the server device stores the setting information and the identification information in the setting information storage means in association with each other. Therefore, when the setting information of the adjustment parameters is changed, the setting information can be stored in the server device. Thus, when the user changes the microphone or purchases a new microphone, the setting information corresponding to the microphone can be registered.

Sixth Embodiment

An audio signal processing device according to the invention can be applied to howling prevention through superimposition of the identification information of the audio devices on the analog audio signal output from an sound emission device, such as a speaker. Hereinafter, an acoustic system according to a sixth embodiment will be described with reference to FIG. 45.

Figure 45:
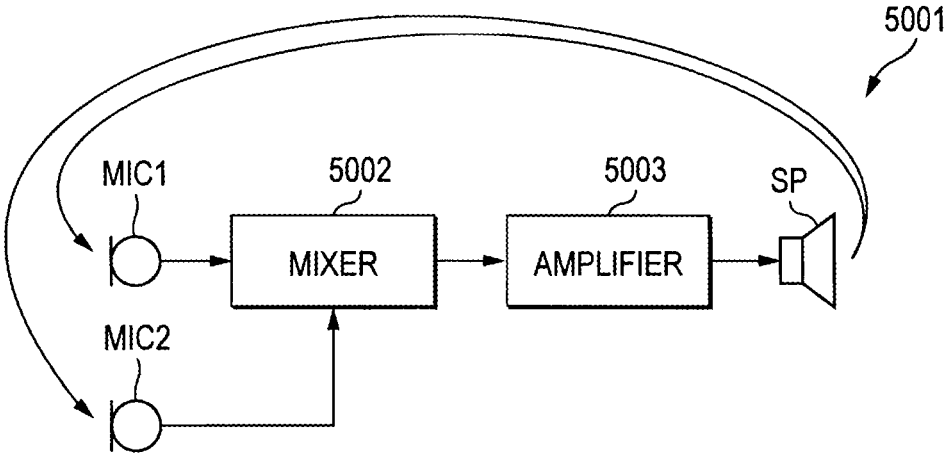
FIG. 45 is an explanatory view of a closed loop which is formed by multiple audio devices according to a sixth embodiment of the invention.

FIG. 45 is an explanatory view of a closed loop which is formed by multiple audio devices. As shown in FIG. 45, an acoustic system 5001 includes multiple audio devices. For example, the acoustic system 5001 includes two microphones MIC1 and MIC2, a mixer 5002, an amplifier 5003, and a speaker SP. The number of microphones constituting the acoustic system 5001 is not limited to two. Hereinafter, in this embodiment, description will be provided for a case where a frequency characteristic is used as an example of a gain characteristic.

The two microphones MIC1 and MIC2 respectively collect sound (uttered sound, sound emitted from the speaker SP, noise, and the like) to generate sound signals, and output the sound signals to the mixer 5002 as sound-collected signals. The mixer 5002 mixes the input sound-collected signals of the respective microphones to generate a mixed sound-collected signal, and outputs the mixed sound-collected signal to the speaker SP through the amplifier 5003. The speaker SP emits sound on the basis of the mixed sound-collected signal. As described above, in the acoustic system 5001, sound emitted from the speaker SP is collected by the microphone MIC1 and the microphone MIC2, and is emitted from the speaker SP through the mixer 5002 and the amplifier 5003, such that a closed loop is formed by these audio devices.

Figure 46:
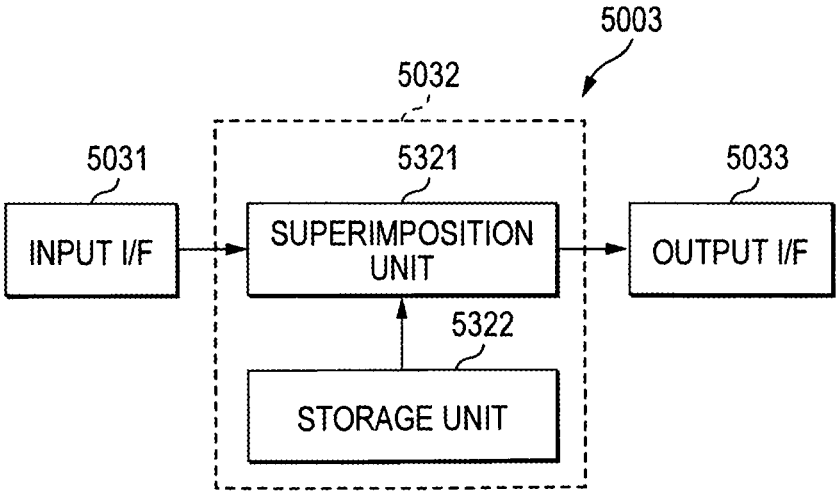
FIG. 46 is a block diagram showing the function and configuration of an amplifier according to the sixth embodiment.
Figure 47:
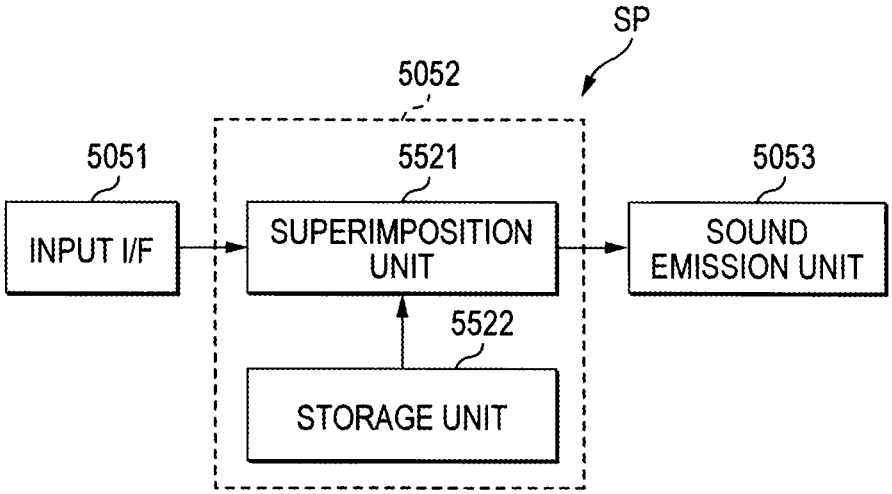
FIG. 47 is a block diagram showing the function and configuration of a speaker according to the sixth embodiment.
Figure 48:
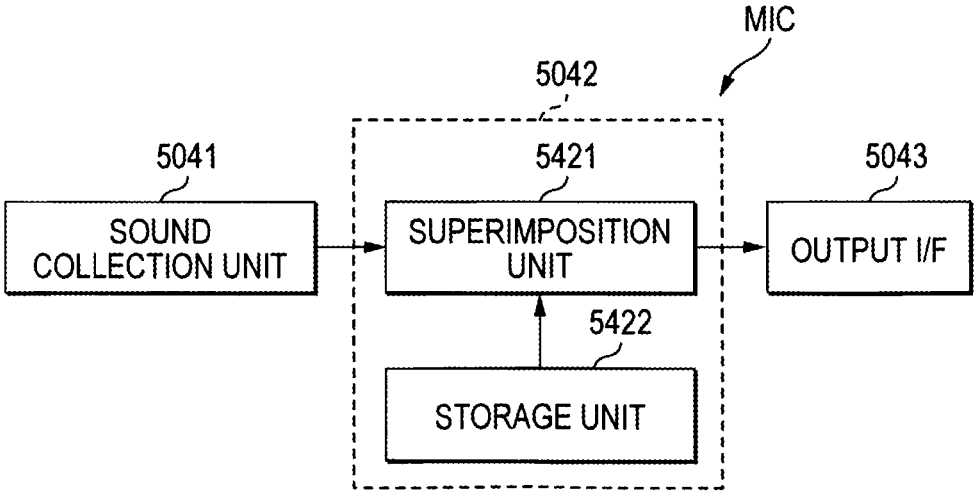
FIG. 48 is a block diagram showing the function and configuration of a microphone according to the sixth embodiment.
Figure 49:
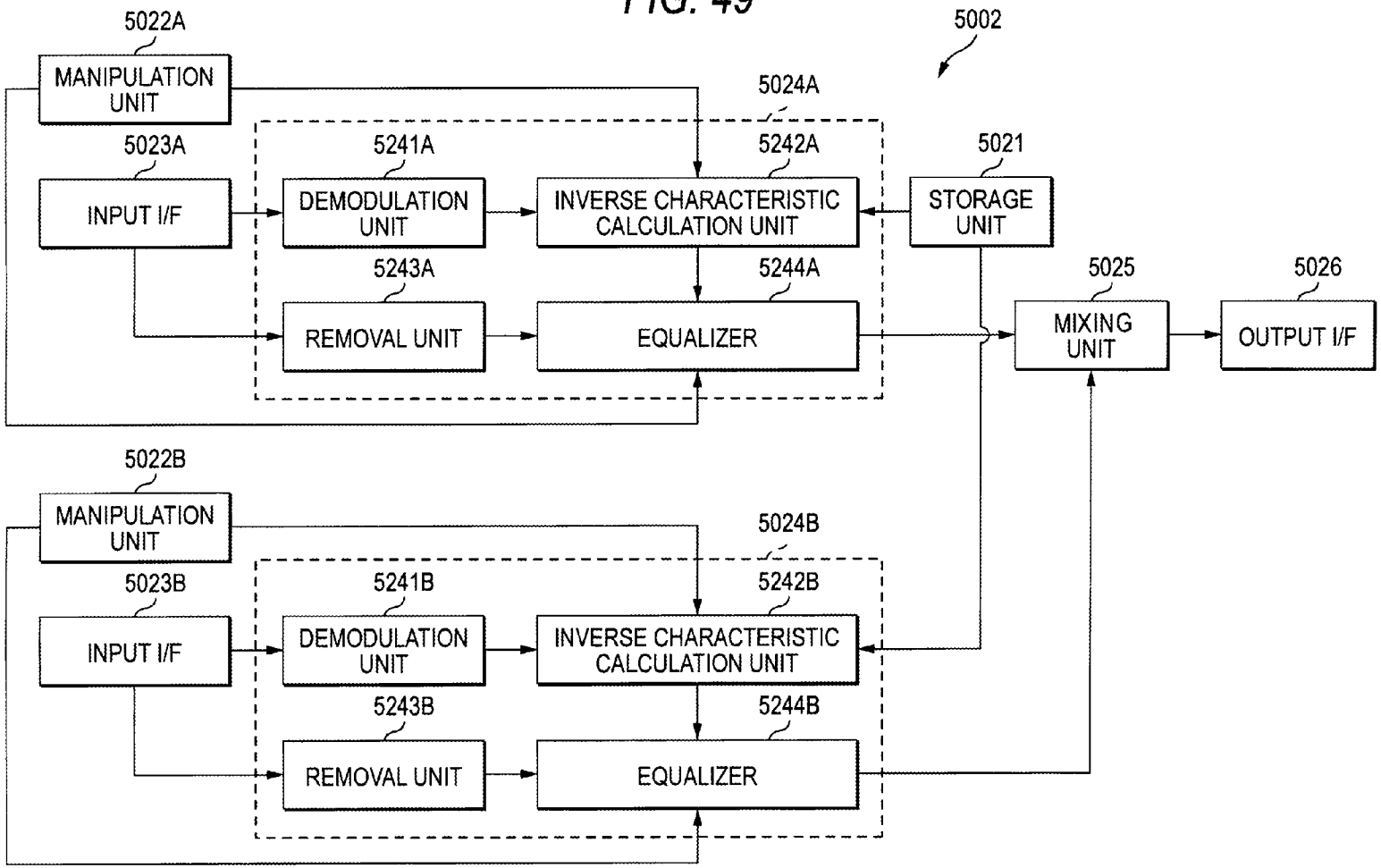
FIG. 49 is a block diagram showing the function and configuration of a mixer according to the sixth embodiment.
Figure 50:
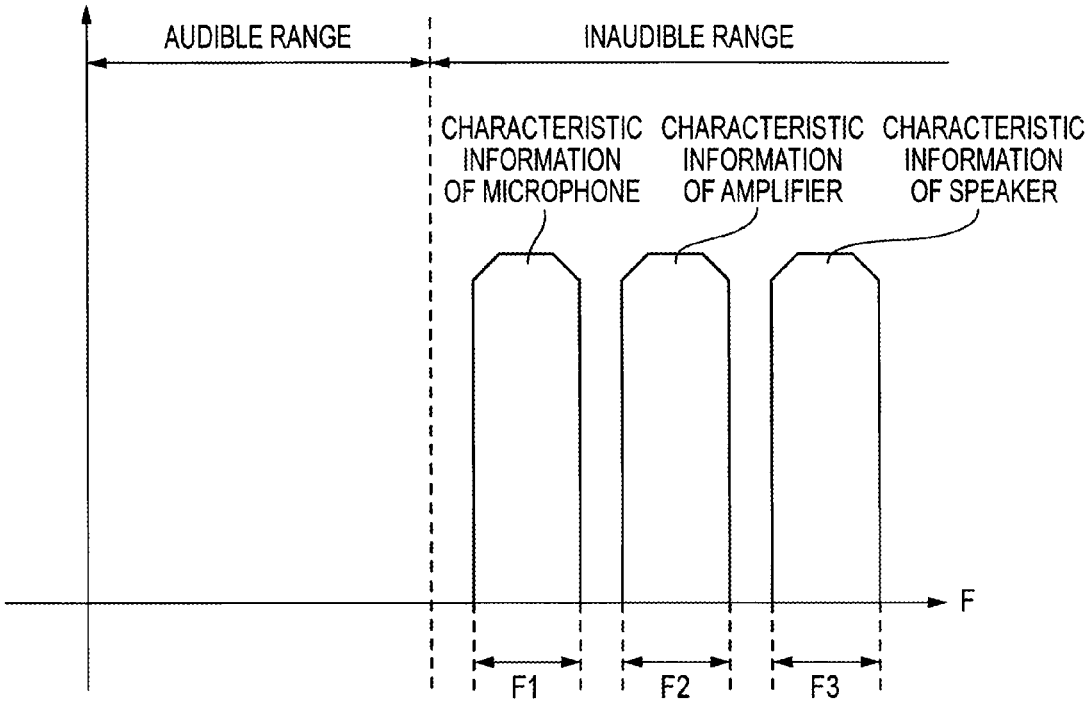
FIG. 50 shows an example of a frequency band for superimposition of an identification information sound signal according to the sixth embodiment.

Next, the function and configuration of each audio device will be described with reference to FIGS. 46 to 50. FIG. 46 is a block diagram showing the function and configuration of the amplifier. FIG. 47 is a block diagram showing the function and configuration of the speaker. FIG. 48 is a block diagram showing the function and configuration of the microphone. FIG. 49 is a block diagram showing the function and configuration of the mixer. FIG. 50 shows an example of a frequency band for superimposition of an identification information sound signal.

First, the function and configuration of the amplifier 5003 will be described. As shown in FIG. 46, the amplifier 5003 includes an input I/F 5031, a superimposition processing unit 5032, and an output I/F 5033. The superimposition processing unit 5032 includes a superimposition unit 5321 and a storage unit 5322. The storage unit 5322 stores characteristic information indicating the frequency characteristic of the output with respect to input of the own device (amplifier 5003).

The input I/F 5031 outputs the mixed sound-collected signal input from the mixer 5002 described below to the superimposition unit 5321 of the superimposition processing unit 5032. The superimposition unit 5321 acquires the characteristic information of the own device from the storage unit 5322, superimposes the characteristic information on a frequency band F2 (see FIG. 50) in the inaudible range of the mixed sound-collected signal from the input I/F 5031, and outputs the resultant mixed sound-collected signal to the output I/F 5033. The output I/F 5033 outputs the mixed sound-collected signal to the subsequent-stage speaker SP. As shown in FIG. 50, for the respective audio devices, frequency bands F1 to F3 on which the characteristic information is superimposed are defined in advance. For this reason, the superimposition unit 5321 superimposes the characteristic information on the frequency band F2 allocated to the own device.

Next, the function and configuration of the speaker SP will be described. As shown in FIG. 47, the speaker SP includes an input I/F 5051, a superimposition processing unit 5052, and a sound emission unit 5053. The superimposition processing unit 5052 includes a superimposition unit 5521 and a storage unit 5522. The storage unit 5522 stores characteristic information indicating the frequency characteristic of the output with respect to the input of the own device (speaker SP).

The input I/F 5051 outputs the mixed sound-collected signal input from the amplifier 5003 to the superimposition unit 5521 of the superimposition processing unit 5052. The superimposition unit 5521 acquires the characteristic information of the own device from the storage unit 5522, superimposes the characteristic information on the frequency band F3 (see FIG. 50) in the inaudible range of the mixed sound-collected signal from the input I/F 5051, and outputs the resultant mixed sound-collected signal to the sound emission unit 5053. The sound emission unit 5053 emits sound on the basis of the mixed sound-collected signal.

Next, the function and configuration of the two microphones MIC1 and MIC2 will be described. The two microphones have the same function and configuration, thus description will be provided for the microphone MIC1 as a representative. As shown in FIG. 48, the microphone MIC1 includes a sound collection unit 5041, a superimposition processing unit 5042, and an output I/F 5043. The superimposition processing unit 5042 includes a superimposition unit 5421 and a storage unit 5422. The storage unit 5422 stores characteristic information indicating the frequency characteristic of the output with respect to the input of the own device (microphone MIC1).

The sound collection unit 5041 collects ambient sound (uttered sound, sound emitted from the speaker SP, noise, and the like) to generate a sound-collected signal, and outputs the sound-collected signal to the superimposition unit 5421 of the superimposition processing unit 5042. The superimposition unit 5421 acquires the characteristic information of the own device from the storage unit 5422, superimposes the characteristic information on the frequency band F1 (see FIG. 50) in the inaudible range of the sound-collected signal from the sound collection unit 5041, and outputs the resultant sound-collected signal to the output I/F 5043. The output I/F 5043 outputs the sound-collected signal to the subsequent-stage mixer 5002.

Finally, the function and configuration of the mixer 5002 will be described. As shown in FIG. 49, the mixer 5002 includes a storage unit 5021, a mixing unit 5025, and an output I/F 5026, and a manipulation unit 5022A, an input I/F 5023A, and a correction processing unit (corresponding to a correction device of the invention) 5024A in accordance with the number of channels. In this embodiment, the mixer 5002 are connected to the two microphones and includes two channels, thus the mixer 5002 further includes a manipulation unit 5022B, an input I/F 5023B, and a correction processing unit 5024B. The manipulation unit 5022A and the manipulation unit 5022B, the input I/F 5023A and the input I/F 5023B, and the correction processing unit 5024A and the correction processing unit 5024B respectively have the same function and configuration. Thus, description will be provided for the manipulation unit 5022A, the input I/F 5023A, and the correction processing unit 5024A.

The storage unit 5021 stores characteristic information indicating the frequency characteristic of the output with respect to the input of the own device (mixer 5002).

The manipulation unit 5022A receives a manipulation input from the user. For example, the manipulation unit 5022A receives a manipulation input which instructs to change the setting of the equalizer. In this case, the manipulation unit 5022A outputs the manipulation signal to an inverse characteristic calculation unit 5242A and an equalizer 5244A of the correction processing unit 5024A.

The input I/F 5023A outputs the sound-collected signal input from the microphone MIC1 to a demodulation unit 5241A and a removal unit 5243A of the correction processing unit 5024A.

The correction processing unit 5024A is a functional unit which corrects the sound-collected signal on the basis of the frequency characteristic of the closed loop formed by the acoustic system 5001. The frequency characteristics of the closed loop include the frequency characteristics of the respective audio devices constituting the acoustic system 5001, and the frequency characteristics of the space from the speaker SP to the microphone MIC1 and the microphone MIC2. Hence, the frequency characteristics of the closed loop are estimated on the basis of the characteristic information of the respective audio devices of the acoustic system 5001. The correction processing unit 5024A includes a demodulation unit 5241A, an inverse characteristic calculation unit 5242A, a removal unit 5243A, and an equalizer 5244A.

The demodulation unit 5241A demodulates the sound-collected signal to acquire the characteristic information, and outputs the characteristic information to the inverse characteristic calculation unit 5242A. At this time, as shown in FIG. 50, since the frequency bands F1 to F3 are defined for superimposition of the characteristic information for the respective audio devices, the demodulation unit 5241A acquires the characteristic information of the audio devices (the microphone MIC1, the amplifier 5003, and the speaker SP) from the frequency bands F1 to F3.

The inverse characteristic calculation unit 5242A estimates the frequency characteristics of the closed loop to calculate the inverse characteristics of the estimated frequency characteristics. Specifically, since the frequency characteristic of the own device is defined in accordance with the manipulation signal from the manipulation unit 5022A (that is, in accordance with the setting of the equalizer), the inverse characteristic calculation unit 5242A calculates the frequency characteristic according to the setting of the equalizer by using the characteristic information acquired from the storage unit 5021. If there is some space at the installation location of the acoustic system 5001, the frequency characteristics of the closed loop are defined by the frequency characteristics of the audio devices of the closed loop. For this reason, the inverse characteristic calculation unit 5242A averages the frequency characteristics indicated by the characteristic information of the audio devices (the microphone MIC1, the amplifier 5003, and the speaker SP) input from the demodulation unit 5241 and the calculated frequency characteristics, and, when the closed loop is regarded as a single filter, estimates the frequency characteristics of the filter. Then, the inverse characteristic calculation unit 5242A calculates the inverse characteristics of the estimated frequency characteristics and outputs the inverse characteristics to the equalizer 5244A.

If the manipulation signal from the manipulation unit 5022A is input (that is, the setting of the equalizer is changed), the frequency characteristic of the own device is changed or the system of the acoustic system 5001 forming the closed loop is changed, thus the inverse characteristic calculation unit 5242A estimates the frequency characteristics again.

The removal unit 5243A is a low-pass filter, removes the frequency bands F1 to F3 (see FIG. 50), on which the characteristic information of the audio devices (the microphone MIC1, the amplifier 5003, and the speaker SP) is superimposed, from the sound-collected signals, and outputs the resultant sound-collected signals to the equalizer 5244A. The removal unit 5243A is not an essential part. The mixer 5002 includes the removal unit 5243A, preventing re-superimposition of the characteristic information.

The equalizer 5244A changes the frequency characteristic of the sound-collected signals input from the removal unit 5243A in accordance with the manipulation signal from the manipulation unit 5022A. Then, the equalizer 5244A corrects the changed, sound-collected signals on the basis of the inverse characteristic input from the inverse characteristic calculation unit 5242A. The equalizer 5244A outputs the corrected, sound-collected signals to the mixing unit 5025.

The mixing unit 5025 mixes the sound-collected signals input from the equalizer 5244A of the correction processing unit 5024A and the equalizer 5244B of the correction processing unit 5024B to generate the mixed sound-collected signal. The mixing unit 5025 outputs the mixed sound-collected signal to the output I/F 5026. The output I/F 5026 outputs the mixed sound-collected signal to the subsequent-stage amplifier 5003.

As described above, the audio devices (the microphone MIC1, the microphone MIC2, the amplifier 5003, and speaker SP) respectively superimpose the characteristic information thereof on the sound signals, and output the resultant sound signals. The mixer 5002 demodulates the sound signals to acquire the characteristic information of the audio devices (the microphone MIC1, the microphone MIC2, the amplifier 5003, and the speaker SP), estimates the frequency characteristics of the closed loop on the basis of the acquired characteristic information and the characteristic information of the own devices, and corrects the sound-collected signals with the inverse characteristics of the estimated frequency characteristics. For this reason, the acoustic system 5001 can estimate the frequency characteristics of the closed loop in accordance with the changes of the audio devices constituting the acoustic system 5001 with a low load, preventing occurrence of howling. Even when the settings of the audio devices are changed, since the audio devices superimpose the frequency characteristics, the acoustic system 5001 can estimate the frequency characteristics of the closed loop in accordance with changes of the system, preventing occurrence of howling.

Figure 51:
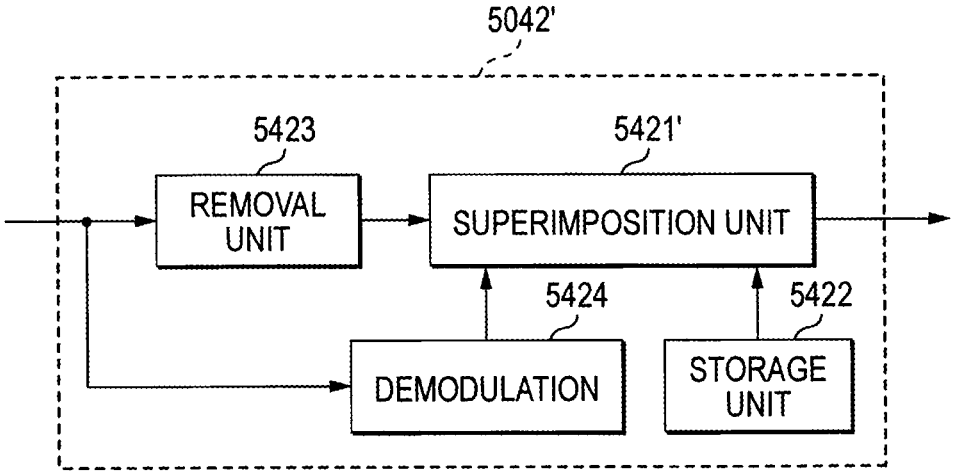
FIG. 51 is a block diagram showing the function and configuration of a superimposition processing unit according to a modification of the sixth embodiment.

In the above-described embodiment, the audio devices (the microphone MIC1, the microphone MIC2, the amplifier 5003, and the speaker SP) superimpose the characteristic information thereof on the different frequency bands. However, the audio device (the microphone MIC1, the microphone MIC2, the amplifier 5003, or the speaker SP) may acquire characteristic information superimposed on a specific frequency band, and may then superimpose the acquired characteristic information on the specific frequency band together with the frequency characteristic thereof. FIG. 51 is a block diagram showing the function and configuration of a superimposition processing unit according to a modification of this embodiment. A superimposition processing unit 5042' of each microphone, a superimposition processing unit 5032' of the amplifier 5003, and a superimposition processing unit 5052' of the speaker SP have the same function and configuration, thus description will be provided for the superimposition processing unit 5042' of the microphone MIC1 as an example.

In this case, as shown in FIG. 51, the superimposition processing unit 5042' includes a removal unit 5423, a demodulation unit 5424, a superimposition unit 5421', and a storage unit 5422 which stores the characteristic information of the own device. The removal unit 5423 is a low-pass filter, removes the frequency band, on which the characteristic information is superimposed, from the input sound-collected signal, and outputs the sound-collected signal after the removal to the superimposition unit 5421'. The demodulation unit 5424 demodulates the input sound-collected signal to acquire the characteristic information, and outputs the characteristic information to the superimposition unit 5421'. The superimposition unit 5421' superimposes the characteristic information from the demodulation unit 5424 and the characteristic information of the own device acquired from the storage unit 5422 on the sound-collected signal input from the removal unit 5423, and outputs the resultant sound-collected signal. As described above, the superimposition processing unit 5042' acquires the characteristic information superimposed in advance from the input sound-collected signal, superimposes the acquired characteristic information on the sound-collected signal together with the characteristic information of the own device, and outputs the resultant sound-collected signal. Therefore, the characteristic information can be superimposed, regardless of the audio devices constituting the acoustic system 5001.

Although in the above-described embodiment, the characteristic information is superimposed by using the frequency-division multiplexing method, other methods, such as a time-division multiplexing method, may be used.

Figure 52:
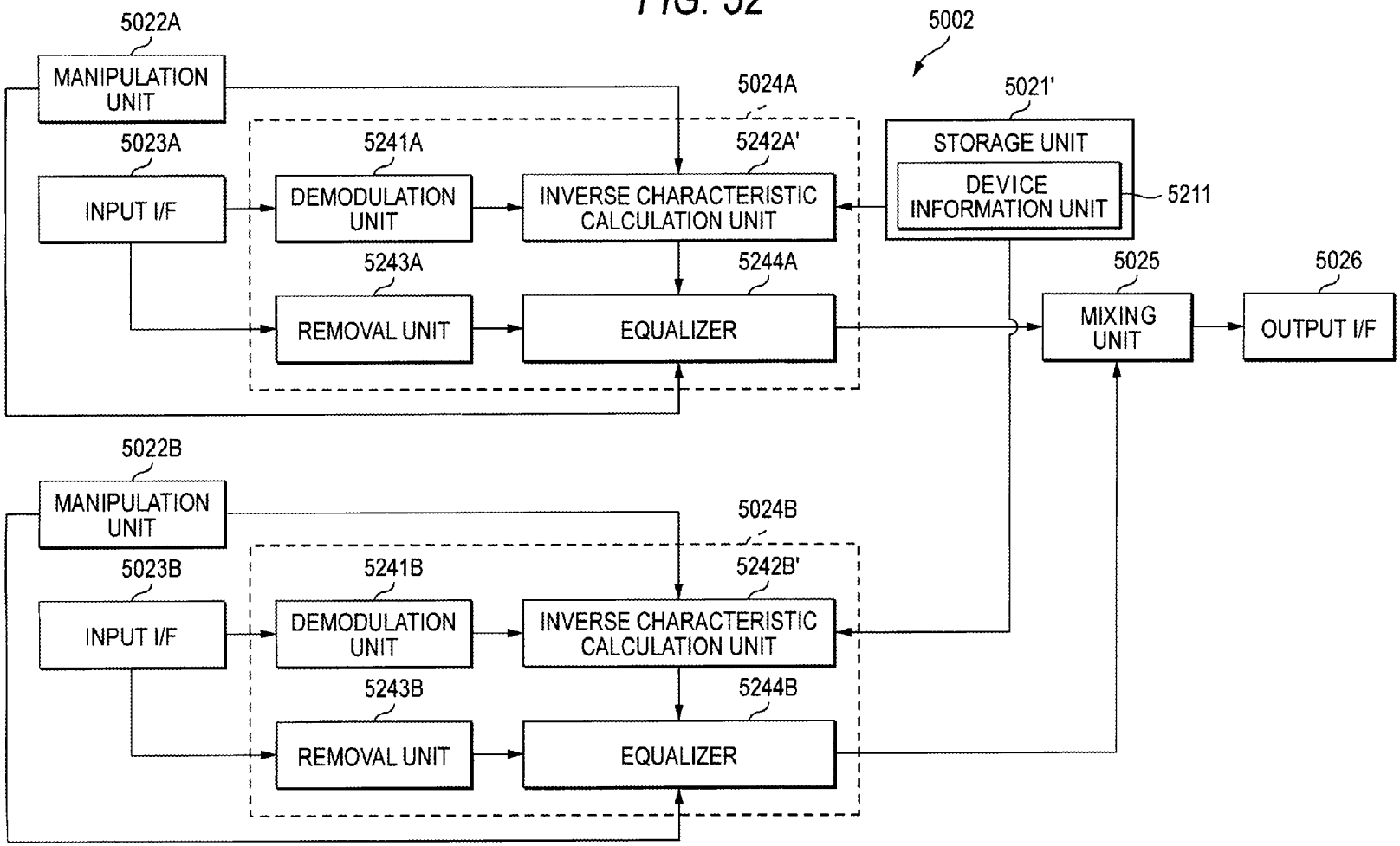
FIG. 52 is a block diagram showing the function and configuration of a mixer according to a modification of the sixth embodiment.

In the above-described embodiment, each audio device (the microphone MIC1, the microphone MIC2, the mixer 5002, the amplifier 5003, or the speaker SP) stores the characteristic information thereof and superimposes the characteristic information on the sound signal. However, each audio device may store the identification information thereof, instead of the frequency characteristic thereof, and may superimpose the identification information thereof. FIG. 52 is a block diagram showing the function and configuration of a mixer according to a modification of this embodiment. FIG. 53 shows an example of a device information list. In this case, as shown in FIG. 52, the functions of a storage unit 5021' and an inverse characteristic calculation unit 5242A' in a mixer 5002 are different from those in the above-described embodiment. Hereinafter, only the differences will be described.

The storage unit 5021 stores a device information list 5211 shown in FIG. 52, in addition to the identification information of the own device. The device information list 5211 registers the identification information of the audio devices and the characteristic information according to the identification information in association with each other. The device information list 5211 is updated through download from the server device through a network or the like or through registration according to a manipulation input of the user.

The inverse characteristic calculation unit 5242A' acquires the identification information of the audio devices (the microphone MIC1, the microphone MIC2, the amplifier 5003, and the speaker SP) input from the demodulation unit 5241A and the characteristic information corresponding to the identification information of the own devices from the device information list 5211. Then, the inverse characteristic calculation unit 5242A' estimates the frequency characteristics of the closed loop on the basis of the acquired characteristic information. The inverse characteristic calculation unit 5242A' calculates the inverse characteristics of the estimated frequency characteristics and outputs the inverse characteristics to the equalizer 5244A.

As described above, the mixer 5002 estimates the frequency characteristics of the closed loop on the basis of the identification information superimposed on the sound signals by the audio devices (the microphone MIC1, the microphone MIC2, the amplifier 5003, and the speaker SP) and the identification information of the own devices. The mixer 5002 calculates the inverse characteristics of the estimated frequency characteristics and corrects the sound signals. Therefore, it should suffice that the audio devices (the microphone MIC1, the microphone MIC2, the amplifier 5003, and the speaker SP) superimpose the identification information having a small data amount, instead of the characteristic information having a large data amount, on the sound signals.

In the above-described embodiment, the correction processing unit 5024A is provided in the mixer 5002, and the mixer 5002 corrects the frequency characteristics. However, a correction device including the correction processing unit 5024A may be provided in front of the mixer 5002 for each sound signal.

Although in the above-described embodiment, the frequency characteristic of the sound signal is corrected, the gain characteristic indicating the change in amplitude of the sound signal may be corrected. In this case, each audio device (the microphone MIC1, the microphone MIC2, the amplifier 5003, or the speaker SP) superimposes characteristic information indicating the gain characteristic, which indicates the change in amplitude with respect to the input thereof, on the sound signal. Then, the mixer 5002 acquires the characteristic information superimposed on the sound signal, and estimates the gain characteristic of the closed loop on the basis of the acquired characteristic information. The mixer 5002 corrects the sound signal with the inverse characteristic of the estimated gain characteristic (specifically, reduces the gain of the sound signal). Therefore, even when the sound signals are mixed and the gain excessively increases, the mixer 5002 can correct the gain such that sound is not cracked at the time of sound emission, and can output the sound signal.

The acoustic system of this embodiment includes multiple audio devices (for example, a microphone, a mixer, an amplifier, a speaker, and the like) and a correction device. The audio devices are configured such that sound emitted from the speaker is collected by the microphone, and emitted from the speaker through the mixer and the amplifier, forming a closed loop. The audio devices superimpose the characteristic information indicating the gain characteristics thereof (for example, the frequency characteristics or the gain characteristics indicating the changes in amplitude) on the sound signals and output the resultant sound signals. The correction device demodulates the characteristic information of the audio devices from the input sound signals, and estimates the gain characteristic of the closed loop on the basis of the characteristic information. For example, the correction device averages the gain characteristics of the audio devices and regards the averaged gain characteristic as the gain characteristic of the closed loop. Then, the correction device corrects the input sound signals with the inverse characteristic of the estimated gain characteristic. The correction device may be implemented by software installed on any audio device.

Therefore, the acoustic system can estimate the gain characteristic of the closed loop in accordance with the change of the system (for example, changes of the audio device constituting the acoustic system 5001, changes in the setting of the audio devices, or the like) with a low load, preventing howling.

The acoustic system of this embodiment includes multiple microphones as the audio devices. Then, the correction device corrects the sound signal of each of the microphones.

Therefore, even when there are multiple closed loops, the acoustic system can estimate the gain characteristic for each closed loop, preventing howling.

The audio devices in the acoustic system of this embodiment superimpose the identification information for identifying the audio devices, instead of the characteristic information, on the sound signals, and output the resultant sound signals. The correction device stores the identification information and the characteristic information in association with each other. The correction device demodulates and acquires the identification information of the audio devices from the input sound signals, and acquires the characteristic information corresponding to the identification information. The correction device estimates the gain characteristic of the closed loop on the basis of the acquired characteristic information.

Therefore, it should suffice that the acoustic system superimposes only the identification information having a small data amount, instead of the gain characteristic having a large data amount, on the sound signal.

This application is based on Japanese Patent Application No. 2008-196492 filed on Jul. 30, 2008, Japanese Patent Application No. 2008-249723 filed on Sep. 29, 2008, Japanese Patent Application No. 2008-252075 filed on Sep. 30, 2008, Japanese Patent Application No. 2008-253532 filed on Sep. 30, 2008, Japanese Patent Application No. 2008-310402 filed on Dec. 5, 2008, and Japanese Patent Application No. 2008-331081 filed on Dec. 25, 2008, the contents of which are incorporated herein by reference.

INDUSTRIAL APPLICABILITY

According to the invention, it is practical in that, the identification information of the audio signal output device superimposed on the analog audio signal is used, thus the wirings of the devices in the audio signal processing system, such as a PA system, can be facilitated, and the settings of the adjustment parameters of the respective audio devices in the system can be automatically carried out.

The invention claimed is:

1. A display device comprising:

multiple input reception units to which respective analog audio signals, on which watermark information indicating corresponding identification information of respective audio devices are superimposed, are input from the respective audio devices;

an extraction unit adapted to extract the identification information from the respective analog audio signals input to the multiple input reception units; and a display unit adapted to perform display depending on the identification information extracted by the extraction unit in correspondence with the input reception unit to which the analog audio signal, from which the identification information is extracted, is input.

2. The display device according to claim 1, further comprising:

a manipulation unit for inputting specific identification information different from the identification information;

a mixing unit adapted to mix the analog audio signals input from the input reception unit each other;

a superimposition unit adapted to superimpose the specific identification information input from the manipulation unit on the analog audio signals mixed by the mixing unit; and an output unit that outputs the analog audio signals superimposed by the superimposition unit.

3. An audio signal processing device comprising:

a display device; and a signal processing unit, wherein the display device includes:

multiple input reception units to which respective analog audio signals, on which watermark information indicating corresponding identification information of respective audio devices are superimposed, are input from the respective audio devices;

an extraction unit adapted to extract the identification information from the respective analog audio signals input to the multiple input reception units; and a display unit adapted to perform display depending on the identification information extracted by the extraction unit in correspondence with the input reception unit to which the analog audio signal, from which the identification information is extracted, is input, and wherein the signal processing unit performs signal processing set in advance for the analog audio signal input to the input reception unit and output the processed analog audio signal.

4. The audio signal processing device according to claim 3, wherein the signal processing unit performs signal processing depending on the identification information extracted by the extraction unit for the analog audio signal from which the identification information is extracted.

5. The audio signal processing device according to claim 3, wherein the signal processing unit mixes the analog audio signals subjected to the signal processing each other and outputs the mixed analog audio signal.

6. The audio signal processing device according to claim 3, further comprising a removal unit adapted to remove the watermark information superimposed on the respective analog audio signals.

7. The audio signal processing device according to claim 6, further comprising a re-superimposition unit adapted to superimpose, on the analog audio signal from which the watermark information is removed by the removal unit, the watermark information.

8. The audio signal processing device according to claim 7, wherein:

the signal processing unit performs signal processing for the analog audio signal from which the watermark information is removed by the removal unit, and the re-superimposition unit superimposes, on the analog audio signal which has been subjected to signal processing by the signal processing unit, the watermark information.

9. An audio signal processing system comprising:

an identification information superimposition device including an identification information superimposition unit adapted to superimpose watermark information indicating identification information on an analog audio signal and output the analog audio signal on which the watermark information is superimposed;

a transmission unit adapted to transmit the analog audio signal output from the identification information superimposition unit; and an audio signal processing device including a display device and a signal processing unit, wherein the display device includes:

multiple input reception units to which respective analog audio signals, on which watermark information indicating corresponding identification information of respective audio devices are superimposed, are input from the respective audio devices, wherein one of the multiple input reception units receives the analog audio signal output from the transmission unit;

an extraction unit adapted to extract the identification information from the respective analog audio signals input to the multiple input reception units; and a display unit adapted to perform display depending on the identification information extracted by the extraction unit in correspondence with the input reception unit to which the analog audio signal, from which the identification information is extracted, is input, wherein the signal processing unit performs signal processing set in advance for the analog audio signal input to the input reception unit and output the processed analog audio signal.

10. The audio signal processing system according to claim 9, wherein:

the identification information superimposition device further includes multiple input terminals to which the respective analog audio signals to be supplied are input and which are provided in correspondence with the input reception unit, and when the analog audio signals which are input to the respective input terminals and output with the watermark information superimposed thereon are mixed, the identification information superimposition unit superimposes the watermark information on the respective analog audio signals input to the respective input terminals so that the watermark information superimposed on one analog audio signal does not interfere with the watermark information superimposed on another audio signal.

11. The audio signal processing system according to claim 9, wherein the identification information superimposition device further includes:

multiple input terminals to which the analog audio signals to be supplied are input and which are provided in correspondence with the respective input reception units; and a setting unit adapted to set identification information in correspondence with the respective input terminals, wherein for each of the analog audio signals to be supplied, the watermark information superimposed by the identification information superimposition unit indicates the identification information which is set in correspondence with the input terminal to which the analog audio signal is supplied.

12. An audio signal processing device comprising:

multiple input reception units to which respective analog audio signals, on which watermark information indicating corresponding identification information of respective audio devices are superimposed, are input from the respective audio devices;

an extraction unit adapted to extract the identification information from the respective analog audio signals input to the multiple input reception units; and a signal processing unit adapted to perform signal processing depending on the identification information extracted by the extraction unit for the analog audio signal, from which the identification information is extracted, and output the processed analog audio signal.

13. The audio signal processing device according to claim 12, further comprising:

a manipulation unit for inputting specific identification information different from the identification information;

a mixing unit adapted to mix the analog audio signals input from the input reception unit each other;

a superimposition unit adapted to superimpose the specific identification information input from the manipulation unit on the analog audio signal mixed by the mixing unit; and an output unit that outputs the analog audio signals superimposed by the superimposition unit.

14. The audio signal processing device according to claim 13, further comprising:

a removal unit adapted to remove the identification information from the analog audio signals input from the input reception unit, wherein the mixing unit mixes the analog audio signals each other after the removal unit has removed the identification information.

15. The audio signal processing device according to claim 13, further comprising:

a demodulation unit that is adapted to demodulate the analog audio signals input from the input reception unit to acquire the identification information, wherein the superimposition unit superimposes the specific identification information input from the manipulation unit and the identification information acquired by the demodulation unit on the analog audio signals mixed by the mixing unit.

16. The audio signal processing device according to claim 13, further comprising a display unit for displaying the identification information input from the input reception unit.

17. The audio signal processing device according to claim 12, wherein:

the signal processing unit includes multiple signal processing units, each of which process the respective analog audio signals, and the audio signal processing device includes:

a scene memory in which scene data including association information between the multiple signal processing units and the respective audio devices are stored;

an identification information detection unit adapted to detect the audio device connected to each of the input reception units on the basis of the identification information extracted by the extraction unit; and a connection control unit adapted to respectively connect the input reception units to the signal processing units on the basis of the detection result of the identification information detection unit so that each of the audio devices connected to the multiple input reception unit is connected to the signal processing unit according to the association information.

18. The audio signal processing device according to claim 17, wherein when the identification information extracted from the input analog audio signal does not completely coincide with the identification information stored in the storage unit, the connection control unit retrieves an alternative signal processing unit on the basis of the extracted identification information and connects the retrieved alternative signal processing unit and a relevant input reception unit of the multiple reception units.

19. The audio signal processing device according to claim 18, wherein:

the identification information includes a unique number of the relevant audio device, and the connection control unit retrieves identification information in which at least a part of information other than the unique number coincides with the extracted identification information, and retrieves the alternative signal processing unit.

20. The audio signal processing device according to claim 12, wherein:

the signal processing unit includes multiple signal processing units that are respectively connected to the multiple input reception units and each perform audio signal processing based on signal processing parameters, and the audio signal processing device includes:

a scene memory in which signal processing parameters for audio signals of the respective audio devices are stored;

an identification information detection unit adapted to detect the audio device connected to the respective input reception units on the basis of the identification information extracted by the extraction unit; and a control unit that sets signal processing parameters corresponding to the signal processing units on the basis of the detection result of the identification information detection unit such that signal processing corresponding to the audio signal of each of the audio devices is performed.

21. A display method comprising:

an input reception step in which analog audio signals, on which watermark information indicating corresponding identification information of respective audio devices are superimposed, are input from the respective audio devices to multiple input reception units;

an extraction step of extracting the identification information from each of the analog audio signals input to the multiple input reception units; and a display step of performing display depending on the identification information extracted in the extraction step in correspondence with the input reception unit to which the analog audio signal, from which the identification information is extracted, is input.

22. An audio signal processing method comprising:

an input reception step in which analog audio signals, on which watermark information indicating corresponding identification information of respective audio devices are superimposed, are input from the respective audio devices to multiple input reception units;

an extraction step of extracting the identification information from each of the analog audio signals input to the multiple input reception units; and a signal processing step of performing signal processing depending on the identification information extracted in the extraction step for the analog audio signal from which the identification information is extracted and outputting the processed analog audio signal.

23. A signal processing system comprising:

an audio signal processing device; and an external server which is connected to the audio signal processing device, wherein the audio signal processing device includes:

multiple input reception units to which respective analog audio signals, on which watermark information indicating corresponding identification information of respective audio devices are superimposed, are input from the respective audio devices;

an extraction unit adapted to extract the identification information from the respective analog audio signals input to the multiple input reception units;

multiple signal processing units, each of which is adapted to perform signal processing depending on the identification information extracted by the extraction unit for the analog audio signal, from which the identification information is extracted, and output the processed analog audio signal;

a scene memory in which scene data including association information between the multiple signal processing units and the respective audio devices are stored;

an identification information detection unit adapted to detect the audio device connected to each of the input reception units on the basis of the identification information extracted by the extraction unit; and a connection control unit adapted to respectively connect the input reception units to the signal processing units on the basis of the detection result of the identification information detection unit so that each of the audio devices connected to the multiple input reception unit is connected to the signal processing unit according to the association information, wherein, when the identification information extracted from the input analog audio signal does not completely coincide with the identification information stored in the storage unit, the connection control unit retrieves an alternative signal processing unit on the basis of the extracted identification information and connects the retrieved alternative signal processing unit and relevant input reception unit of the multiple input reception units, wherein the identification information superimposed on the analog audio signal input to the input reception unit is the unique number of the relevant audio device, wherein the external server includes a database in which the unique numbers of multiple audio devices and identification information of the audio devices associated with the unique numbers are stored, wherein when the unique number extracted from the input analog audio signal does not coincide with the identification information stored in the scene memory, the connection control unit of the audio signal processing device references the database using the extracted unique number and references the scene memory using the identification information acquired from the database to retrieve the alternative signal processing unit, and wherein the retrieved alternative signal processing unit and the relevant input reception unit are connected to each other.

24. An audio signal processing system comprising:

an audio signal output device;

an audio signal processing device; and a server device, wherein the audio signal output device includes identification information storage unit for storing identification information, and identification information superimposition unit for superimposing the identification information read from the identification information storage unit on analog audio signals and outputting the resultant analog audio signals, wherein the audio signal processing device includes an extraction unit for extracting the identification information from the analog audio signals output from the audio signal output device, and a first communication unit for transmitting the identification information to the server device, wherein the server device includes a setting information storage unit in which setting information, that corresponds to the identification information from the audio signal processing device for setting adjustment parameters of the analog audio signals, are stored in advance, and a second communication unit for, if the identification information is received from the audio signal processing device, transmitting the setting information corresponding to the identification information to the audio signal processing device, and wherein the audio signal processing device further includes a signal processing unit for, if the first communication unit receives the setting information corresponding to the identification information transmitted to the server device from the server device, setting the adjustment parameters of the analog audio signal in accordance with the setting information.

25. The audio signal processing system according to claim 24, wherein, in the server device, default setting information is stored in the setting information storage unit, and when the setting information corresponding to the identification information is not stored in the setting information storage unit, the second communication unit transmits the default setting information to the audio signal processing device.

26. The audio signal processing system according to claim 24, wherein:

the audio signal processing device includes a manipulation unit for setting or changing the adjustment parameters of the audio signals, and if the adjustment parameters of the audio signals are set or changed by the manipulation unit, the first communication unit transmits the setting information of the adjustment parameters and the identification information to the server device, and if the second communication unit receives the setting information of the adjustment parameters and the identification information from the audio signal processing device, the server device causes the setting information storage unit to store the setting information and the identification information in association with each other.

27. An acoustic system comprising:

multiple audio devices which form a closed loop; and an audio signal processing device, wherein the audio signal processing device includes:

multiple input reception units to which respective analog audio signals, on which watermark information indicating corresponding identification information of respective audio devices are superimposed, are input from the respective audio devices;

an extraction unit adapted to extract the identification information from the respective analog audio signals input to the multiple input reception units; and a signal processing unit adapted to perform signal processing depending on the identification information extracted by the extraction unit for the analog audio signal, from which the identification information is extracted, and output the processed analog audio signal, wherein each of the multiple audio devices superimposes characteristic information indicating the gain characteristic of output with respect to input of the audio device as the identification information on the analog audio signal and outputs the resultant analog audio signal.

28. The acoustic system according to claim 27, wherein the signal processing unit of the audio signal processing device demodulates the characteristic information of the audio devices from the input analog audio signals to estimate the gain characteristic of the closed loop, and corrects the analog audio signals with the inverse characteristic of the estimated gain characteristic.

29. The acoustic system according to claim 28, wherein:

the multiple audio devices superimpose information for identifying the audio devices as the identification information on the analog audio signals and output the resultant analog audio signals, and the signal processing unit stores the identification information and the characteristic information in association with each other for the respective audio devices in advance, and demodulates the identification information of the audio devices from the input analog audio signals and acquires the characteristic information corresponding to the identification information of the audio devices to estimate the gain characteristic of the closed loop.

30. The acoustic system according to claim 27, wherein:

the audio devices include multiple microphones, and for each of the analog audio signals output from the microphones, the signal processing unit corrects the relevant analog audio signal.

* * * * *